US011282432B2

(12) United States Patent
Pyo et al.

(10) Patent No.: US 11,282,432 B2
(45) **Date of Patent: *Mar. 22, 2022**

(54) DISPLAY DEVICE AND DRIVING METHOD THEREOF

(71) Applicant: SAMSUNG DISPLAY CO., LTD., Yongin-si (KR)

(72) Inventors: Si Beak Pyo, Yongin-si (KR); Seung Kyu Lee, Yongin-si (KR); Hyun Jung Son, Yongin-si (KR); Yoon Gyu Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/732,744

(22) Filed: Jan. 2, 2020

(65) Prior Publication Data

US 2020/0279518 A1 Sep. 3, 2020

(30) Foreign Application Priority Data

Feb. 28, 2019 (KR) ..... 10-2019-0024131

(51) Int. Cl.
*G09G 5/10* (2006.01)
*G09G 3/20* (2006.01)

(52) U.S. Cl.
CPC ..... *G09G 3/2003* (2013.01); *G09G 3/2074* (2013.01); *G09G 2300/0426* (2013.01); *G09G 2310/027* (2013.01); *G09G 2310/0278* (2013.01); *G09G 2320/0233* (2013.01); *G09G 2320/0242* (2013.01)

(58) Field of Classification Search
CPC .. G09G 3/2003; G09G 3/2074; G09G 3/3413; G09G 3/006; G09G 3/2007; G09G 3/3258; G09G 2300/0426; G09G 2300/0452; G09G 2310/027;
(Continued)

(56) References Cited

U.S. PATENT DOCUMENTS 9,208,718 B2 12/2015 Pyo
9,984,614 B2 5/2018 Hwang
(Continued)

FOREIGN PATENT DOCUMENTS

CN 106340267 1/2017
EP 3637403 4/2020
(Continued)

*Primary Examiner* — Jennifer T Nguyen
(74) *Attorney, Agent, or Firm* — F. Chau & Associates, LLC

(57) ABSTRACT

A display device includes a processor and a display panel for receiving observation grayscale values from the processor. The display panel includes a data driver for applying data voltages to data lines, a target pixel coupled to at least one of the data lines, and observation pixels each coupled to at least one of the data lines, and located adjacent to the target pixel. The display panel applies a first data voltage to the target pixel, when the observation grayscale values for the observation pixels exceed a reference value. The display panel applies a second data voltage to the target pixel, when at least one of the observation grayscale values does not exceed the reference value. The first data voltage and the second data voltage are different from each other.

21 Claims, 40 Drawing Sheets

(58) Field of Classification Search
CPC ... G09G 2310/0278; G09G 2320/0242; G09G 2320/029
USPC ..... 345/690, 82, 83
See application file for complete search history.

(56) References Cited

U.S. PATENT DOCUMENTS

| | | | | |
|---|---|---|---|---|
| 2002/0070948 | A1 | 6/2002 | Murai et al. | |
| 2004/0222999 | A1 | 11/2004 | Choi et al. | |
| 2007/0176862 | A1 | 8/2007 | Kurt et al. | |
| 2007/0252782 | A1 | 11/2007 | Yui | |
| 2008/0211747 | A1 | 9/2008 | Kim | |
| 2009/0009779 | A1* | 1/2009 | Do | H04N 1/50 358/1.9 |
| 2009/0251443 | A1 | 10/2009 | Jinta | |
| 2010/0259556 | A1* | 10/2010 | Inuzuka | H04N 11/06 345/604 |
| 2013/0076803 | A1 | 3/2013 | Lee et al. | |
| 2013/0249955 | A1 | 9/2013 | Kim et al. | |
| 2014/0002864 | A1 | 1/2014 | Li et al. | |
| 2014/0097760 | A1* | 4/2014 | Kato | H05B 45/00 315/192 |
| 2014/0184654 | A1 | 7/2014 | Lee | |
| 2014/0375699 | A1 | 12/2014 | Park et al. | |
| 2015/0070403 | A1 | 3/2015 | Kim et al. | |
| 2016/0049112 | A1* | 2/2016 | Jung | G09G 3/2003 345/694 |
| 2016/0189676 | A1 | 6/2016 | Pyo | |
| 2016/0365024 | A1 | 12/2016 | Pyo | |
| 2017/0011682 | A1 | 1/2017 | Pyo et al. | |
| 2017/0116961 | A1* | 4/2017 | Jun | G09G 3/20 |
| 2017/0287988 | A1* | 10/2017 | Lee | H01L 27/3218 |
| 2019/0130827 | A1 | 5/2019 | Pyo et al. | |
| 2019/0266941 | A1 | 8/2019 | Pyo et al. | |
| 2019/0304372 | A1 | 10/2019 | Pyo et al. | |
| 2019/0340981 | A1 | 11/2019 | Pyo | |
| 2020/0118478 | A1* | 4/2020 | Pyo | G09G 3/3233 |
| 2020/0175924 | A1* | 6/2020 | Bang | G09G 3/3258 |

FOREIGN PATENT DOCUMENTS

| | | |
|---|---|---|
| JP | 2007-199683 | 8/2007 |
| JP | 2011-156214 | 8/2011 |
| KR | 1020170037710 | 4/2017 |
| KR | 1020190049977 | 5/2019 |
| KR | 1020190104086 | 9/2019 |
| KR | 1020190128017 | 11/2019 |
| KR | 10-2020-0040983 | 4/2020 |

* cited by examiner

| | | | | |
|---|---|---|---|---|
| RY40~ RY4255 | RX1Y40~ RX1Y4255 | RX2Y40~ RX2Y4255 | RX3Y40~ RX3Y4255 | RX4Y40~ RX4Y4255 |
| RY30~ RY3255 | RX1Y30~ RX1Y3255 | RX2Y30~ RX2Y3255 | RX3Y30~ RX3Y3255 | RX4Y30~ RX4Y3255 |
| RY20~ RY2255 | RX1Y20~ RX1Y2255 | RX2Y20~ RX2Y2255 | RX3Y20~ RX3Y2255 | RX4Y20~ RX4Y2255 |
| RY10~ RY1255 | RX1Y10~ RX1Y1255 | RX2Y10~ RX2Y1255 | RX3Y10~ RX3Y1255 | RX4Y10~ RX4Y1255 |
| RS00~ RS0255 | RX10~ RX1255 | RX20~ RX2255 | RX30~ RX3255 | RX40~ RX4255 |

FIG. 46

| | | | | |
|---|---|---|---|---|
| BY40~ BY4255 | BX1Y40~ BX1Y4255 | BX2Y40~ BX2Y4255 | BX3Y40~ BX3Y4255 | BX4Y40~ BX4Y4255 |
| BY30~ BY3255 | BX1Y30~ BX1Y3255 | BX2Y30~ BX2Y3255 | BX3Y30~ BX3Y3255 | BX4Y30~ BX4Y3255 |
| BY20~ BY2255 | BX1Y20~ BX1Y2255 | BX2Y20~ BX2Y2255 | BX3Y20~ BX3Y2255 | BX4Y20~ BX4Y2255 |
| BY10~ BY1255 | BX1Y10~ BX1Y1255 | BX2Y10~ BX2Y1255 | BX3Y10~ BX3Y1255 | BX4Y10~ BX4Y1255 |
| BS00~ BS0255 | BX10~ BX1255 | BX20~ BX2255 | BX30~ BX3255 | BX40~ BX4255 |

DISPLAY DEVICE AND DRIVING METHOD THEREOF

CROSS-REFERENCE TO RELATED APPLICATION

The present application claims priority under 35 U.S.C. § 119(a) to Korean patent application no. 10-2019-0024131, filed on Feb. 28, 2019 in the Korean Intellectual Property Office, the disclosure of which is incorporated by reference herein in its entirety.

TECHNICAL FIELD

Exemplary embodiments of the inventive concept relate to a display device and a driving method thereof.

DISCUSSION OF RELATED ART

With the development of information technologies, the importance of a display device as a connection medium between a user and information increases. Accordingly, display devices such as liquid crystal display devices, organic light emitting display devices, and plasma display devices are increasingly used.

An organic light emitting display device includes a plurality of pixels, and allows organic light emitting diodes of the plurality of pixels to emit lights to correspond to a plurality of grayscale values constituting an image frame, thus displaying the image frame.

In general, in the organic light emitting display device, grayscale voltages are set to exhibit a luminance according to a gamma curve preferred by white color light emitted when pixels of different colors emit lights with the same luminance.

Therefore, when mixed color light or single color light instead of the white color light is emitted using the set grayscale voltages, the luminance of the mixed color light or single color light does not accurately correspond to the above-described gamma curve. In addition, lateral leakage may occur where, when the single color light is emitted, holes of driving current flowing through a corresponding pixel are leaked to adjacent pixels having small resistance through a P-doped Hole Injection Layer (PHIL) that is a layer shared by the organic light emitting diodes. Therefore, light may not be emitted with a desired luminance.

SUMMARY

According to an exemplary embodiment of the inventive concept, a display device may include a processor, and a display panel configured to receive observation grayscale values from the processor. The display panel includes a data driver configured to apply data voltages to data lines, a target pixel coupled to at least one of the data lines, and observation pixels each coupled to at least one of the data lines, and located adjacent to the target pixel. The display panel applies a first data voltage to the target pixel, when the observation grayscale values for the observation pixels exceed a reference value, the display panel applies a second data voltage to the target pixel, when at least one of the observation grayscale values does not exceed the reference value, and the first data voltage and the second data voltage are different from each other.

No other pixels may exist between the target pixel and the observation pixels.

The target pixel may emit light of a first color. Some of the observation pixels may emit light of a second color different from the first color, and the others of the observation pixels may emit light of a third color different from the first color and the second color.

When a driving transistor of the target pixel is a P-type transistor, the first data voltage may be larger than the second data voltage.

When a driving transistor of the target pixel is an N-type transistor, the first data voltage may be smaller than the second data voltage.

According to an exemplary embodiment of the inventive concept, a display device may include a target pixel emitting light of a first color, second color observation pixels located adjacent to the target pixel, and emitting light of a second color different from the first color, third color observation pixels located adjacent to the target pixel, and emitting light of a third color different from the first color and the second color, and a grayscale corrector configured to convert an input grayscale value corresponding to the target pixel, with reference to second color observation grayscale values corresponding to the second color observation pixels and third color observation grayscale values corresponding to the third color observation pixels. The grayscale corrector includes a light emitting pixel counter configured to provide a second color light emitting pixel number by counting a number of the second color observation grayscale values that exceed a reference value, and provide a third color light emitting pixel number by counting a number of the third color observation grayscale values that exceed the reference value, and a grayscale converter configured to provide a converted grayscale value obtained by converting the input grayscale value, based on the second color light emitting pixel number and the third color light emitting pixel number.

The grayscale corrector may further include a single color offset provider configured to provide single color offset values. When the second color light emitting pixel number is 0 and the third color light emitting pixel number is 0, the grayscale converter may generate the converted grayscale value by adding a corresponding offset value among the single color offset values to the input grayscale value.

The grayscale corrector may further include a double mixed color offset provider configured to provide double mixed color offset values. When the second color light emitting pixel number is greater than 0 and the third color light emitting pixel number is 0, the grayscale converter may generate the converted grayscale value by adding a corresponding offset value among the double mixed color offset values to the input grayscale value.

The grayscale corrector may further include a triple mixed color offset provider configured to provide triple mixed color offset values. When the second color light emitting pixel number is greater than 0, the third color light emitting pixel number is greater than 0, and the second color light emitting pixel number and the third color light emitting pixel number are not respectively equal to a number of the second color observation pixels and a number of the third color observation pixels, the grayscale converter may generate the converted grayscale value by adding a corresponding offset value among the triple mixed color offset values to the input grayscale value.

The grayscale converter may determine the input grayscale value as the converted grayscale value, when the second color light emitting pixel number is equal to the number of the second color observation pixels and the third color light emitting pixel number is equal to the number of the third color observation pixels.

The single color offset provider may include a single color reference offset provider configured to receive an input maximum luminance value, and provide reference offset values corresponding to the input maximum luminance value, and a single color total offset generator configured to generate the single color offset values by interpolating the reference offset values.

The single color reference offset provider may include a single color preset determiner configured to pre-store preset offset values corresponding to preset maximum luminance values, and determine whether the input maximum luminance value corresponds to any one of the preset maximum luminance values. When the input maximum luminance value corresponds to any one of the preset maximum luminance values, the single color preset determiner may provide the corresponding preset offset values as the reference offset values.

When the input maximum luminance value does not correspond to any one of the preset maximum luminance values, the single color preset determiner may provide the preset offset values corresponding to at least two preset maximum luminance values, and the single color reference offset provider may further include a single reference offset generator configured to generate the reference offset values by interpolating the preset offset values corresponding to the at least two preset maximum luminance values.

The preset maximum luminance values may include a maximum value and a minimum value of the receivable input maximum luminance value.

The preset maximum luminance values may further include a first intermediate maximum luminance value, and when the input maximum luminance value is a value between the maximum value and the first intermediate maximum luminance value, a grayscale voltage corresponding to the converted grayscale value may be adjusted corresponding to the input maximum luminance value.

When the input maximum luminance value is a value between the minimum value and the first intermediate maximum luminance value, an emission period of the target pixel may be adjusted corresponding to the input maximum luminance value.

The preset maximum luminance values may further include a second intermediate maximum luminance value that is a value between the first intermediate maximum luminance value and the minimum value.

According to an exemplary embodiment of the inventive concept, for a method for driving a display device, the display device may include a target pixel configured to emit light of a first color, second color observation pixels located adjacent to the target pixel, and configured to emit light of a second color different from the first color, and third color observation pixels located adjacent to the target pixel, and configured to emit light of a third color different from the first color and the second color. The driving method may include receiving an input grayscale value corresponding to the target pixel, second color observation grayscale values corresponding to the second color observation pixels, and third color observation grayscale values corresponding to the third color observation pixels, determining a second color light emitting pixel number by counting a number of the second color observation grayscale values that exceed a reference value, determining a third color light emitting pixel number by counting a number of the third color observation grayscale values that exceed the reference value, and generating a converted grayscale value by converting the input grayscale value, based on the second color light emitting pixel number and the third color light emitting pixel number.

In the generating of the converted grayscale value, the converted grayscale value may be generated by adding a single color offset value to the input grayscale value, when the second color light emitting pixel number is 0 and the third color light emitting pixel number is 0.

In the generating of the converted grayscale value, the converted grayscale value may be generated by adding a double mixed color offset value to the input grayscale value, when the second color light emitting pixel number is greater than 0 and the third color light emitting pixel number is 0.

In the generating of the converted grayscale value, the converted grayscale value may be generated by adding a triple mixed color offset value to the input grayscale value, when the second color light emitting pixel number is greater than 0, the third color light emitting pixel number is greater than 0, and the second color light emitting pixel number and the third color light emitting pixel number are not respectively equal to a number of the second color observation pixels and a number of the third color observation pixels.

In the generating of the converted grayscale value, the input grayscale value may be determined as the converted grayscale value, when the second color light emitting pixel number is equal to the number of the second color observation pixels, and the third color light emitting pixel number is equal to the number of the third color observation pixels.

The display panel may be further configured to receive an input grayscale value from the processor, and the display panel may apply the first data voltage and the second data voltage when the input grayscale value for the target pixel exceeds the reference value.

According to an exemplary embodiment of the inventive concept, a display panel may include a target pixel connected to a first scan line and a first data line, and configured to emit light of a first color, second color observation pixels located adjacent to the target pixel, connected to scan lines adjacent to the first scan line, and configured to emit light of a second color different from the first color, third color observation pixels located adjacent to the target pixel, connected to the first scan line or the first data line, and configured to emit light of a third color different from the first color and the second color, and a grayscale corrector configured to convert an input grayscale value corresponding to the target pixel to a converted grayscale value, based on whether the second color observation pixels and the third color observation pixels are in an emission state. A pixel is in the emission state when a corresponding grayscale value exceeds a reference value.

No other pixels may exist between the target pixel and the second color observation pixels and between the target pixel and the third color observation pixels.

A second color light emitting pixel number may be a number of the second color observation pixels in the emission state, a third color light emitting pixel number may be a number of the third color observation pixels in the emission state, and the converted grayscale value may be generated based on the second color light emitting pixel number and the third color light emitting pixel number.

The input grayscale value may be determined as the converted grayscale value, when the second color light emitting pixel number is equal to the total number of the second color observation pixels, and the third color light emitting pixel number is equal to the total number of the third color observation pixels.

The input grayscale value added with an offset value may be determined as the converted grayscale value, when the second color light emitting pixel number is not equal to the total number of the second color observation pixels, or the third color light emitting pixel number is not equal to the total number of the third color observation pixels.

BRIEF DESCRIPTION OF THE DRAWINGS

The above and other features of the inventive concept will be more clearly understood by describing in detail exemplary embodiments thereof with reference to the accompanying drawings.

FIGS. 43 to 46 are diagrams illustrating a third double mixed color offset provider and a third triple mixed color offset provider in accordance with an exemplary embodiment of the inventive concept.

DETAILED DESCRIPTION OF THE EMBODIMENTS

Figure 1:
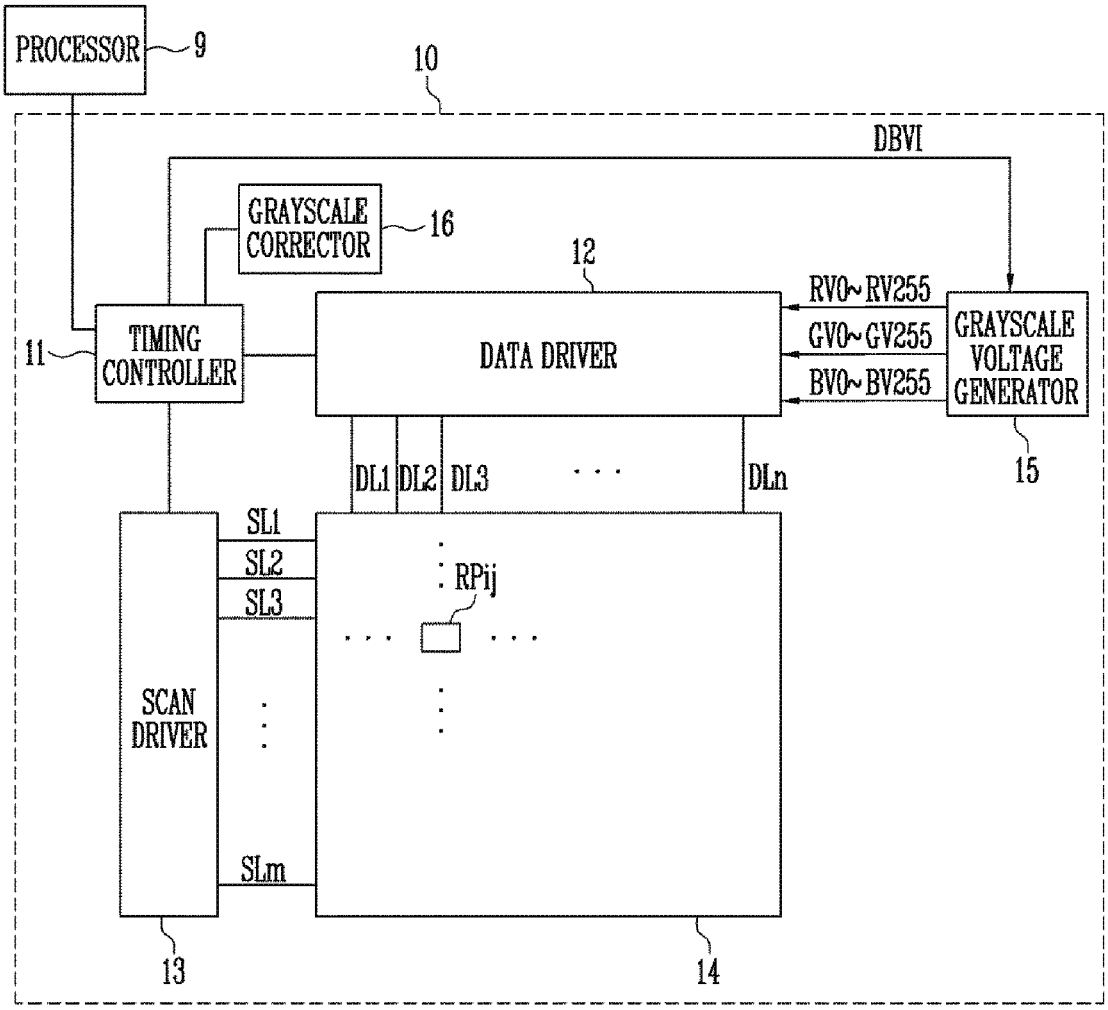
FIG. 1 is a diagram illustrating a display device in accordance with an exemplary embodiment of the inventive concept.

Exemplary embodiments of the inventive concept provide a display device capable of exhibiting a desired luminance even when single color light and mixed color light are emitted in addition to white color light, and a driving method of the display device.

Exemplary embodiments of the inventive concept will be described more fully hereinafter with reference to the accompanying drawings. Like reference numerals may refer to like elements throughout this application.

FIG. 1 is a diagram illustrating a display device in accordance with an exemplary embodiment of the inventive concept.

Referring to FIG. 1, the display device in accordance with an exemplary embodiment of the inventive concept may include a processor 9 and a display panel 10. For example, the display panel 10 may include a timing controller 11, a data driver 12, a scan driver 13, a pixel unit 14, a grayscale voltage generator 15, and a grayscale corrector 16.

The processor 9 may provide grayscale values and control signals with respect to an image frame. The processor 9 may be an application processor, a Central Processing Unit (CPU), a Graphics Processing Unit (GPU), etc. The processor 9 may provide grayscale values to be matched to a structure (e.g., a pentile structure or an RGB stripe structure) of the pixel unit 14. For example, the processor 9 may provide grayscales to correspond one-to-one to pixels RPij included in the pixel unit 14. The processor 9 may also provide grayscale values regardless of the structure of the pixel unit 14. The processor 9 may provide a red grayscale value, a green grayscale value, and a blue grayscale value with respect to one dot. A number of the grayscale values may be different from that of the pixels included in the pixel unit 14.

The timing controller 11 may receive grayscale values and control signals with respect to an image frame from the processor 9. When the processor 9 provides grayscale values to be matched to the structure of the pixel unit 14, the timing controller 11 may provide the received grayscale values to the grayscale corrector 16. When the processor 9 provides grayscale values regardless of the structure of the pixel unit 14, the timing controller 11 may generate grayscale values rendered to correspond one-to-one to the pixels included in the pixel unit 14 by rendering the received grayscale values, and provide the rendered grayscale values to the grayscale corrector 16.

The grayscale corrector 16 may provide converted grayscale values by correcting grayscale values.

The timing controller 11 may provide such converted grayscale values and control signals to the data driver 12. Additionally, the timing controller 11 may provide a clock signal, a scan start signal, etc. to the scan driver 13.

The data driver 12 may generate data voltages to be provided to data lines DL1, DL2, DL3, . . . , and DLn by using the converted grayscale values and the control signals, which are received from the timing controller 11. For example, the data driver 12 may sample the converted grayscale values by using a clock signal, and apply data voltages corresponding to the converted grayscale values to the data lines DL1 to DLn in units of pixel rows. Here, n may be an integer greater than 0. The data voltages may correspond to grayscale voltages RV0 to RV255, GV0 to GV255, and BV0 to BV255 provided from the grayscale voltage generator 15.

In other words, different data voltages may be generated based on the converted grayscale values. The grayscale values for pixels may be compared to a reference value to determine an emission state of the pixels. Different grayscale values result in different converted grayscale values. As such, for example, a first data voltage may be generated and applied to a target pixel, when an input grayscale value for the target pixel exceeds the reference value and the grayscale values for observation pixels adjacent to the target pixel exceed the reference value. A second data voltage different from the first data voltage may be generated and applied to the target pixel, when the input grayscale value exceeds the reference value and at least one of the grayscale values for the observation pixels does not exceed the reference value. This will be described in further detail below with reference to FIGS. 12 to 46.

The scan driver 13 may generate scan signals to be provided to scan lines SL1, SL2, SL3, . . . , and SLm by receiving the clock signal, the scan start signal, etc. from the timing controller 11. For example, the scan driver 13 may sequentially provide scan signals having a pulse of a turn-on level to the scan lines SL1 to SLm. For example, the scan driver 13 may be configured in a shift register form, and generate scan signals in a manner that sequentially transfers the scan start signal in the form of a pulse of a turn-on level to a next scan stage circuit in response to the clock signal. Here, p may be an integer that is not 0. Here, m may be an integer greater than 0.

The pixel unit 14 includes pixels. Each pixel RPij may be coupled to a corresponding data line and a corresponding scan line. Here, i and j may be integers greater than 0. The pixel RPij may refer to a pixel coupled to an ith scan line and a jth data line.

The pixel unit 14 may include pixels emitting light of a first color, pixels emitting light of a second color, and pixels emitting light of a third color. The first color, the second color, and the third color may be colors different from one another. For example, the first color may be one color among red, green, and blue colors, the second color may be another color different from the first color among the red, green, and blue colors, and the third color may be another color different from the first color and the second color among the red, green, and blue colors. In addition, magenta, cyan, and yellow colors may be used instead of the red, green, and blue colors as the first to third colors. However, for convenience of description, a case is described where the red, green, and blue colors are used as the first to third colors, the magenta color is expressed as a combination of the red and blue colors, the cyan color is expressed as a combination of the green and blue colors, and the yellow color is expressed as a combination of the red and green colors.

Hereinafter, a case where the pixel unit 14 is disposed in a diamond pentile structure is assumed and described. However, even if the pixel unit 14 is disposed in another structure, e.g., an RGB-stripe structure, an S-stripe structure, a real RGB structure, a normal pentile structure, etc., those skilled in the art may implement the inventive concept by appropriately setting a target pixel and observation pixels, which will be described later.

Hereinafter, the position of the pixel RPij is described with respect to the position of each light emitting diode (particularly, an emitting layer). The position of a pixel circuit coupled to each light emitting diode may not correspond to that of the light emitting diode, and the pixel circuit and the light emitting diode may be appropriately disposed so as to achieve space efficiency.

The grayscale voltage generator 15 may receive an input maximum luminance value DBVI, and provide the grayscale voltages RV0 to RV255 with respect to the pixels of the first color, the grayscale voltages GV0 to GV255 with respect to the pixels of the second color, and the grayscale voltages BV0 to BV255 with respect to the pixels of the third color, which correspond to the input maximum luminance value DBVI. Hereinafter, for convenience of description, a case is described where a total of 256 grayscales from grayscale 0 (minimum grayscale) to 155 (maximum grayscale) exist. However, when a grayscale value is expressed with eight bits or more, a larger number of grayscales may exist.

A maximum luminance value may be a luminance value of light emitted from pixels, corresponding to the maximum grayscale. For example, the maximum luminance value may be a luminance value of white color light generated when a pixel of the first color emits light corresponding to the grayscale 255, a pixel of the second color emits light corresponding to the grayscale 255, and a pixel of the third color emits light corresponding to the grayscale 255. The pixel of the first color, the pixel of the second color, and the pixel of the third color constitute one dot. The unit of the luminance value may be nit.

Therefore, the pixel unit 14 may display a partially (spatially) dark or bright image frame, but the maximum brightness of the image frame is limited to the maximum luminance value. Such a maximum luminance value may be manually set by manipulation of a user with respect to the display panel 10, or be automatically set by an algorithm associated with an illumination sensor, etc. The set maximum luminance value is expressed as an input maximum luminance value.

The maximum luminance value may vary depending on products. However, for example, the maximum value of the maximum luminance value may be 1200 nits, and the minimum value of the maximum luminance value may be 4 nits. When the input maximum luminance value DBVI varies with respect to the same grayscale value, the grayscale voltage generator 15 provides other grayscale values RV0 to RV255, GV0 to GV255, and BV0 to BV255, and therefore, the light emitting luminance of the pixel varies.

The grayscale corrector 16 may correct an input grayscale value to a converted grayscale value as described above. The grayscale corrector 16 will be described in detail with reference to FIG. 15.

In the above-described exemplary embodiment, a case where the grayscale corrector 16 is a component separate from the timing controller 11 is illustrated. However, in exemplary embodiments of the inventive concept, a portion or the whole of the grayscale corrector 16 may be integrally configured with the timing controller 11. For example, a portion or the whole of the grayscale corrector 16 may be configured together with the timing controller 11 in an integrated circuit form. In exemplary embodiments of the inventive concept, a portion or the whole of the grayscale corrector 16 may be implemented in a software manner in the timing controller 11.

In an exemplary embodiment of the inventive concept, a portion or the whole of the grayscale corrector 16 may be configured together with the data driver 12 in an integrated circuit form. In exemplary embodiments of the inventive concept, a portion or the whole of the grayscale corrector 16 may be implemented in a software manner in the data driver 12. Therefore, the timing controller 11 may provide input grayscale values to the data driver 12, and the grayscale corrector 16 or the data driver 12 may autonomously correct the input grayscale values to converted grayscale values.

In an exemplary embodiment of the inventive concept, a portion or the whole of the grayscale corrector 16 may be configured together with the processor 9 in an integrated circuit form. In an exemplary embodiment of the inventive concept, a portion or the whole of the grayscale corrector 16 may be implemented in a software manner in the processor 9. Therefore, the timing controller 11 may directly receive converted grayscale values from the processor 9.

Figure 2:
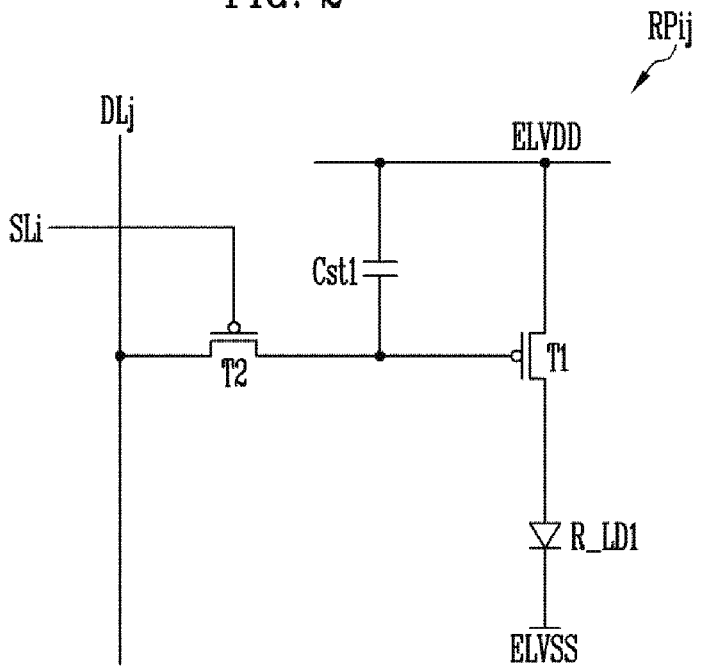
FIG. 2 is a diagram illustrating a pixel of the display device shown in FIG. 1 in accordance with an exemplary embodiment of the inventive concept.
Figure 3:
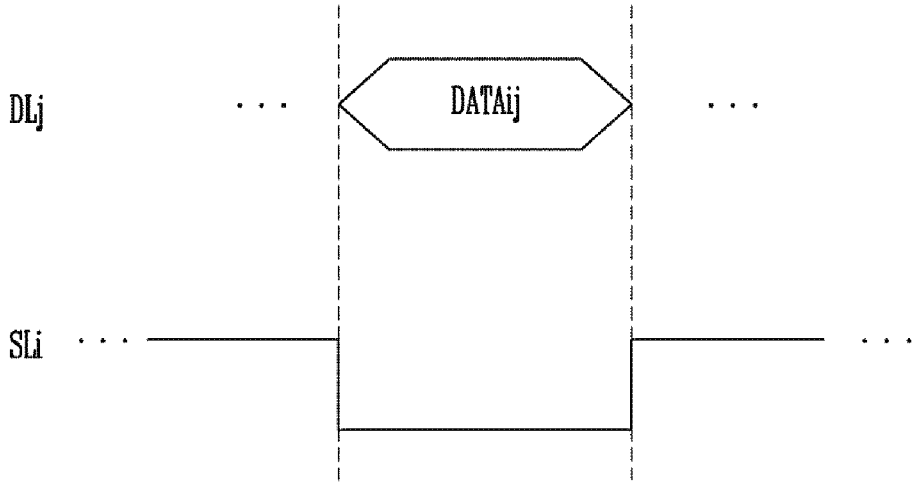
FIG. 3 is a diagram illustrating a driving method of the pixel shown in FIG. 2 in accordance with an exemplary embodiment of the inventive concept.

FIG. 2 is a diagram illustrating a pixel of the display device shown in FIG. 1 according to an exemplary embodiment of the inventive concept. FIG. 3 is a diagram illustrating a driving method of the pixel shown in FIG. 2 according to an exemplary embodiment of the inventive concept.

The pixel RPij may be a pixel emitting light of the first color. Pixels emitting light of the second color or the third color include components substantially identical to those of the pixel RPij except a light emitting diode R_LD1, and therefore, overlapping descriptions will be omitted.

The pixel RPij may include a plurality of transistors T1, and T2, a storage capacitor Cst1, and the light emitting diode R_LD1.

Although a case where the transistors are implemented with a P-type transistor, e.g., a PMOS transistor, is illustrated in the present exemplary embodiment, those skilled in the art may implement a pixel circuit that performs substantially the same function, using an NMOS transistor.

A gate electrode of the transistor T2 is coupled to a scan line SLi, one electrode of the transistor T2 is coupled to a data line DLj, and the other electrode of the transistor T2 is coupled to a gate electrode of the transistor T1. The transistor T2 may be referred to as a scan transistor, a switching transistor, etc.

The gate electrode of the transistor T1 is coupled to the other electrode of the transistor T2, one electrode of the transistor T1 is coupled to a first power line ELVDD, and the other electrode of the transistor T1 is coupled to an anode of the light emitting diode R_LD1. The transistor T1 may be referred to as a driving transistor.

The storage capacitor Cst1 couples the one electrode and the gate electrode of the transistor T1 to each other.

The anode of the light emitting diode R_LD1 is coupled to the other electrode of the transistor T1, and a cathode of the light emitting diode R_LD1 is coupled to a second power line ELVSS. The light emitting diode R_LD1 may be a device emitting light having a wavelength corresponding to the first color. The light emitting diode R_LD1 may be implemented with an organic light emitting diode, an inorganic light emitting diode, a quantum dot light emitting diode, etc. The pixel RPij shown in FIG. 2 includes a single light emitting diode R_LD1. However, in an exemplary embodiment of the inventive concept, the pixel RPij may include a plurality of light emitting diodes. The plurality of light emitting diodes may be coupled in parallel with the same polarity, or be coupled in parallel with different polarities.

When a scan signal of a turn-on level (low level) is supplied to the gate electrode of the transistor T2 through the scan line SLi, the transistor T2 couples the data line DLj and one electrode of the storage capacitor Cst1 to each other. Therefore, a voltage value according to the difference between a data voltage DATAij applied through the data line DLj and a first power voltage is stored in the storage capacitor Cst1. The data voltage DATAij may correspond to one of the grayscale voltages RV0 to RV255.

The transistor T1 allows a driving current determined according to the voltage stored in the storage capacitor Cst1 to flow from the first power line ELVDD to the second power line ELVSS. The light emitting diode R_LD1 emits light with a luminance corresponding to an amount of the driving current.

Figure 4:
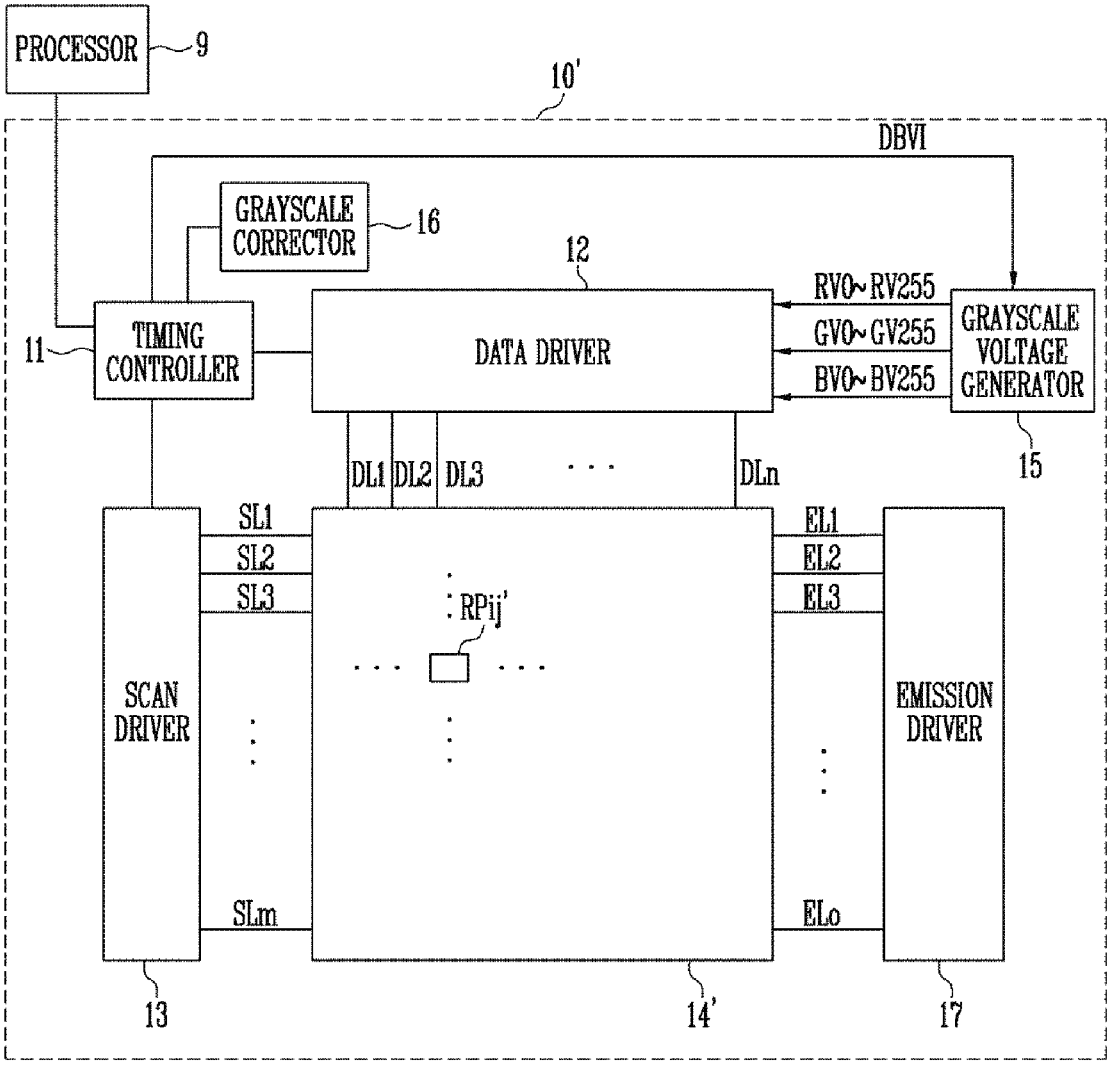
FIG. 4 is a diagram illustrating a display device in accordance with an exemplary embodiment of the inventive concept.

FIG. 4 is a diagram illustrating a display device in accordance with an exemplary embodiment of the inventive concept.

A display panel 10' shown in FIG. 4 may include a configuration substantially identical to the display panel 10 shown in FIG. 1, except for an emission driver 17 and a pixel unit 14'. Therefore, overlapping descriptions will be omitted.

The emission driver 17 may generate emission signals to be provided to emission lines EL1, EL2, EL3, . . . , and ELo by receiving a clock signal, an emission stop signal, etc. from the timing controller 11. For example, the emission driver 17 may sequentially provide emission signals having a pulse of a turn-off level to the emission lines EL1 to ELo. For example, the emission driver 17 may be configured in a shift register form, and generate emission signals in a manner that sequentially transfers the emission stop signal in the form of a pulse of a turn-off level to a next scan stage circuit in response to the clock signal. Here, o may be a natural number.

The pixel unit 14' may include pixels. Each pixel RPij' may be coupled to a corresponding data line, a corresponding scan line, and a corresponding emission line.

Figure 5:
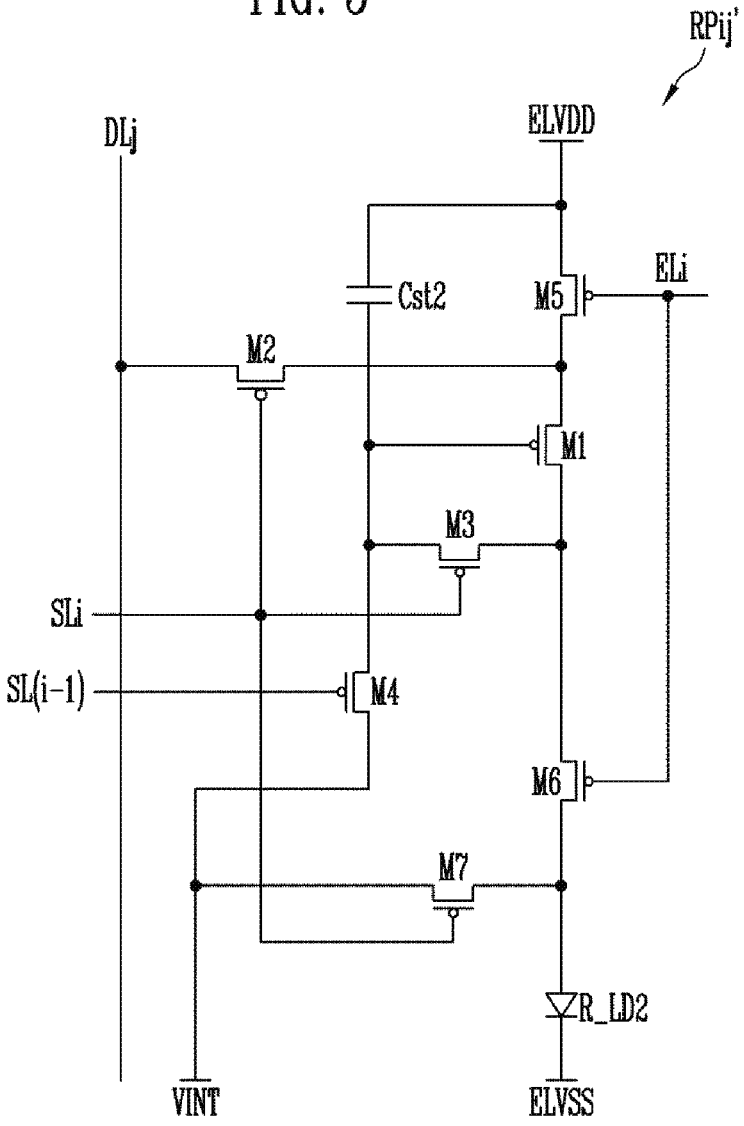
FIG. 5 is a diagram illustrating a pixel of the display device shown in FIG. 4 in accordance with an exemplary embodiment of the inventive concept.

FIG. 5 is a diagram illustrating a pixel of the display device shown in FIG. 4 according to an exemplary embodiment of the inventive concept.

Referring to FIG. 4, the pixel RPij' may include transistors M1, M2, M3, M4, M5, M6, and M7, a storage capacitor Cst2, and a light emitting diode R_LD2.

One electrode of the storage capacitor Cst2 is coupled to the first power line ELVDD, and the other electrode of the storage capacitor Cst2 is coupled to a gate electrode of the transistor M1.

One electrode of the transistor M1 is coupled to the other electrode of the transistor M5, the other electrode of the transistor M1 is coupled to one electrode of the transistor M6, and the gate electrode of the transistor M1 is coupled to the other electrode of the storage capacitor Cst2. The transistor M1 may be referred to as a driving transistor. The transistor M1 determines an amount of driving current flowing between the first power line ELVDD and the second power line ELVSS according to a potential difference between the gate electrode and a source electrode thereof.

One electrode of the transistor M2 is coupled to the data line DLj, the other electrode of the transistor M2 is coupled to the one electrode of the transistor M1, and a gate electrode of the transistor M2 is coupled to a current scan line SLi. The transistor M2 may be referred to as a switching transistor, a scan transistor, etc. When a scan signal of a turn-on level is applied to the current scan line SLi, the transistor M2 allows a data voltage of the data line DLj to be input to the pixel RPij'.

One electrode of the transistor M3 is coupled to the other electrode of the transistor M1, the other electrode of the transistor M3 is coupled to the gate electrode of the transistor M1, and a gate electrode of the transistor M3 is coupled to the current scan line SLi. When a scan signal of a turn-on level is applied to the current scan line SLi, the transistor M3 allows the transistor M1 to be diode-coupled.

One electrode of the transistor M4 is coupled to the gate electrode of the transistor M1, the other electrode of the transistor M4 is coupled to an initialization voltage line VINT, and a gate electrode of the transistor M4 is coupled to a previous scan line SL(i−1). In an exemplary embodiment of the inventive concept, the gate electrode of the transistor M4 may be coupled to another scan line. When a scan signal of a turn-on level is applied to the previous scan line SL(i−1), the transistor M4 initializes a quantity of electric charges of the gate electrode of the transistor M1 by transferring an initialization voltage to the gate electrode of the transistor M1.

One electrode of the transistor M5 is coupled to the first power line ELVDD, the other electrode of the transistor M5 is coupled to the one electrode of the transistor M1, and a gate electrode of the transistor M5 is coupled to an emission line ELi. The one electrode of the transistor M6 is coupled to the other electrode of the transistor M1, the other electrode of the transistor M6 is coupled to an anode of the light emitting diode R_LD2, and a gate electrode of the transistor M6 is coupled to the emission line ELi. The transistors M5 and M6 may be referred to as emission transistors. When an emission signal of a turn-on level is applied to the emission line ELi, the transistors M5 and M6 allow the light emitting diode R_LD2 to emit light by forming a driving current path between the first power line ELVDD and the second power line ELVSS.

One electrode of the transistor M7 is coupled to the anode of the light emitting diode R_LD2, the other electrode of the transistor M7 is coupled to the initialization voltage line VINT, and a gate electrode of the transistor M7 is coupled to the current scan line SLi. In an exemplary embodiment of the inventive concept, the gate electrode of the transistor M7 may be coupled to another scan line. For example, the gate electrode of the transistor M7 may be coupled to the previous scan line SL(i−1) or a previous scan line prior to the previous scan line SL(i−1), or a next scan line SL(i+1) or a next scan line posterior to the next scan line SL(i+1). When a scan signal of a turn-on level is applied to the current scan line SLi, the transistor M7 initializes a quantity of electric charges accumulated in the light emitting diode R_LD2 by transferring an initialization voltage to the anode of the light emitting diode R_LD2.

The anode of the light emitting diode R_LD2 is coupled to the other electrode of the transistor M6, and a cathode of the light emitting diode R_LD2 is coupled to the second power line ELVSS. The light emitting diode R_LD2 may be implemented with an organic light emitting diode, an inorganic light emitting diode, a quantum dot light emitting diode, etc. The pixel RPij' shown in FIG. 5 includes a single light emitting diode R_LD2. However, in an exemplary embodiment of the inventive concept, the pixel RPij' may include a plurality of light emitting diodes. The plurality of light emitting diodes may be coupled in parallel with the same polarity, or be coupled in parallel with different polarities.

Figure 6:
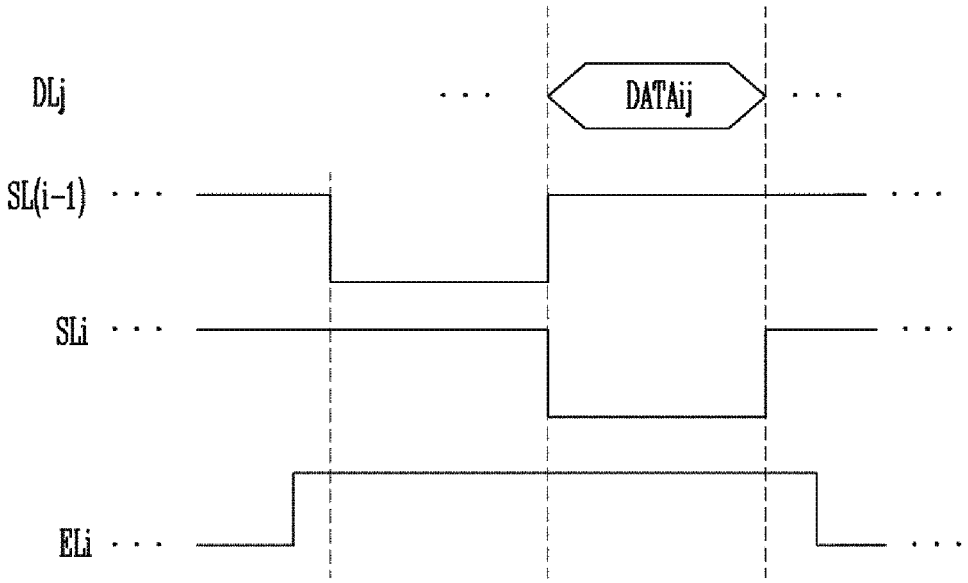
FIG. 6 is a diagram illustrating a driving method of the pixel shown in FIG. 5 in accordance with an exemplary embodiment of the inventive concept.

FIG. 6 is a diagram illustrating a driving method of the pixel shown in FIG. 5 according to an exemplary embodiment of the inventive concept.

First, a scan signal of a turn-on level (low level) is applied to the previous scan line SL(i−1). Since the transistor M4 is in a turn-on state, an initialization voltage is applied to the gate electrode of the transistor M1 such that the quantity of electric charges is initialized. Since an emission signal of a turn-off level is applied to the emission line ELi, the transistors M5 and M6 are in a turn-off state, and unnecessary emission of the light emitting diode R_LD2 in the process of applying the initialization voltage is prevented.

Next, a data voltage DATAij with respect to a current pixel row is applied to the data line DLj, and a scan signal of a turn-on level is applied to the current scan line SLi. Accordingly, the transistors M2, M1, and M3 are in a conducting state, and the data line DLj and the gate electrode of the transistor M1 are electrically coupled to each other. Thus, the data voltage DATAij is applied to the other electrode of the storage capacitor Cst2, and the storage capacitor Cst2 accumulates a quantity of electric charges corresponding to the difference between a voltage of the first power line ELVDD and the data voltage DATAij.

Since the transistor M7 is in the turn-on state, the anode of the light emitting diode R_LD2 and the initialization voltage line VINT are coupled to each other, and a quantity of electric charges corresponding to the difference between the initialization voltage of the light emitting diode R_LD2 and a voltage of the second power line ELVSS is precharged or initialized.

Subsequently, when an emission signal of a turn-on level is applied to the emission line ELi, the transistors M5 and M6 are in the conducting state, and an amount of driving current flowing through the transistor M1 is controlled according to the quantity of electric charges accumulated in the storage capacitor Cst2, so that the driving current flows through the light emitting diode R_LD2. The light emitting diode R_LD2 emits light until before an emission signal of a turn-off level is applied to the emission line ELi.

Figure 7:
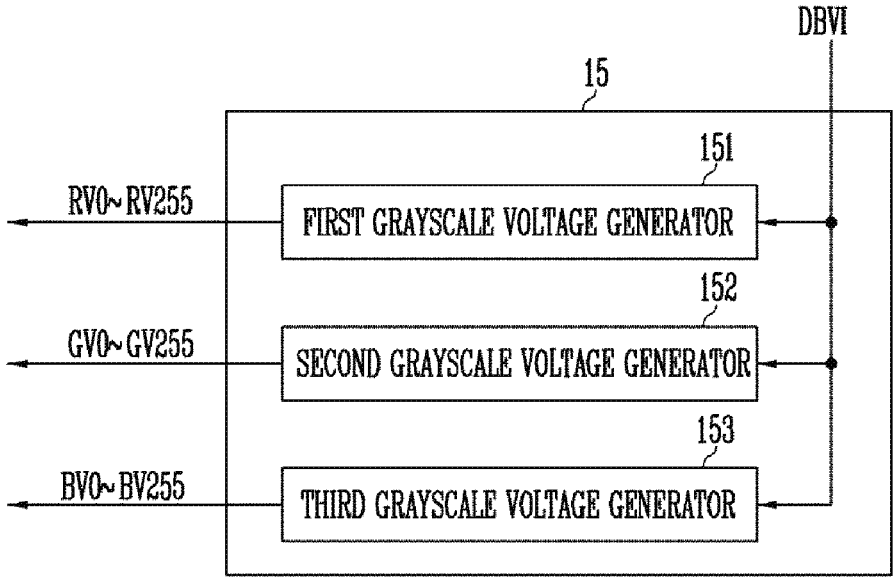
FIG. 7 is a diagram illustrating a grayscale voltage generator in accordance with an exemplary embodiment of the inventive concept.

FIG. 7 is a diagram illustrating a grayscale voltage generator in accordance with an exemplary embodiment of the inventive concept.

Referring to FIG. 7, the grayscale voltage generator 15 may include a first grayscale voltage generator 151, a second grayscale voltage generator 152, and a third grayscale voltage generator 153.

The first grayscale voltage generator 151 may receive the input maximum luminance value DBVI, and provide the grayscale voltages RV0 to RV255 with respect to the pixels of the first color, which correspond to the input maximum luminance value DBVI.

The second grayscale voltage generator 152 may receive the input maximum luminance value DBV1, and provide the grayscale voltages GV0 to GV255 with respect to the pixels of the second color, which correspond to the input maximum luminance value DBVI.

The third grayscale voltage generator 153 may receive the input maximum luminance value DBV1, and provide the grayscale voltages BV0 to BV255 with respect to the pixels of the third color, which correspond to the input maximum luminance value DBVI.

Figure 8:
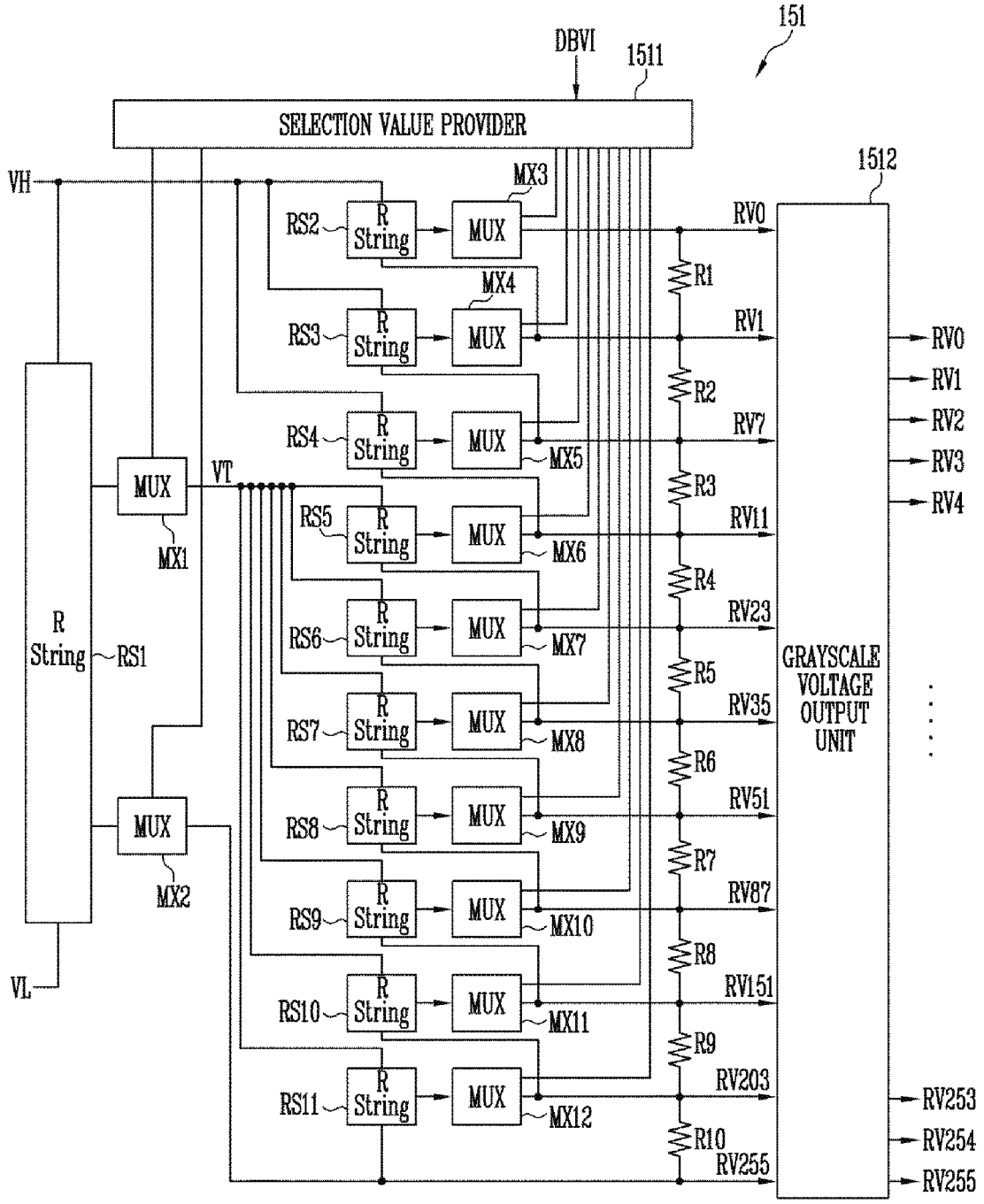
FIG. 8 is a diagram illustrating a portion of the grayscale voltage generator shown in FIG. 7 in accordance with an exemplary embodiment of the inventive concept.

FIG. 8 is a diagram illustrating a portion of the grayscale voltage generator shown in FIG. 7 according to an exemplary embodiment of the inventive concept.

Referring to FIG. 8, the first grayscale voltage generator 151 may include a selection value provider 1511, a grayscale voltage output unit 1512, resistor strings RS1 to RS11, multiplexers MX1 to MX12, and resistors R1 to R10.

Each of the second grayscale voltage generator 152 and the third grayscale voltage generator 153 may include a configuration substantially identical to that of the first grayscale voltage generator 151, and therefore, overlapping descriptions will be omitted.

The selection value provider 1511 may provide selection values with respect to the multiplexers MX1 to MX12 according to the input maximum luminance value DBVI. The selection values according to the input maximum luminance value DBVI may be pre-stored in a memory device, e.g., a device such as a register.

The resistor string RS1 may generate intermediate voltages between a first reference voltage VH and a second reference voltage VL. The multiplexer M1 may output a third reference voltage VT by selecting one of the intermediate voltages provided from the resistor string RS1 according to a selection value. The multiplexer MX2 may output a 255-grayscale voltage RV255 by selecting one of the intermediate voltages provided from the resistor string RS1 according to a selection value.

The resistor string RS11 may generate intermediate voltages between the third reference voltage VT and the 255-grayscale voltage RV255. The multiplexer MX12 may output a 203-grayscale voltage RV203 by selecting one of the intermediate voltages provided from the resistor string RS11 according to a selection value.

The resistor string RS10 may generate intermediate voltages between the third reference voltage VT and the 203-grayscale voltage RV203. The multiplexer MX11 may output a 151-grayscale voltage RV151 by selecting one of the intermediate voltages provided from the resistor string RS10 according to a selection value.

The resistor string RS9 may generate intermediate voltages between the third reference voltage VT and the 151-grayscale voltage RV151. The multiplexer MX10 may output an 87-grayscale voltage RV87 by selecting one of the intermediate voltages provided from the resistor string RS9 according to a selection value.

The resistor string RS8 may generate intermediate voltages between the third reference voltage VT and the 87-grayscale voltage RV87. The multiplexer MX9 may output a 51-grayscale voltage RV51 by selecting one of the intermediate voltages provided from the resistor string RS8 according to a selection value.

The resistor string RS7 may generate intermediate voltages between the third reference voltage VT and the 51-grayscale voltage RV51. The multiplexer MX8 may output a 35-grayscale voltage RV35 by selecting one of the intermediate voltages provided from the resistor string RS7 according to a selection value.

The resistor string RS6 may generate intermediate voltages between the third reference voltage VT and the 35-grayscale voltage RV35. The multiplexer MX7 may output a 23-grayscale voltage RV23 by selecting one of the intermediate voltages provided from the resistor string RS6 according to a selection value.

The resistor string RS5 may generate intermediate voltages between the third reference voltage VT and the 23-grayscale voltage RV23. The multiplexer MX6 may output an 11-grayscale voltage RV11 by selecting one of the intermediate voltages provided from the resistor string RS5 according to a selection value.

The resistor string RS4 may generate intermediate voltages between the first reference voltage VH and the 11-grayscale voltage RV11. The multiplexer MX5 may output a 7-grayscale voltage RV7 by selecting one of the intermediate voltages provided from the resistor string RS4 according to a selection value.

The resistor string RS3 may generate intermediate voltages between the first reference voltage VH and the 7-grayscale voltage RV7. The multiplexer MX4 may output a 1-grayscale voltage RV1 by selecting one of the intermediate voltages provided from the resistor string RS3 according to a selection value.

The resistor string RS2 may generate intermediate voltages between the first reference voltage VH and the 1-grayscale voltage RV1. The multiplexer MX3 may output a 0-grayscale voltage RV0 by selecting one of the intermediate voltages provided from the resistor string RS2 according to a selection value.

The above-described grayscales 0, 1, 7, 11, 23, 35, 51, 87, 151, 203, and 255 may be referred to as reference grayscales. In addition, the grayscale voltages RV0, RV1, RV7, RV11, RV23, RV35, RV51, RV87, RV151, RV203, and RV255 generated from the multiplexers MX2 to MX12 may be referred to as reference grayscale voltages. A number of reference grayscales and grayscale numbers corresponding to the reference grayscales may be differently set depending on products. Hereinafter, for convenience of description, the grayscales 0, 1, 7, 11, 23, 35, 51, 87, 151, 203, and 255 are described as reference grayscales.

The grayscale voltage output unit 1512 may generate all grayscale voltages RV0 to RV255 by dividing the reference grayscale voltages RV0, RV1, RV7, RV11, RV23, RV35, RV51, RV87, RV151, RV203, and RV255. For example, the grayscale voltage output unit 1512 may generate RV2 to RV6 by dividing the reference grayscale voltages RV1 and RV7.

Figure 9:
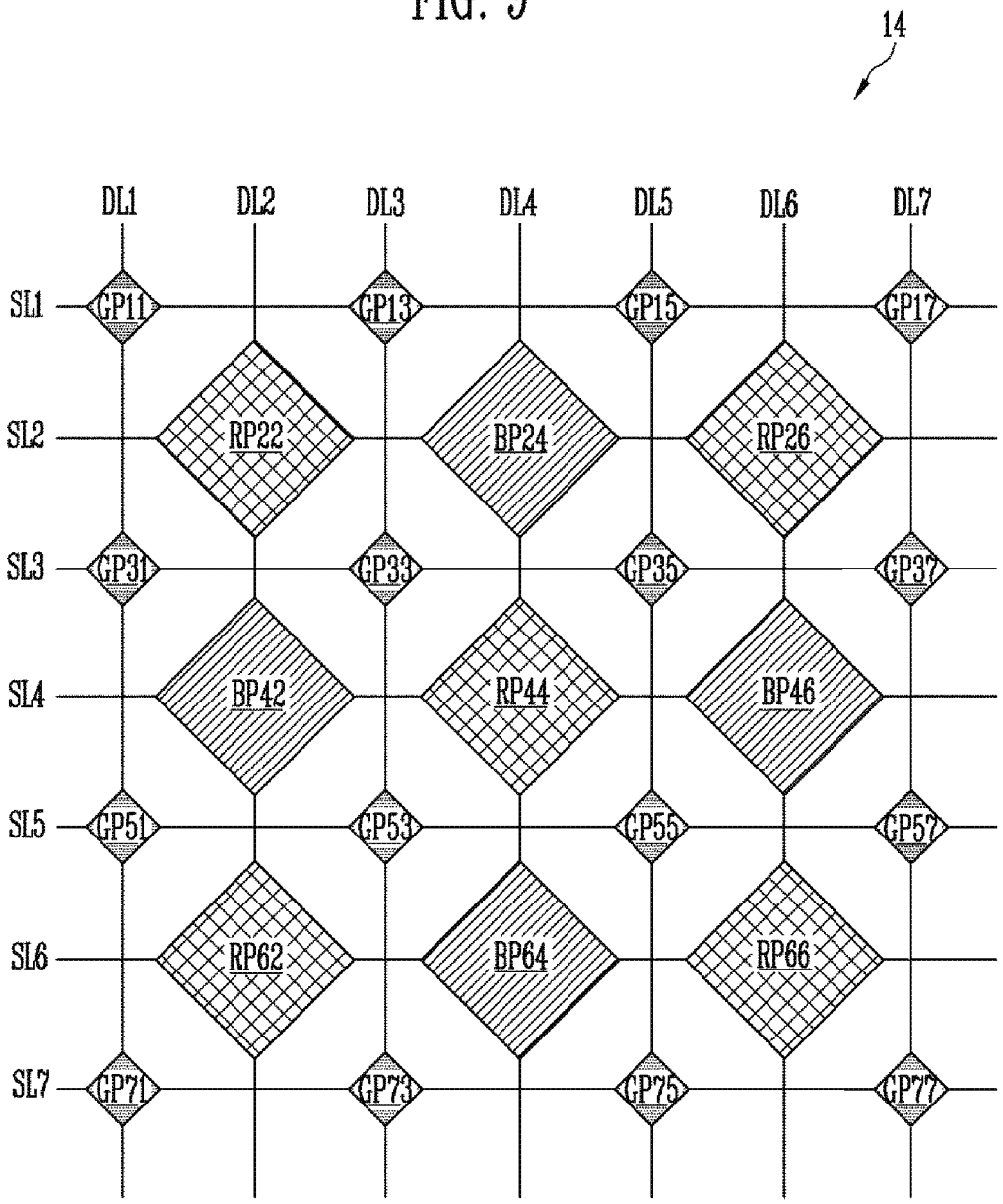
FIGS. 9 and 10 are diagrams illustrating a case where pixels emit white color light according to a maximum luminance value in accordance with an exemplary embodiment of the inventive concept.
Figure 10:
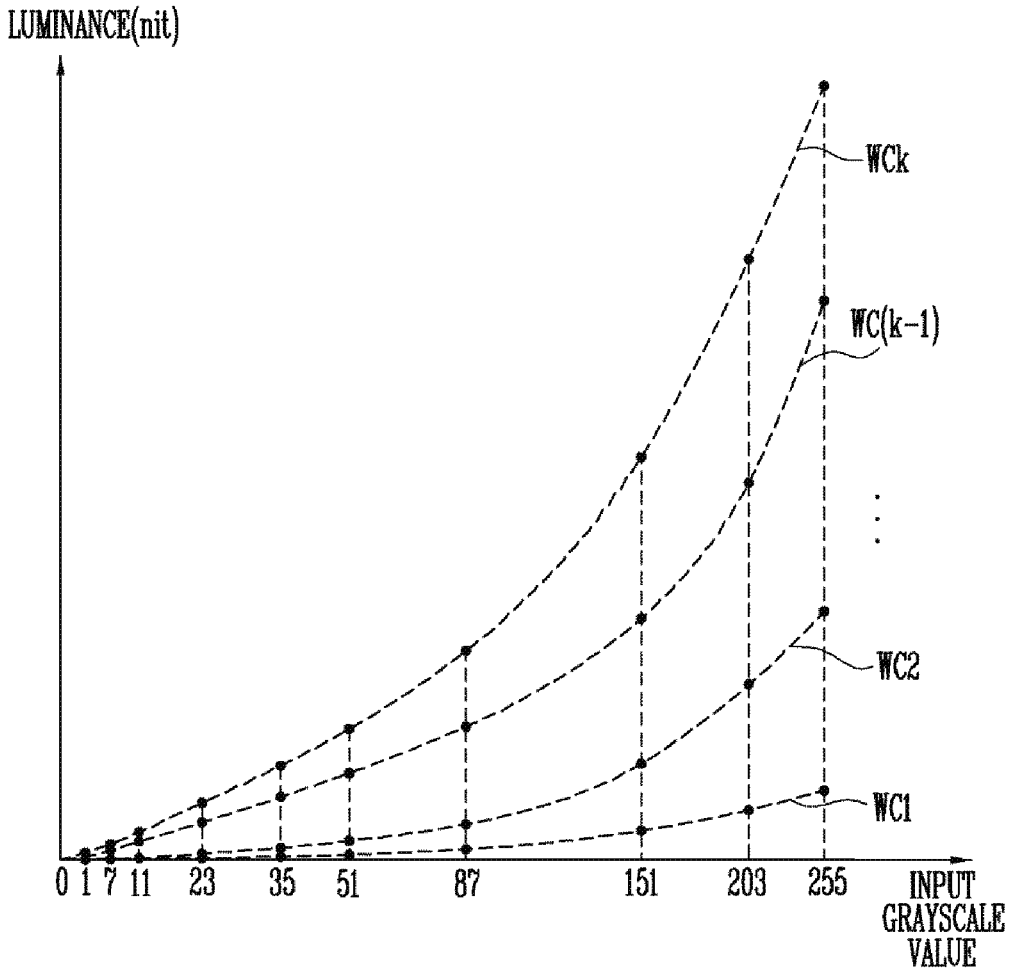

FIGS. 9 and 10 are diagrams illustrating a case where pixels emit white color light according to a maximum luminance value according to an exemplary embodiment of the inventive concept.

Referring to FIG. 9, a disposition example of the pixel unit 14 is partially illustrated. As described above, in FIG. 9, pixels are illustrated based on the positions of light emitting diodes of the pixel unit 14, and scan lines SL1 to SL7 and data lines DL1 to DL7 are illustrated so as to describe an electrical coupling relationship of the pixel unit 14.

Pixels RP22, RP26, RP44, RP62, and RP66 may be pixels emitting light of the first color. Pixels GP11, GP13, GP15, GP17, GP31, GP33, GP35, GP37, GP51, GP53, GP55, GP57, GP71, GP73, GP75, and GP77 may be pixels emitting light of the second color. Pixels BP24, BP42, BP46, and BP64 may be pixels emitting light of the third color.

In exemplary embodiments of the inventive concept, data voltages corresponding to grayscale voltages may be alternately applied to data lines DL1, DL3, DL5, and DL7 of a first group and data lines DL2, DL4, and DL6 of a second group.

For example, data voltages corresponding to the first color may be applied to the data lines DL1, DL3, DL5, and DL7 of the first group. When a scan signal of a turn-on level is applied to the scan line SL1, corresponding data voltages are written in the pixels GP11, GP13, GP15, and GP17. When a scan signal of a turn-on level is applied to the scan line SL3, corresponding data voltages are written in the pixels GP31, GP33, GP35, and GP37. When a scan signal of a turn-on level is applied to the scan line SL5, corresponding data voltages are written in the pixels GP51, GP53, GP55, and GP57. When a scan signal of a turn-on level is applied to the scan line SL7, corresponding data voltages are written in the pixels GP71, GP73, GP75, and GP77.

In addition, data voltages corresponding to the second color or the third color may be applied to the data lines DL2, DL4, and DL6 of the second group. When a scan signal of a turn-on level is applied to the scan line SL2, corresponding data voltages are written in the pixels RP22, BP24, and RP26. When a scan signal of a turn-on level is applied to the scan line SL4, corresponding data voltages are written in the pixels BP42, RP44, and BP46. When a scan signal of a turn-on level is applied to the scan line SL6, corresponding data voltages are written in the pixels RP62, BP64, and RP66.

FIG. 10 illustrates white color light curves WC1, WC2, . . . , WC(k−1), and WCk of output luminances with respect to input grayscale values. Here, k may be an integer greater than 0.

Maximum luminance values of the white color light curves WC1 to WCk may be different from one another. For example, the maximum luminance (e.g., 4 nits) of the white color light curve WC1 may be lowest, and the maximum luminance value (e.g., 1200 nits) of the white color light curve WCk may be highest.

To generate white light, it is assumed that the pixels of the pixel unit 14 receive data voltages with respect to the same grayscale.

Imaginary dots illustrated on the white color light curves WC1 to WCk shown in FIG. 10 may correspond to the selection values pre-stored in the above-described selection value provider 1511. More accurate white color light curves may be directly expressed as the number of selection values is increased. However, physical devices such as multiplexers, registers, etc., which correspond to the increased number of selection values, may be further required, and therefore, a limitation exists. Accordingly, the selection values with respect to the above-described reference grayscale voltage may be pre-stored and used, and the other grayscale voltages may be generated by dividing the reference grayscale voltages. In addition, for the same reason, selection values with respect to some maximum luminance values (e.g., reference maximum luminance values) between 4 nits and 1200 nits may be pre-stored and used, and the other maximum luminance values may be generated by interpolating the selection values.

The pre-stored selection values may be set for each individual product through Multi-Time Programming (MTP). In other words, selection values may be set through repetitive measurements to be stored in a product, so that white color light with a desired luminance can be emitted with respect to grayscale values.

In other words, the pre-stored selection values may be values set with respect to the white color light. As described above, when mixed color light or single color light instead of the white color light is emitted using set grayscale voltages, the luminance of the mixed color light or the single color light does not accurately correspond to a desired gamma curve. The gamma curve may correspond to a white color light curve.

Figure 11:
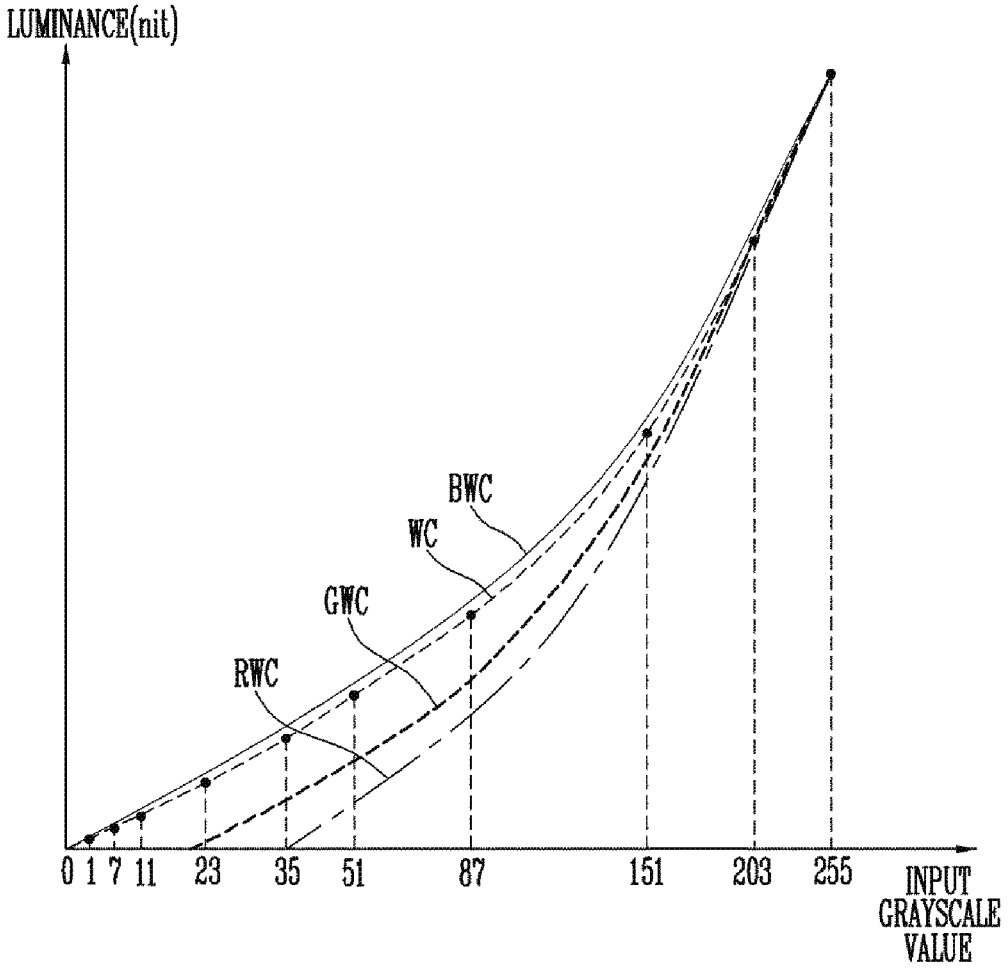
FIG. 11 is a diagram illustrating a white color light curve and single color light curves at an arbitrary maximum luminance value in accordance with an exemplary embodiment of the inventive concept.

FIG. 11 is a diagram illustrating a white color light curve and single color light curves at an arbitrary maximum luminance value according to an exemplary embodiment of the inventive concept.

As described above, when single color light instead of the white color light is emitted using the set grayscale voltages, the luminance of the single color light does not accurately correspond to a desired gamma curve. The gamma curve may correspond to a white color light curve WC. In addition, low grayscale expression is uncertain since luminance differences between low grayscales are insufficient.

The gamma curve may generally follow the following Equation 1.

$$y=ax^{GM}+b \qquad \text{Equation 1}$$

Here, x may be a grayscale value, y may be a luminance value, a and b may be arbitrary constants, and GM may be a gamma value.

Hereinafter, for convenience of description, the constants a and b are neglected, shapes of curves are described using the gamma value GM. When the gamma value corresponds to 1, a straight line instead of a curve is drawn, and a curve becomes convex adjacent to the x axis as the gamma value is greater than 1.

Therefore, a gamma value of a first single color light curve RWC may be greater than that of the white color light curve WC. In addition, a gamma value of a second single color light curve GWC may be greater than that of the white color light curve WC and be smaller than that of the first single color light curve RWC. In addition, a gamma value of a third single color light curve BWC may be smaller than that of the white color light curve WC. For example, a first color may be the red color, a second color may be the green color, and a third color may be the blue color.

Therefore, although the same input grayscale value is expressed when single color light is emitted and when the white color light is emitted, the selection values of the selection value provider 1511 are preferably different from one another. However, as described above, physical devices such as multiplexers are further required when the selection values of the selection value provider 1511 are directly increased, which is not preferable.

Accordingly, in the present exemplary embodiment, a method is provided for checking whether unit areas emit single color light, double mixed color light, triple mixed color light, or white color light, and correcting an input grayscale value to a converted grayscale value, if necessary. When such a method is used, it is unnecessary to modify the existing grayscale voltage generator 15, and thus the product configuration of the display device can be easily achieved.

The case shown in FIG. 11 will be described as an example. The gamma value of the first single color light curve RWC is decreased by correcting the input grayscale value, so that the first single color light curve RWC can be adjusted to become similar to the white color light curve WC.

Similarly, the gamma value of the second single color light curve GWC is decreased by correcting the input grayscale value, so that the second single color light curve GWC can be adjusted to become similar to the white color light curve WC. A decrement in the gamma value of the second single color curve GWC may be smaller than that in the gamma value of the first single color light curve RWC.

Similarly, the gamma value of the third single color light curve BWC is decreased by correcting the input grayscale value, so that the third single color light curve BWC can be adjusted to become similar to the white color light curve WC.

In accordance with the above-described exemplary embodiments, luminances of single color lights can be accurately expressed according a desired gamma curve. In addition, low grayscale expression can be further clarified.

The above-described contents may be equally applied to the cases of double mixed color light and triple mixed color light. Thus, the input grayscale value is corrected, so that the double mixed color light curve can be adjusted to become similar to the white color light curve WC. In addition, the input grayscale value is corrected, so that the triple mixed color light curve can be adjusted to become similar to the white color light curve WC.

However, in the case of the white color light, the selection values have already been set to be suitable for the white color light, and thus it is unnecessary to separately perform grayscale correction.

FIGS. 12 to 26 are diagrams illustrating observation pixels according to a color of a target pixel, a unit area, a single color, a double mixed color, a triple mixed color, and a white color according to exemplary embodiments of the inventive concept.

Referring to FIGS. 12 to 16, a case where a target pixel GP33 is a pixel of the second color is illustrated.

The target pixel GP33 may emit light of the second color. First color observation pixels RP22 and RP44 are located adjacent to the target pixel GP33, and may emit light of the first color. Third color observation pixels BP24 and BP42 are located adjacent to the target pixel GP33, and may emit light of the third color.

A unit area OGA may be an area including the target pixel GP33 and the observation pixels RP22, BP24, BP44, and RP44. The observation pixels RP22, BP24, BP44, and RP44 may be set as pixels located at a most adjacent distance from the target pixel GP33. Therefore, no other pixels exist between the target pixel GP33 and the observation pixels RP22, BP24, BP44, and RP44. The most adjacent distance may refer to a distance between the centers of pixels.

Grayscale values constituting an image frame may be differently referred to as input grayscale values and observation grayscale values according to their usage. For example, a grayscale value of an image frame corresponding to the target pixel GP33 may be referred to as an input grayscale value. Grayscale values of an image frame corresponding to the first color observation pixels RP22 and RP44 may be referred to as first color observation grayscale values. In addition, grayscale values of an image frame corresponding to the third color observation pixels BP24 and BP42 may be referred to as third color observation grayscale values.

Figure 12:
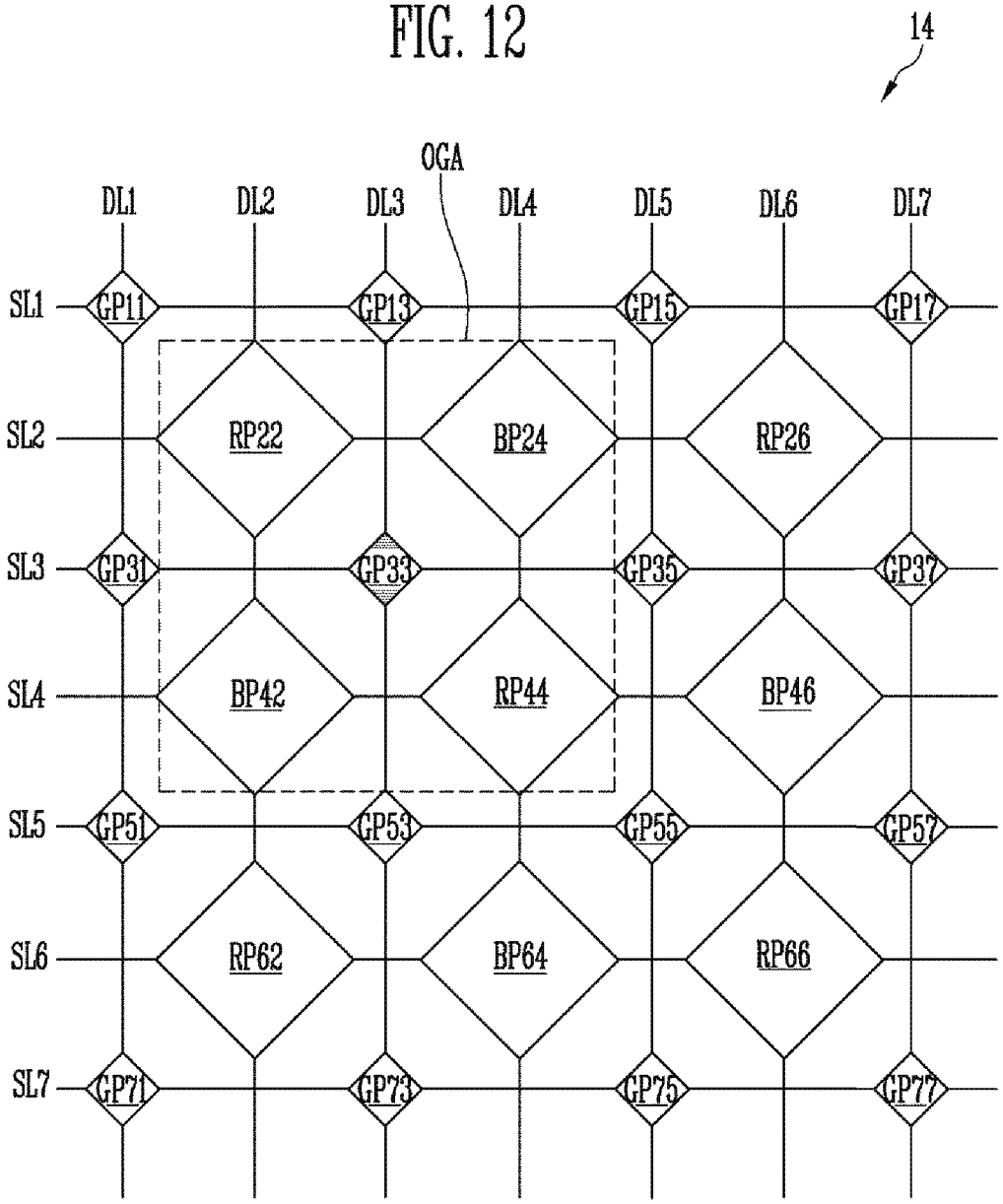
FIGS. 12 to 26 are diagrams illustrating observation pixels according to a color of a target pixel, a unit area, a single color, a double mixed color, a triple mixed color, and a white color in accordance with exemplary embodiments of the inventive concept.

Referring to FIG. 12, in the unit area OGA, the target pixel GP33 is in an emission state, and the observation pixels RP22, BP24, BP42, and RP44 are in a non-emission state. The unit area OGA may emit single color light of the second color.

Emission and non-emission may be sorted according to grayscale values. In other words, a pixel receiving a grayscale value that exceeds a reference value may be sorted as an emission pixel (the emission state), and a pixel receiving a grayscale value that is the reference value or less may be sorted as a non-emission pixel (the non-emission state). For example, the reference value may be grayscale 0 or a specific low grayscale. The reference value may be appropriately set depending on products.

Figure 13:
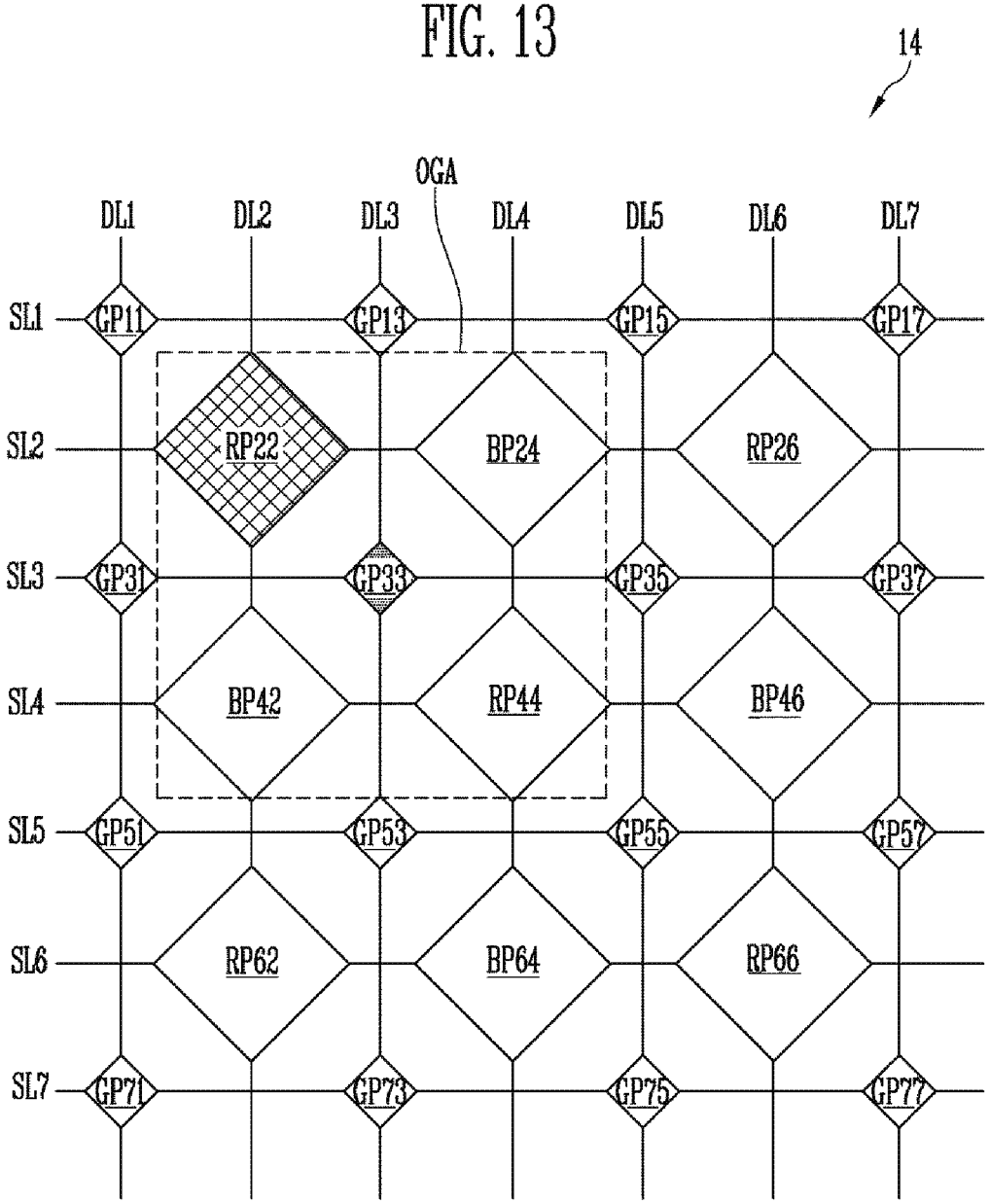

Referring to FIG. 13, in the unit area OGA, the target pixel GP33 is in the emission state, the first color observation pixel RP22 is in the emission state, and the other observation pixels BP24, BP42, and RP44 are in the non-emission state. The unit area OGA may emit double mixed color light. When the first color is the red color and the second color is the green color, the double mixed color light in FIG. 13 may be the yellow color.

Although not shown in the drawing, in the unit area OGA, the target pixel GP33 may be in the emission state, the first color observation pixels RP22 and RP44 may be in the emission state, and the other observation pixels BP24 and BP42 may be in the non-emission state. The unit area OGA may emit double mixed color light of the yellow color. However, a double mixed color light curve in this case may be different from that in the case shown in FIG. 13.

Figure 14:
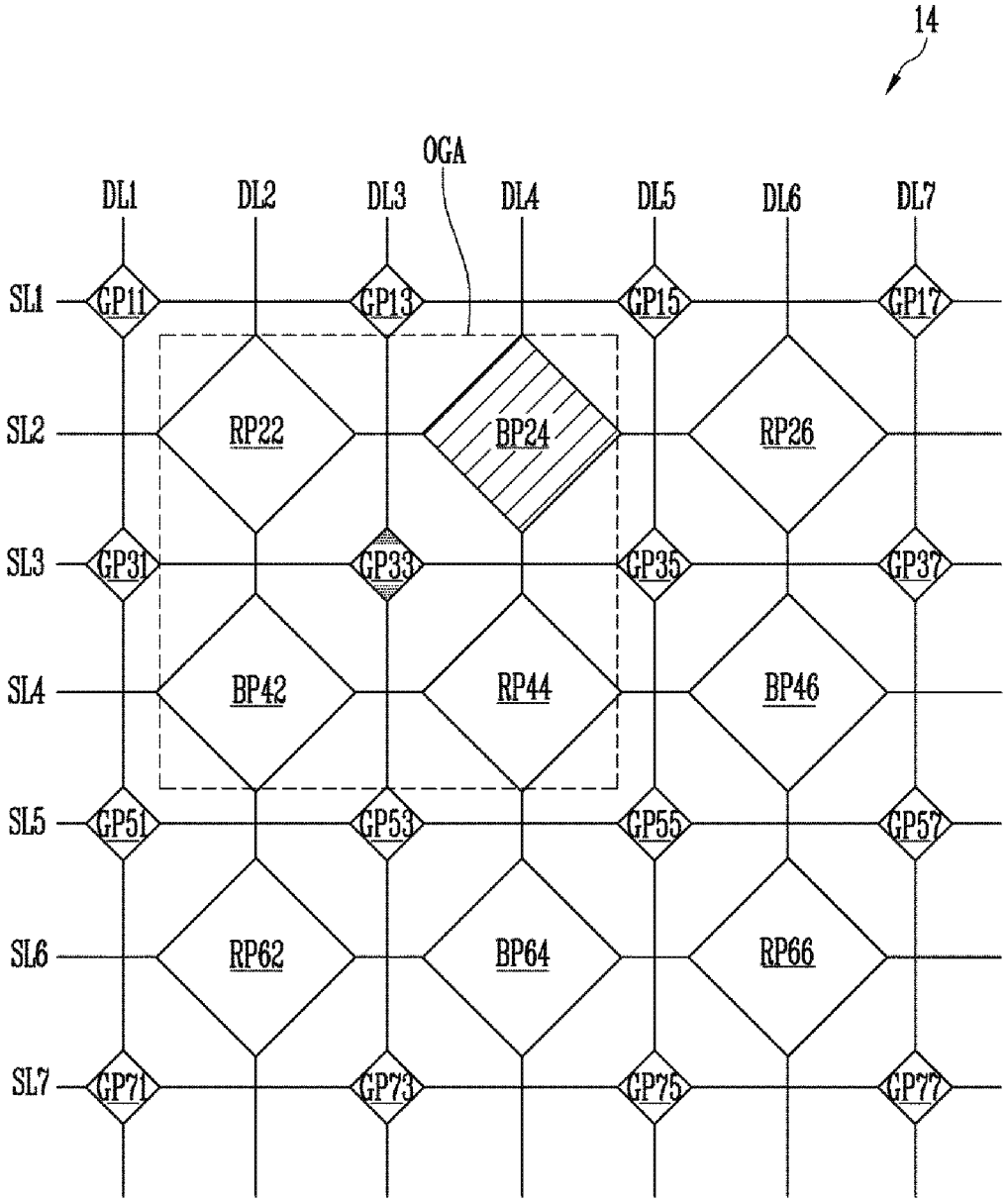

Referring to FIG. 14, in the unit area OGA, the target pixel GP33 is in the emission state, the third color observation pixel BP24 is in the emission state, and the other observation pixels RP22, BP42, and RP44 are in the non-emission state. The unit area OGA may emit double mixed color light. When the second color is the green color and the third color is the blue color, the double mixed color light in FIG. 14 may be light of the cyan color.

Although not shown in the drawing, in the unit area OGA, the target pixel GP33 may be in the emission state, the third color observation pixels BP24 and BP42 may be in the emission state, and the other observation pixels RP22 and RP44 may be in the non-emission state. The unit area OGA may emit double mixed color light of the cyan color. However, a double mixed color light curve in this case may be different from that in the case shown in FIG. 14.

Figure 15:
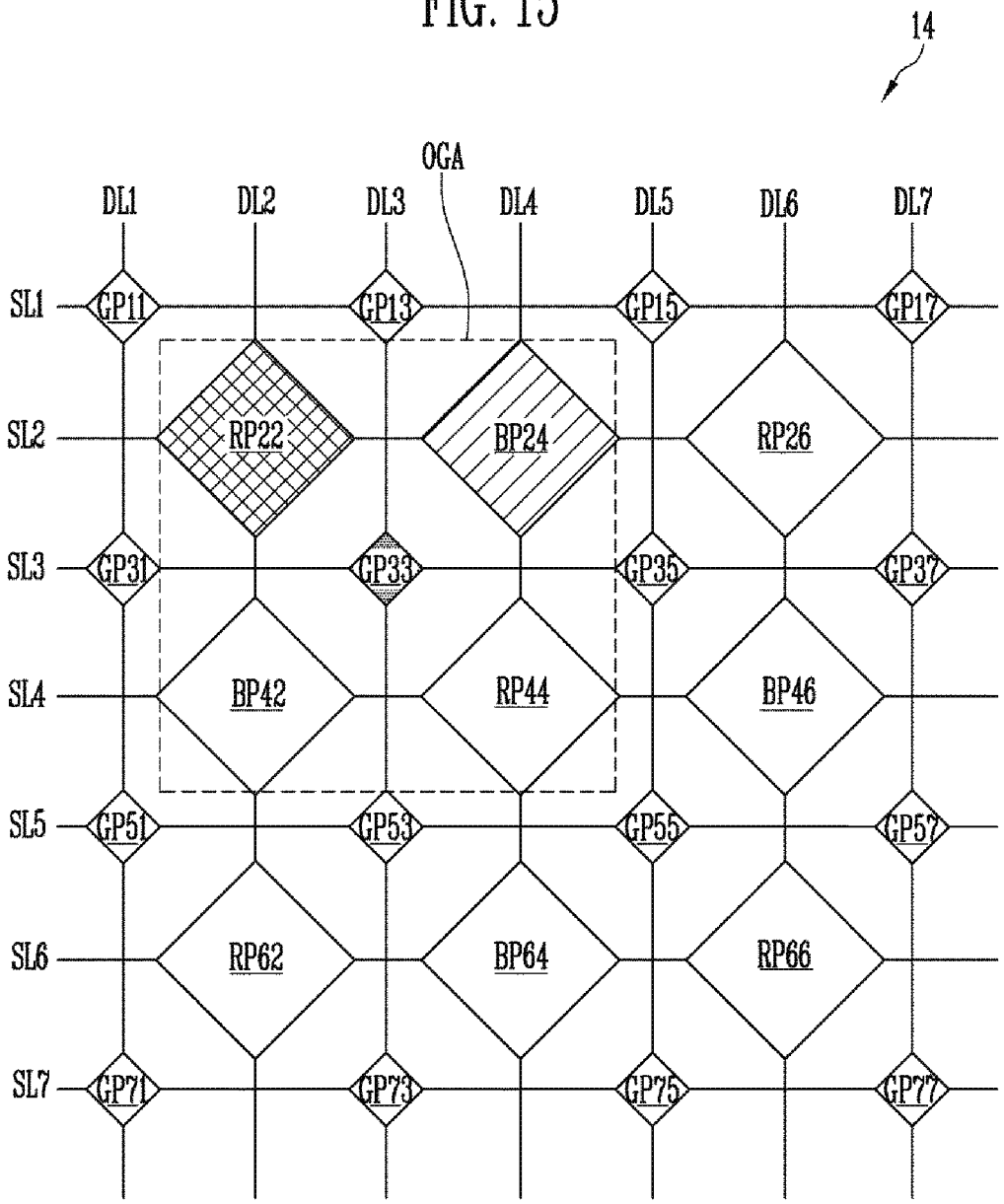

Referring to FIG. 15, in the unit area OGA, the target pixel GP33 is in the emission state, the first color observation pixel RP22 is in the emission state, the third color observation pixel BP24 is in the emission state, and the other observation pixels BP42 and RP44 are in the non-emission state. The unit area OGA may emit triple mixed color light. However, in the present exemplary embodiment, when all the pixels RP22, BP24, GP33, BP42, and RP44 of the unit area OGA are in the emission state, light emitted from the unit area OGA is not determined as triple mixed color light. Triple mixed color light curves may be different from each other depending on emission combinations of the observation pixels.

Figure 16:
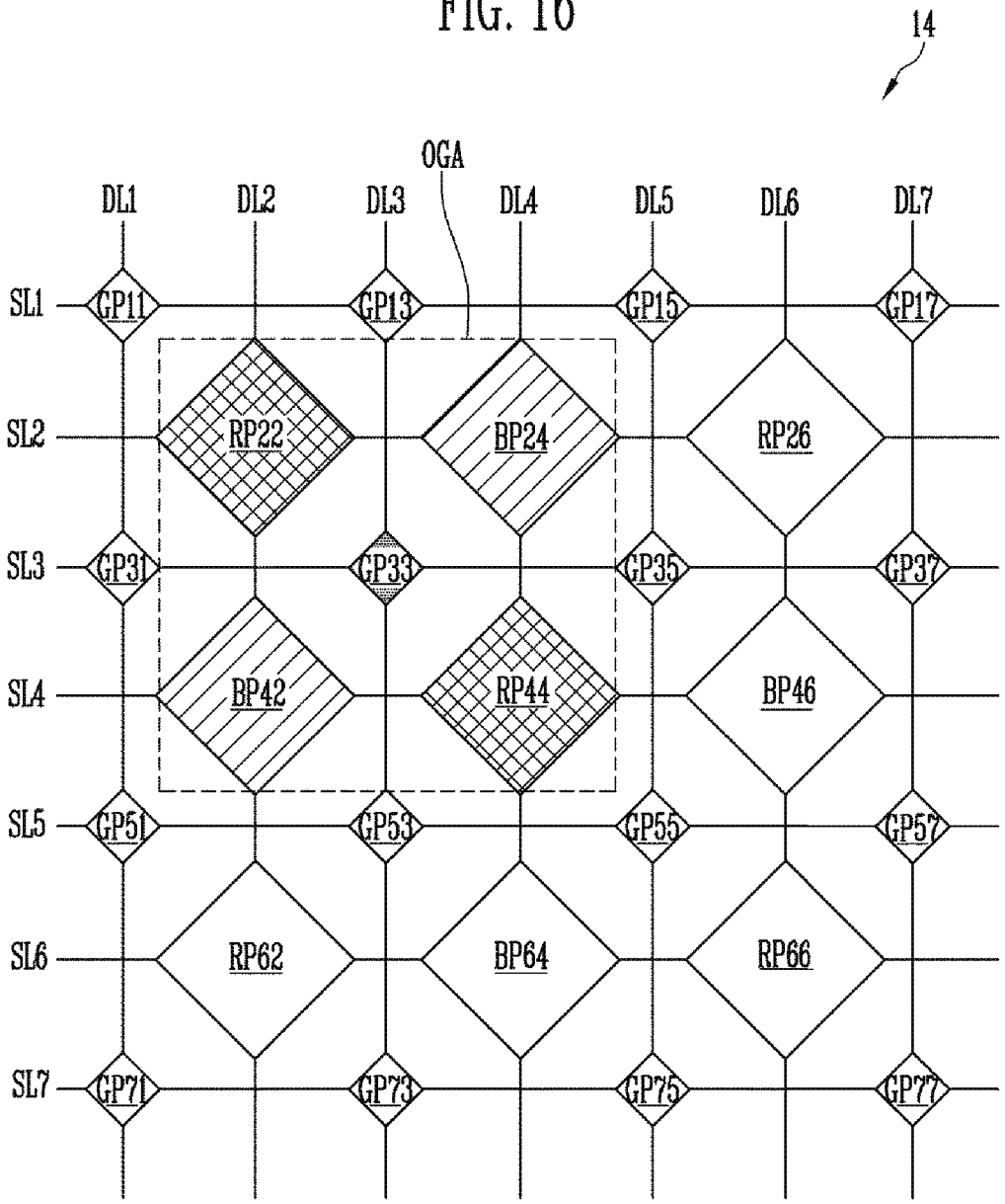

Referring to FIG. 16, a case where all the pixels RP22, BP24, GP33, BP42, and RP44 of the unit area OGA are in the emission state is illustrated. The unit area OGA may emit white color light. The white color light means light emitted when all the pixels RP22, BP24, GP33, BP42, and RP44 of the unit area OGA are in the emission state, and input grayscale values and observation grayscale values are not considered. In other words, when all input grayscale values and observation grayscale values of the unit area OGA exceed the reference value, it is determined that the unit area OGA emits the white color light. As described above, it is unnecessary to separately perform correction on a white color light curve.

Referring to FIGS. 17 to 21, a case where a target pixel RP44 is a pixel of the first color is illustrated.

The target pixel RP44 may emit light of the first color. Second color observation pixels GP33, GP35, GP53, and GP55 are located adjacent to the target pixel RP44, and may emit light of the second color. Third color observation pixels BP24, BP42, BP46, and BP64 are located adjacent to the target pixel RP44, and may emit light of the third color.

In this example, the target pixel RP44 is connected to a scan line SL4 and a data line DL4. The second color observation pixels GP33, GP35, GP53, and GP55 are connected to scan lines SL3 and SL5 adjacent to the scan line SL4. The third color observation pixels BP24, BP42, BP46, and BP64 are connected to the same scan line or the same data line as the target pixel RP44. For example, the third color observation pixels BP24 and BP64 are connected to the data line DL4. The third color observation pixels BP42 and BP46 are connected to the scan line SL4.

A unit area ORA may be an area including the target pixel RP44 and the observation pixels BP24, GP33, GP35, BP42, BP46, GP53, GP55, and BP64. The second color observation pixels GP33, GP35, GP53, and GP55 may be set as second color pixels located at a most adjacent distance from the target pixel RP44. The third color observation pixels BP24, BP42, BP46, and BP64 may be set as third color pixels located at a most adjacent distance from the target pixel RP44. Therefore, no other pixels exist between the target pixel RP44 and the observation pixels BP24, GP33, GP35, BP42, BP46, GP53, GP55, and BP64.

Figure 17:
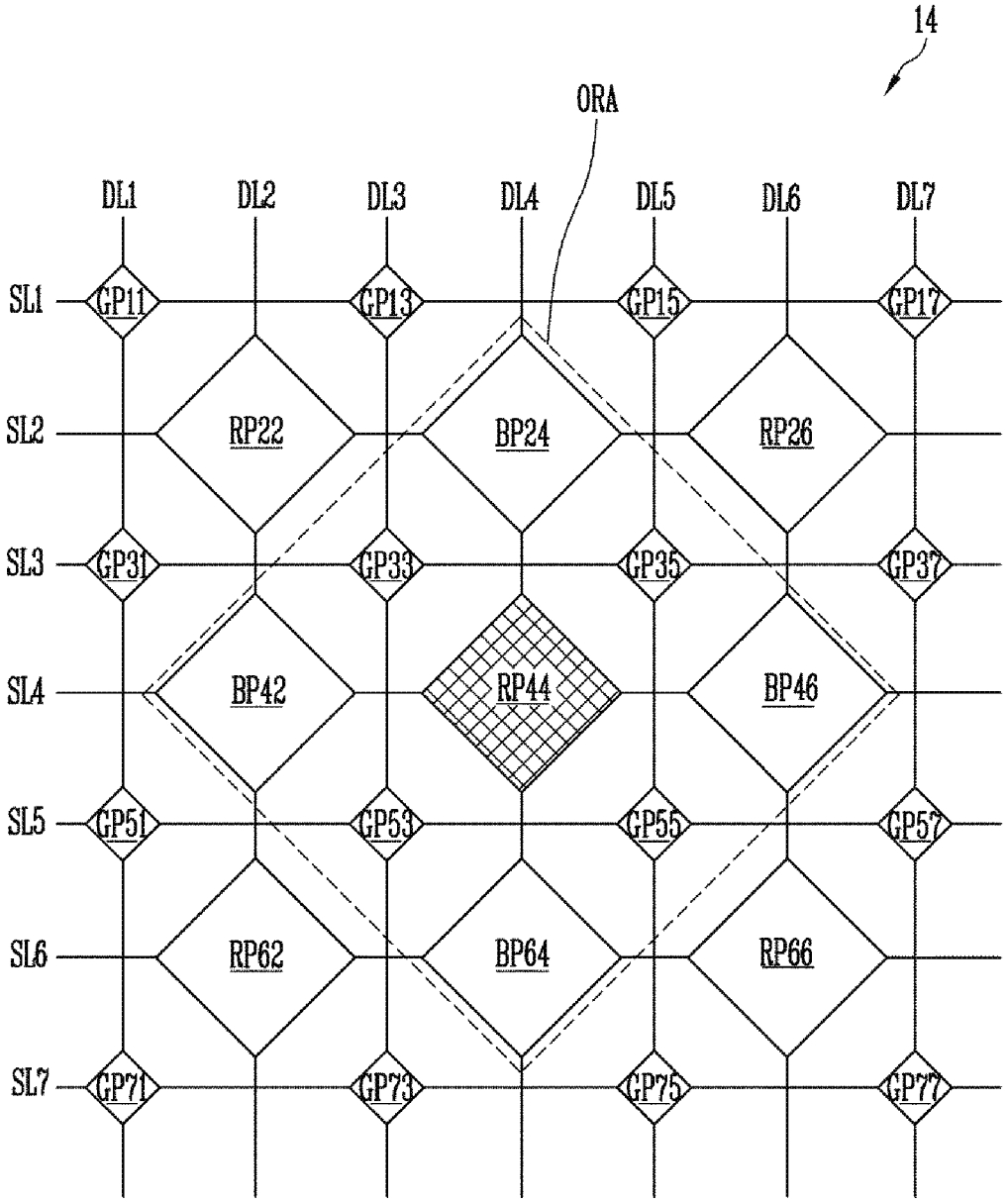

Referring to FIG. 17, in the unit area ORA, the target pixel RP44 is in the emission state, and the observation pixels BP24, GP33, GP35, BP42, BP46, GP53, GP55, and BP64 are in the non-emission state. The unit area ORA may emit single color light of the first color.

Figure 18:
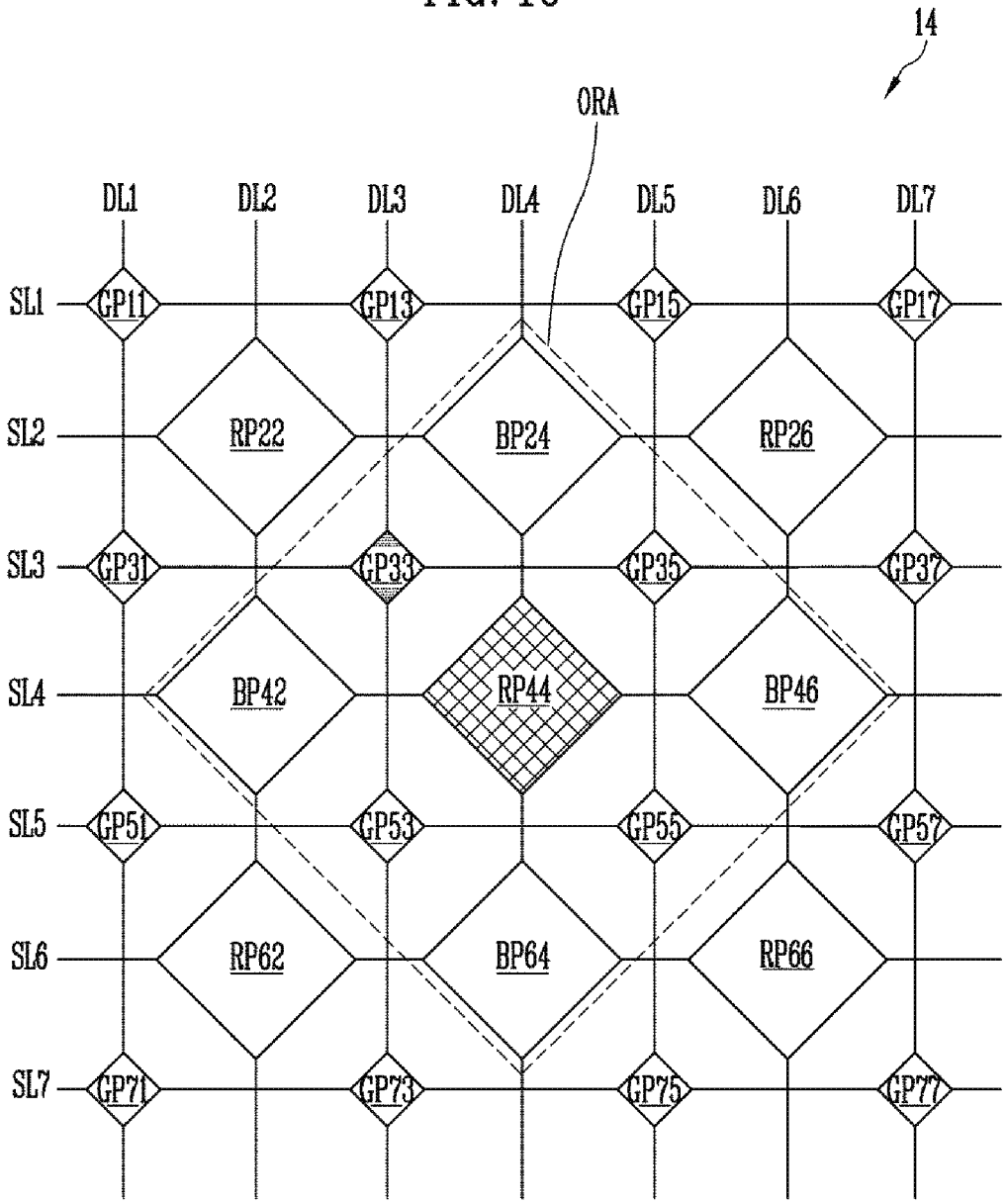

Referring to FIG. 18, in the unit area ORA, the target pixel RP44 is in the emission state, the second color observation pixel GP33 is in the emission state, and the other observation pixels BP24, GP35, BP42, BP46, GP53, GP55, and BP64 are in the non-emission state. The unit area ORA may emit double mixed color light. When the first color is the red color and the second color is the green color, the double mixed color light in FIG. 18 may be light of the yellow color.

Although not shown in the drawing, in the unit area ORA, the target pixel RP44 may be in the emission state, two or more second color observation pixels may be in the emission state, and the other observation pixels may be in the non-emission state. The unit area ORA may emit double mixed color light of the yellow color. However, a double mixed color light curve in this case may be different from that in the case shown in FIG. 18.

Figure 19:
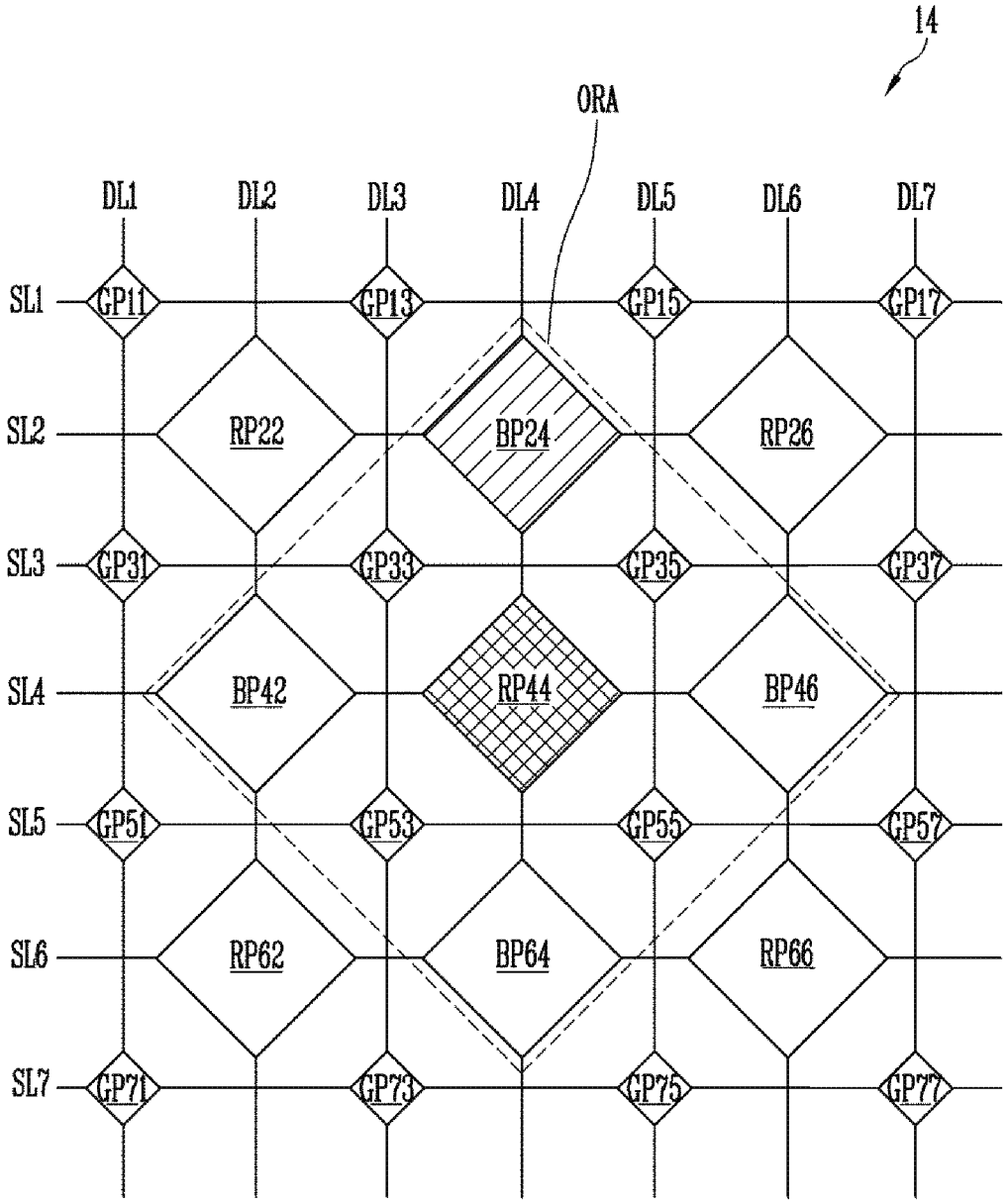

Referring to FIG. 19, in the unit area ORA, the target pixel RP44 is in the emission state, the third color observation pixel BP24 is in the emission state, and the other observation pixels GP33, GP35, BP42, BP46, GP53, GP55, and BP64 are in the non-emission state. The unit area ORA may emit double mixed color light. When the first color is the red color and the third color is the blue color, the double mixed color light in FIG. 19 may be light of the magenta color.

Although not shown in the drawing, in the unit area ORA, the target pixel RP44 may be in the emission state, two or more third color observation pixels may be in the emission state, and the other observation pixels may be in the non-emission state. The unit area ORA may emit double mixed color light of the magenta color. However, a double mixed color light curve in this case may be different from that in the case shown in FIG. 19.

Figure 20:
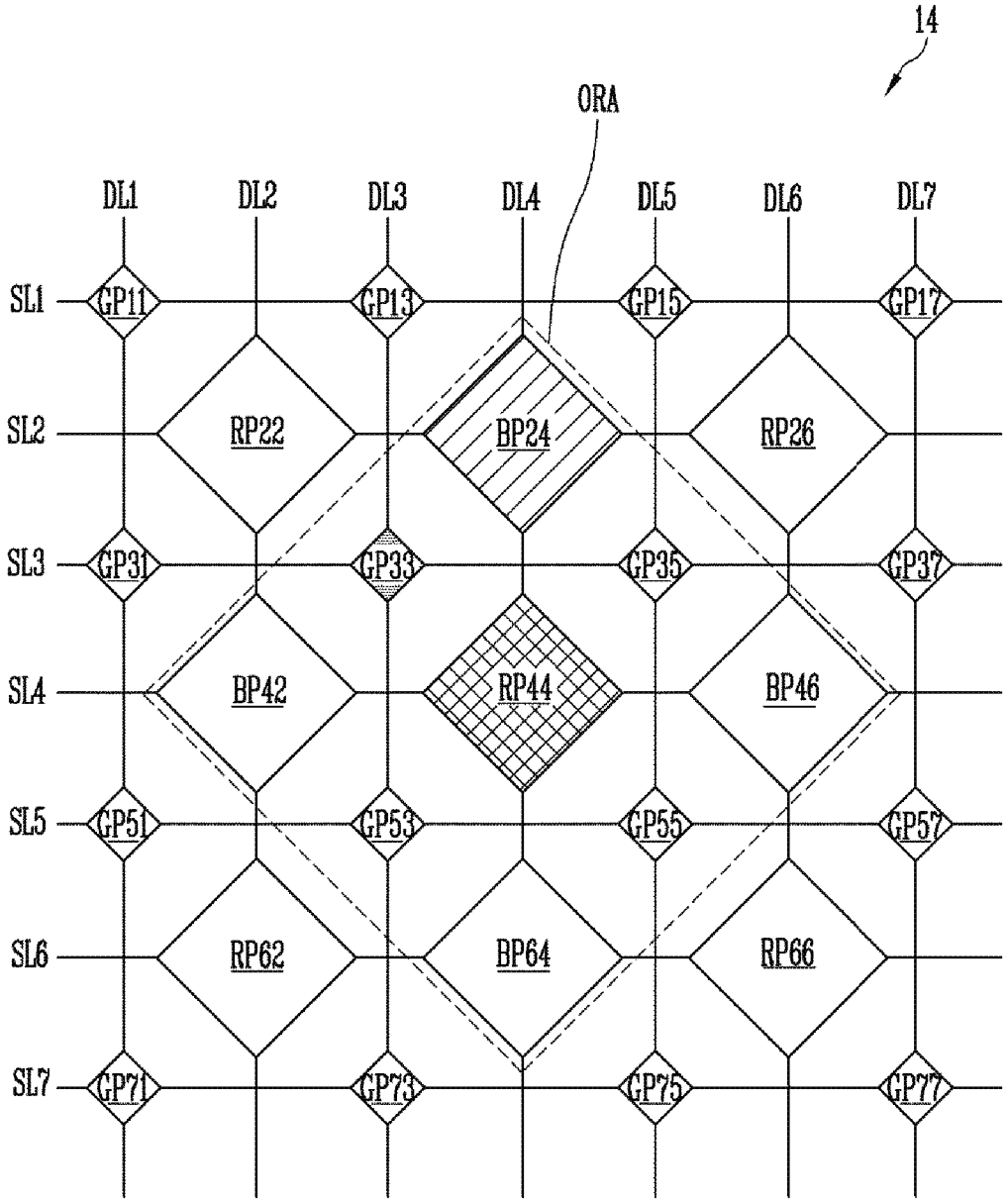

Referring to FIG. 20, in the unit area ORA, the target pixel RP44 is in the emission state, the second color observation pixel GP33 is in the emission state, the third color observation pixel BP24 is in the emission state, and the other observation pixels GP35, BP42, BP46, GP53, GP55, and BP64 are in the non-emission state. The unit area ORA may emit triple mixed color light. However, in the present exemplary embodiment, when all the pixels BP24, GP33, GP35, BP42, RP44, BP46, GP53, GP55, and BP64 of the unit area ORA are in the emission state, light emitted from the unit area ORA is not determined as triple mixed color light. Triple mixed color light curves may be different from one another depending on emission combinations of the observation pixels.

Figure 21:
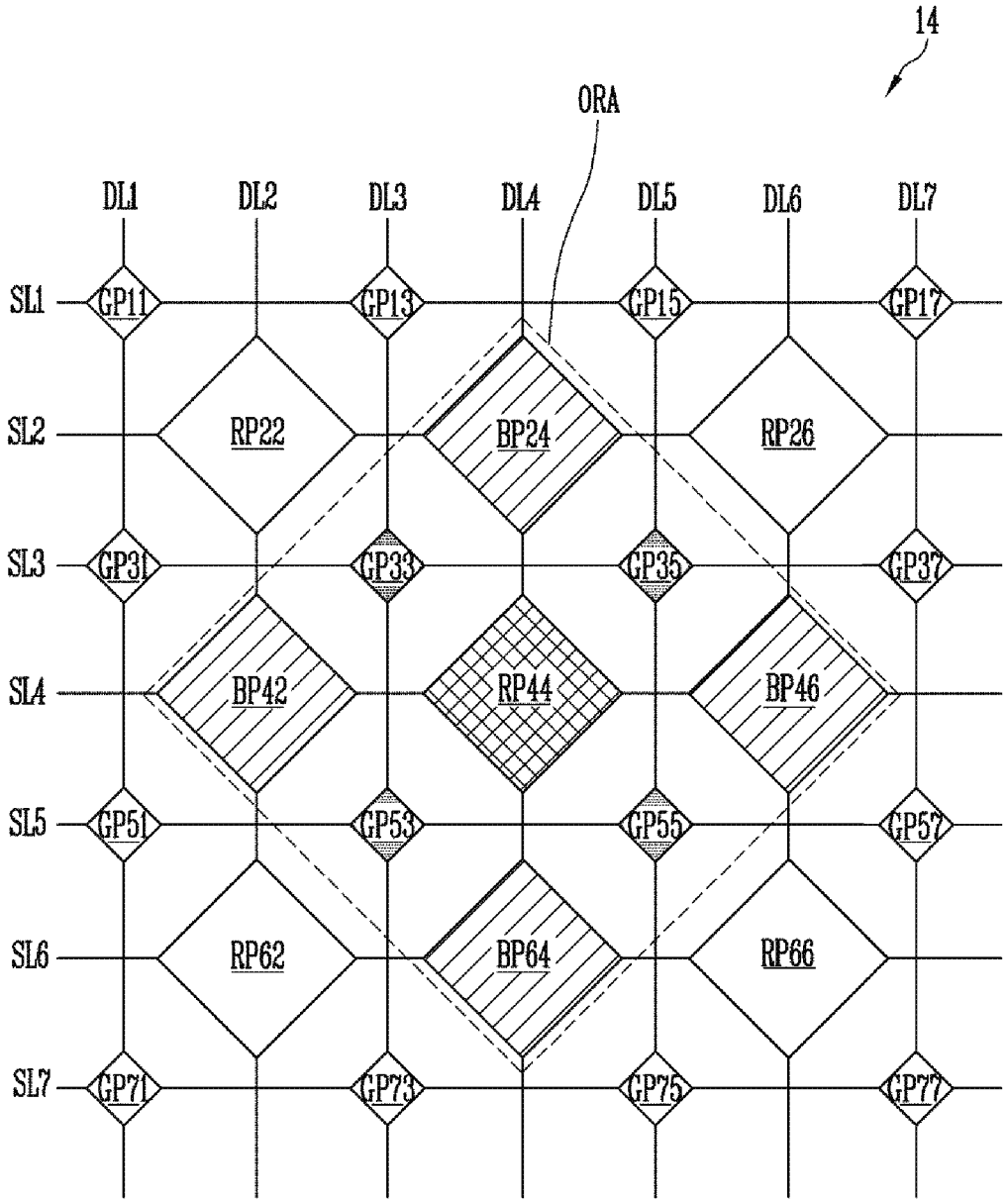

Referring to FIG. 21, in the unit area ORA, a case where all the pixels BP24, GP33, GP35, BP42, RP44, BP46, GP53, GP55, and BP64 are in the emission state is illustrated. The unit area ORA may emit white color light. The white color light means light emitted when all the pixels BP24, GP33, GP35, BP42, RP44, BP46, GP53, GP55, and BP64 are in the emission state, and input grayscale values and observation grayscale values are not considered. In other words, when all input grayscale values and observation grayscale values of the unit area ORA exceed the reference value, it is determined that the unit area ORA emits the white color light. As described above, it is unnecessary to separately perform correction on a white color light curve.

Referring to FIGS. 22 to 26, a target pixel BP64 is a pixel of the third color is illustrated.

The target pixel BP64 may emit light of the third color. First color observation pixels RP44, RP62, RP66, and RP84 are located adjacent to the target pixel BP64, and may emit light of the first color. Second color observation pixels GP53, GP55, GP73, and GP75 are located adjacent to the target pixel BP64, and may emit light of the second color.

A unit area OBA may be an area including the target pixel BP64 and the observation pixels RP44, GP53, GP55, RP62, RP66, GP73, GP75, and RP84. The first color observation pixels RP44, RP62, RP66, and RP84 may be set as first color pixels located at a most adjacent distance from the target pixel BP64. The second color observation pixels GP53, GP55, GP73, and GP75 may be set as second color pixels located at a most adjacent distance from the target pixel BP64. Therefore, no other pixels exist between the target pixel BP64 and the observation pixels RP44, GP53, GP55, RP62, RP66, GP73, GP75, and RP84.

Figure 22:
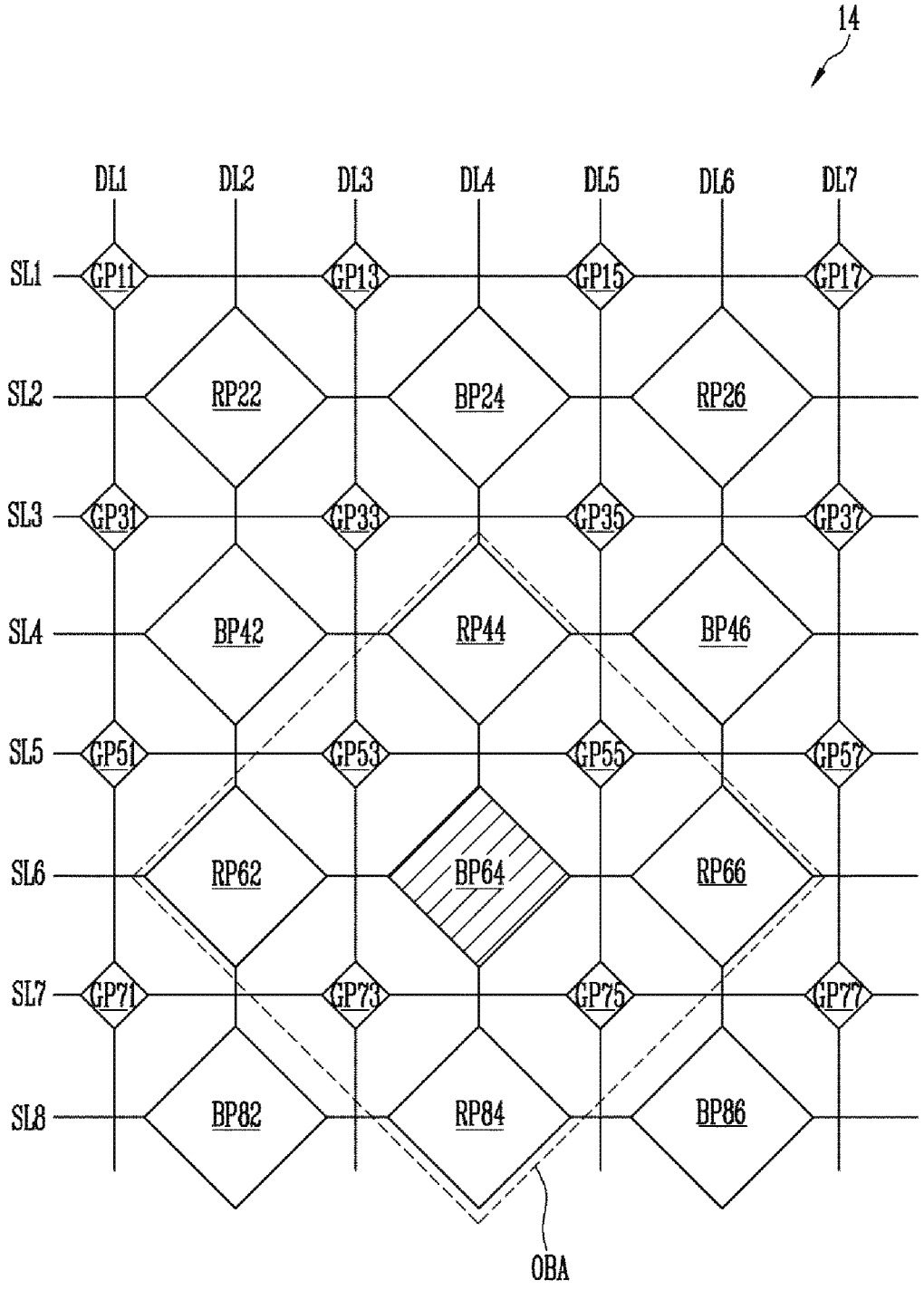

Referring to FIG. 22, in the unit area OBA, the target pixel BP64 is in the emission state, and the observation pixels RP44, GP53, GP55, RP62, RP66, GP73, GP75, and RP84 are in the non-emission state. The unit area OBA may emit single color light of the third color.

Figure 23:
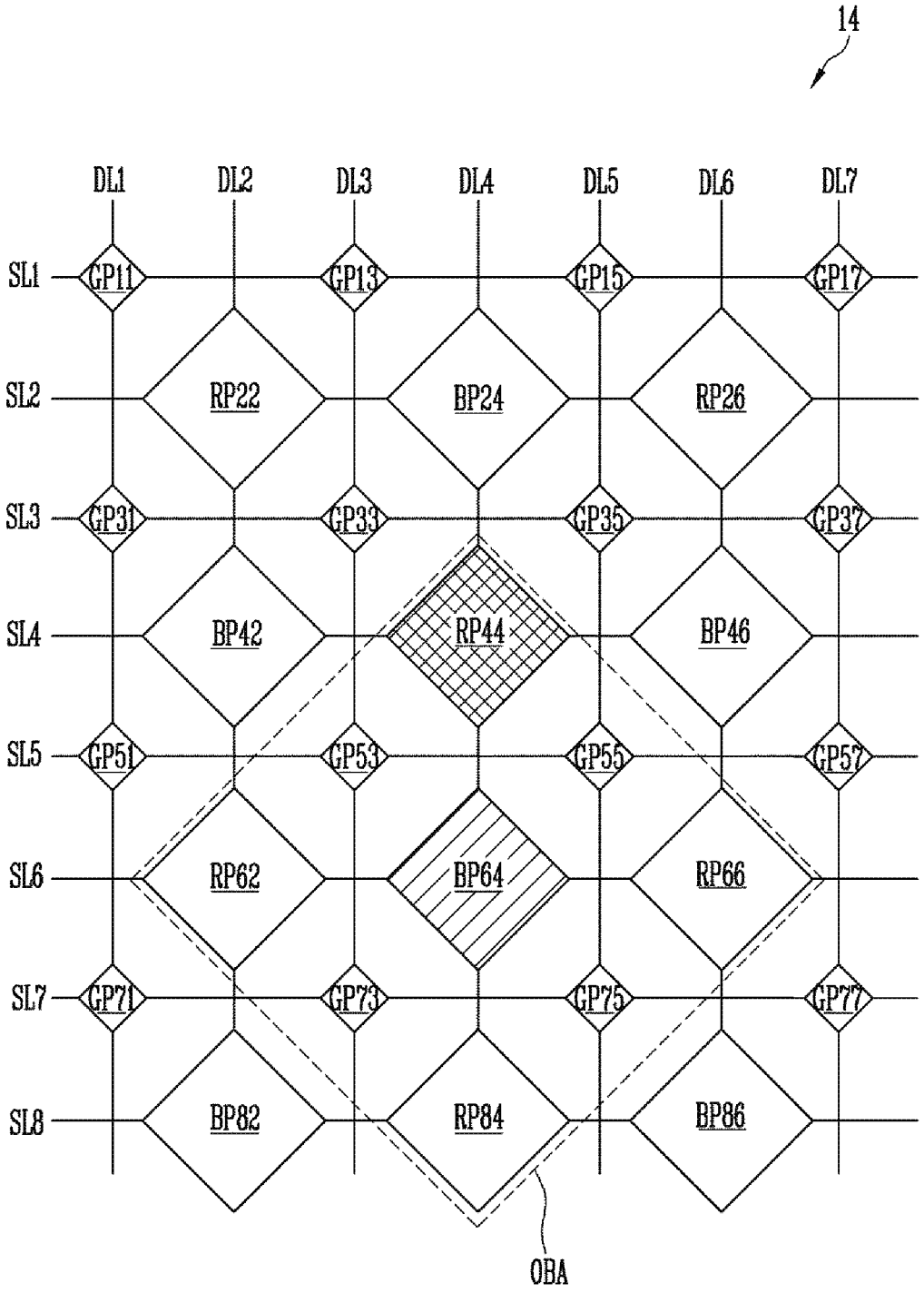

Referring to FIG. 23, in the unit area OBA, the target pixel BP64 is in the emission state, the first color observation pixel RP44 is in the emission state, and the other observation pixels GP53, GP55, RP62, RP66, GP73, GP75, and RP84 are in the non-emission state. The unit area OBA may emit double mixed color light. When the first color is the red color and the third color is the blue color, the double mixed color light in FIG. 23 may be light of the magenta color.

Although not shown in the drawing, in the unit area OBA, the target pixel BP64 may be in the emission state, two or more first color observation pixels may be in the emission state, and the other observation pixels may be in the non-emission state. The unit area OBA may emit double mixed color light of the magenta color. However, a double mixed color light curve in this case may be different from that in the case shown in FIG. 23.

Figure 24:
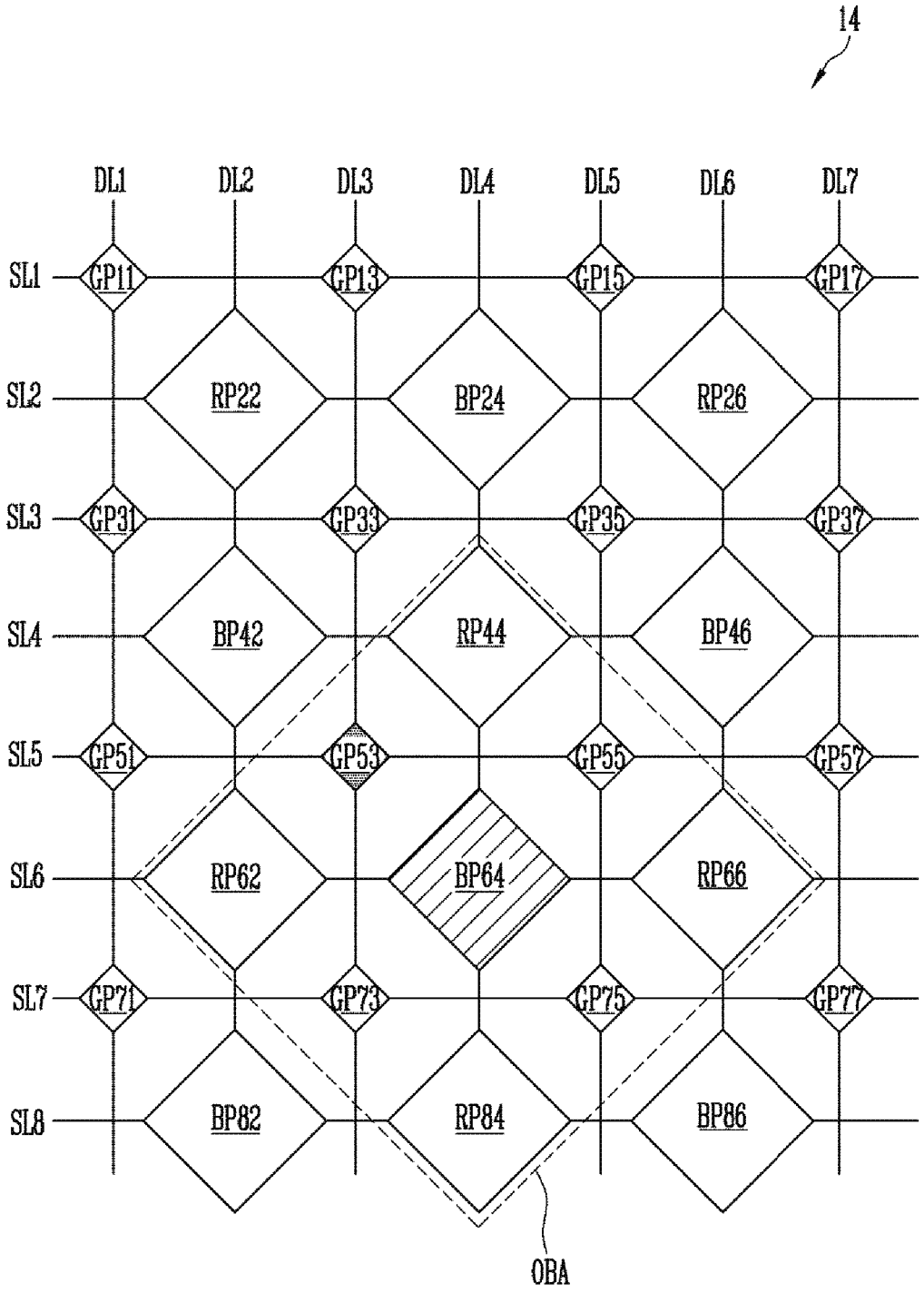

Referring to FIG. 24, in the unit area OBA, the target pixel BP64 is in the emission state, the second color observation pixel GP53 is in the emission state, and the other observation pixels RP44, GP55, RP62, RP66, GP73, GP75, and RP84 are in the non-emission state. The unit area OBA may emit double mixed color light. When the second color is the green color and the third color is the blue color, the double mixed color light in FIG. 24 may be light of the cyan color.

Although not shown in the drawing, in the unit area OBA, the target pixel BP64 may be in the emission state, two or more second color observation pixels may be in the emission state, and the other observation pixels may be in the non-emission state. The unit area OBA may emit double mixed color light of the cyan color. However, a double mixed color light curve in this case may be different from that in the case shown in FIG. 24.

Figure 25:
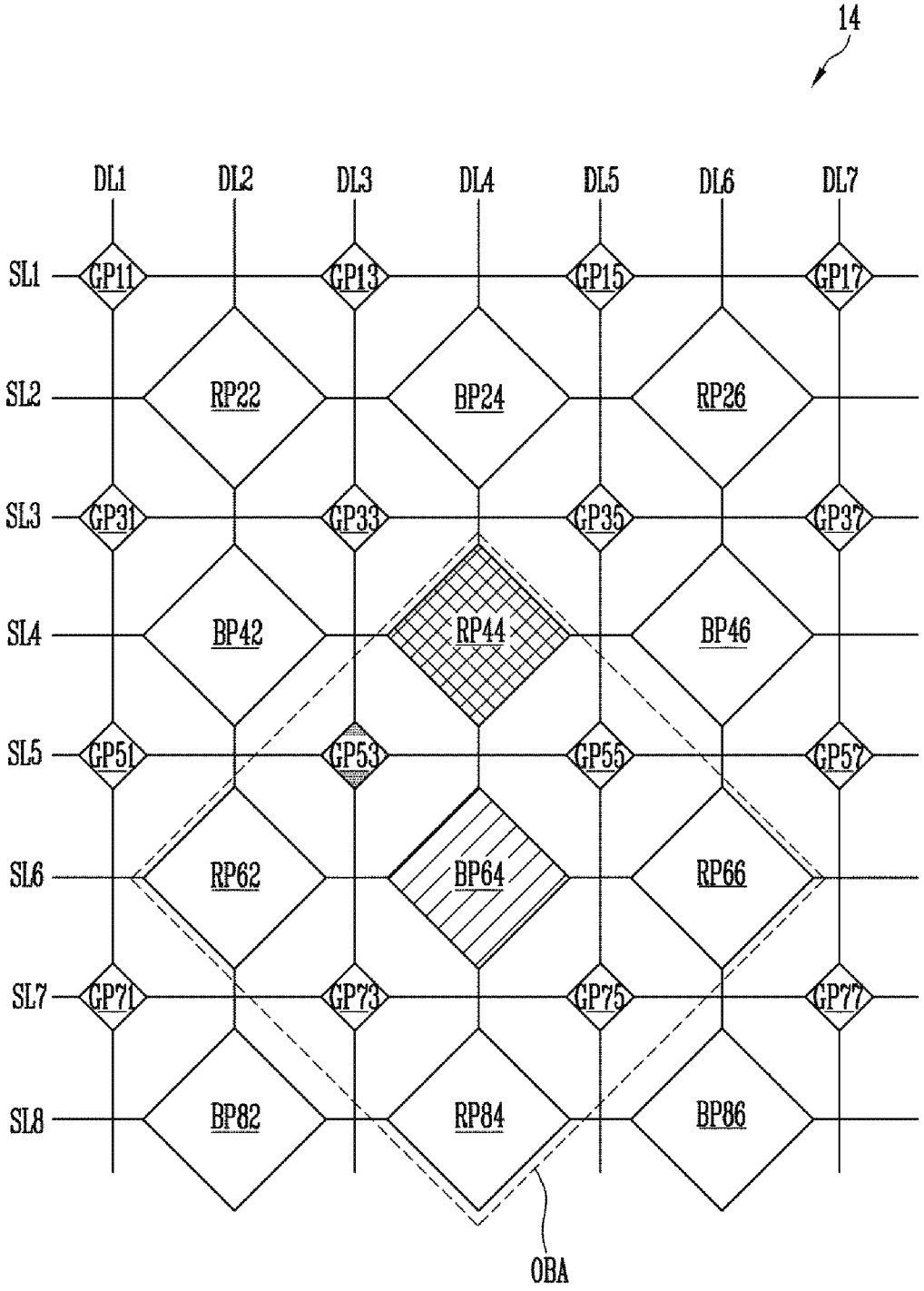

Referring to FIG. 25, in the unit area OBA, the target pixel BP64 is in the emission state, the first color observation pixel RP44 is in the emission state, the second color observation pixel GP53 is in the emission state, and the other observation pixels GP55, RP62, RP66, GP73, GP75, and RP84 are in the non-emission state. The unit area OBA may emit triple mixed color light. However, in the present exemplary embodiment, when all the pixels RP44, GP53, GP55, RP62, BP64, RP66, GP73, GP75, and RP84 of the unit area OBA are in the emission state, light emitted from the unit area OBA is not determined as triple mixed color light. Triple mixed color light curves may be different from one another depending on emission combinations of the observation pixels.

Figure 26:
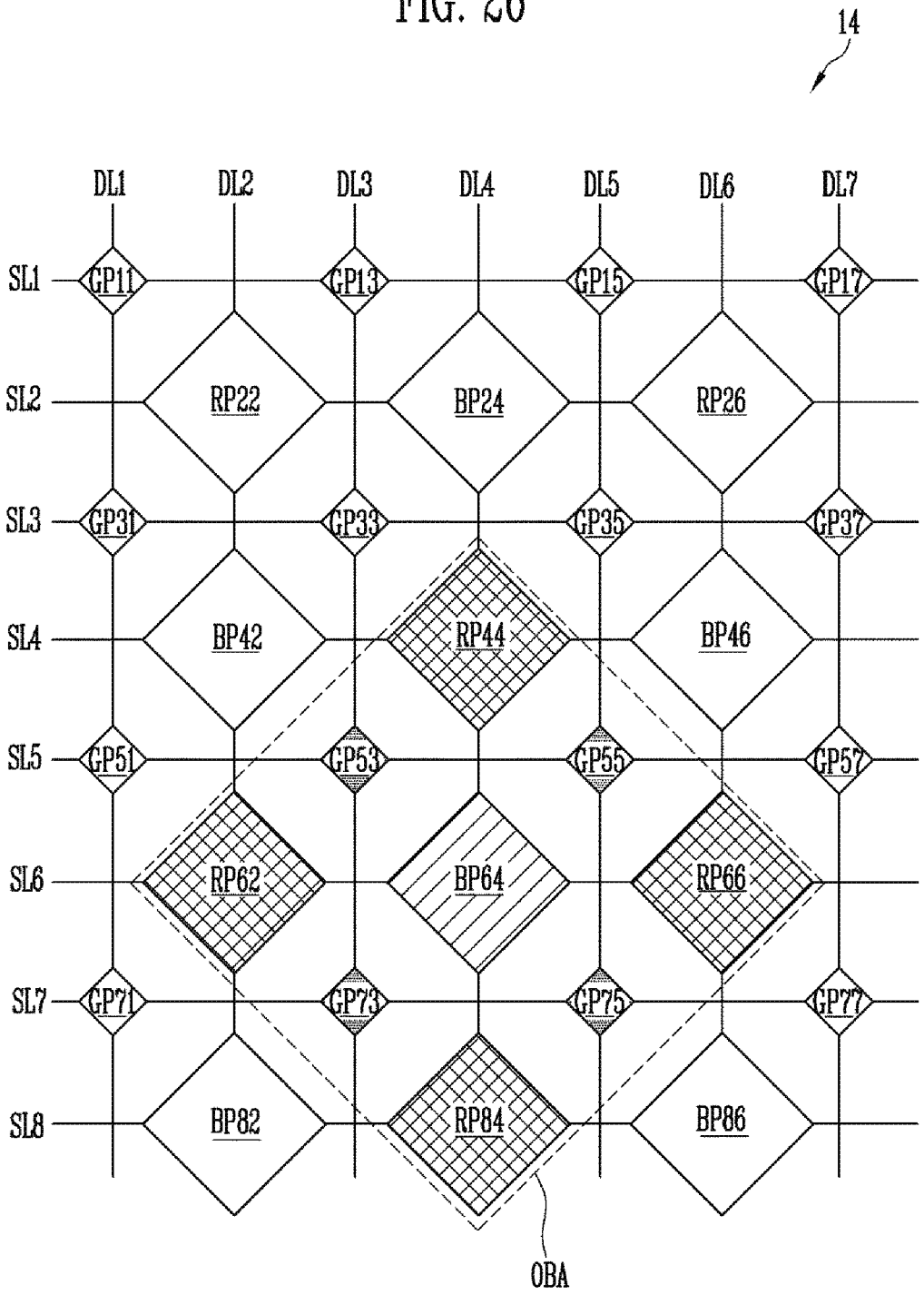

Referring to FIG. 26, a case where all the pixels RP44, GP53, GP55, RP62, BP64, RP66, GP73, GP75, and RP84 of the unit area OBA are in the emission state is illustrated. The unit area OBA may emit white color light. The white color light means light emitted when all the pixels RP44, GP53, GP55, RP62, BP64, RP66, GP73, GP75, and RP84 of the unit area OBA are in the emission state, and input grayscale values and observation grayscale values are not considered. In other words, when all input grayscale values and observation grayscale values of the unit area OBA exceed the reference value, it is determined that the unit area OBA emits the white color light. As described above, it is unnecessary to separately perform correction on a white color light curve.

Figure 27:
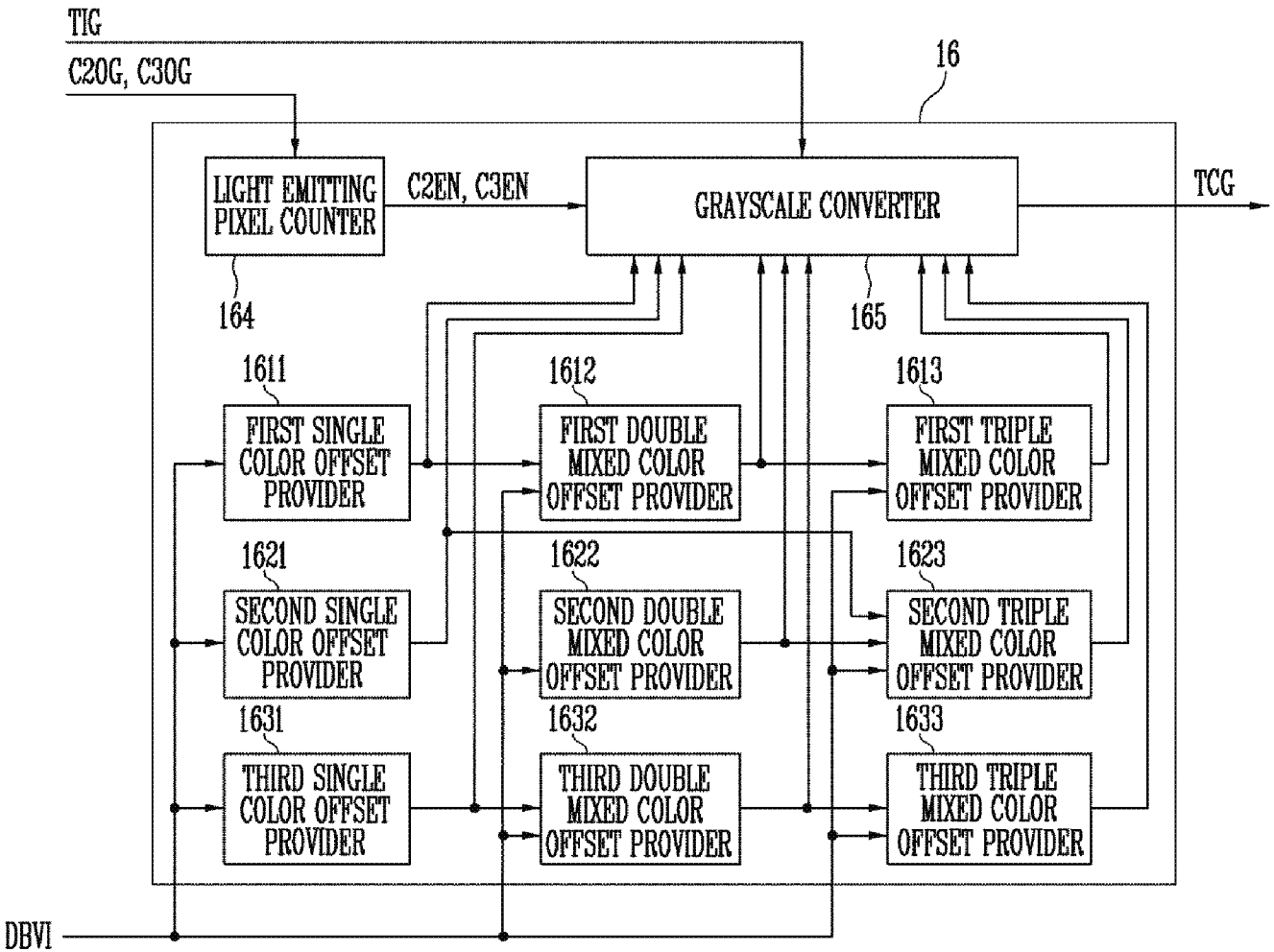
FIG. 27 is a diagram illustrating a grayscale corrector in accordance with an exemplary embodiment of the inventive concept.

FIG. 27 is a diagram illustrating a grayscale corrector in accordance with an exemplary embodiment of the inventive concept.

Referring to FIG. 27, the grayscale corrector 16 may include a light emitting pixel counter 164, a grayscale converter 165, single color offset providers 1611, 1621, and 1631, double mixed color offset providers 1612, 1622, and 1632, and triple mixed color offset providers 1613, 1623, and 1632.

Hereinafter, a case where a target pixel emits light of the first color is assumed for convenience of description. The grayscale corrector 16 may convert an input grayscale value TIG corresponding to the target pixel with reference to second color observation grayscale values C2OG corresponding to second color observation pixels and third color observation grayscale values C3OG corresponding to third color observation pixels.

In a driving method of the display device, the grayscale converter 165 may receive the input grayscale value TIG corresponding to the target pixel, and the light emitting pixel counter 164 may receive the second color observation grayscale values C2OG and the third color observation grayscale values C3OG.

The light emitting pixel counter 164 may determine and provide a second color light emitting pixel number C2EN by counting a number of the second color observation grayscale values C2OG that exceed a reference value, and determine and provide a third color light emitting pixel number C3EN by counting a number of third color observation grayscale values C3OG that exceed the reference value. As described above, a pixel receiving a grayscale value that exceeds the reference value may be sorted as an emission pixel (the pixel is in an emission state). Thus, in other words, the second color light emitting pixel number is a number of the second color observation pixels in the emission state, and the third color light emitting pixel number is a number of the third color observation pixels in the emission state. The grayscale corrector 16 converts the input grayscale value TIG based on whether the second color observation pixels and the third color observation pixels are in an emission state.

For example, in the case shown in FIG. 17, the light emitting pixel counter 164 may determine the second color light emitting pixel number C2EN as 0, and determine the third color light emitting pixel number C3EN as 0. In the case shown in FIG. 18, the light emitting pixel counter 164 may determine the second color light emitting pixel number C2EN as 1, and determine the third color light emitting pixel number C3EN as 0. In the case shown in FIG. 19, the light emitting pixel counter 164 may determine the second color light emitting pixel number C2EN as 0, and determine the third color light emitting pixel number C3EN as 1. In the case shown in FIG. 20, the light emitting pixel counter 164 may determine the second color light emitting pixel number C2EN as 1, and determine the third color light emitting pixel number C3EN as 1. In the case shown in FIG. 21, the light emitting pixel counter 164 may determine the second color light emitting pixel number C2EN as 4, and determine the third color light emitting pixel number C3EN as 4.

The grayscale converter 165 may generate and provide a converted grayscale value TCG obtained by converting the input grayscale value TIG, based on the second color light emitting pixel number C2EN and the third color light emitting pixel number C3EN. For example, the grayscale converter 165 may generate the converted grayscale value TCG by adding an offset value to the input grayscale value TIG.

For example, when the second color light emitting pixel number C2EN is 0 and the third color light emitting pixel number C3EN is 0, the grayscale converter 165 may generate the converted grayscale value TCG by adding a corresponding offset value among single color offset values to the input grayscale value TIG (see FIG. 17).

In addition, when the second color light emitting pixel number C2EN is greater than 0 and the third color light emitting pixel number C3EN is 0, the grayscale converter 165 may generate the converted grayscale value TCG by adding a corresponding offset value among double mixed color offset values to the input grayscale value TIG (see FIG. 18).

In addition, when the second color light emitting pixel number C2EN is greater than 0, the third color light emitting pixel number C3EN is greater than 0, and the second color light emitting pixel number C2EN and the third color light emitting pixel number C3EN are not respectively equal to the number of second color observation pixels and the number of third color observation pixels, the grayscale converter 165 may generate the converted grayscale value TCG by adding a corresponding offset value among triple mixed color offset values to the input grayscale value TIG (see FIG. 20).

In addition, when the second color light emitting pixel number C2EN is equal to the number of second color observation pixels and the third color light emitting pixel number C3EN is equal to the number of third color observation pixels, the grayscale converter 165 may determine the input grayscale value TIG as the converted grayscale value TCG. In other words, the offset value in this case may be 0 (see FIG. 21). Thus, in all other cases, e.g., when the second color light emitting pixel number C2EN is not equal to a total number of the second color observation pixels, or the third color light emitting pixel number C3EN is not equal to a total number of the third color observation pixels, the converted grayscale value TCG is not equal to the input grayscale value TIG. As described above, the input grayscale value TIG added with an offset value is determined as the converted grayscale value TCG.

A first single color offset provider 1611 may provide first single color offset values. The first single color offset values may be single color offset values for the first color, and vary depending on the input maximum luminance value DBVI.

A second single color offset provider 1621 may provide second single color offset values. The second single color offset values may be single color offset values for the second color, and vary depending on the input maximum luminance value DBVI.

A third single color offset provider 1631 may provide third single color offset values. The third single color offset values may be single color offset values for the third color, and vary depending on the input maximum luminance value DBVI.

A first double mixed color offset provider 1612 may provide first double mixed color offset values. The first double mixed color offset values may be double mixed color offset values for a mixed color (e.g., the yellow color) of the first color and the second color or a mixed color (e.g., the magenta color) of the first color and the third color, with respect to a target pixel of the first color.

A second double mixed color offset provider 1622 may provide second double mixed color offset values. The second double mixed color offset values may be double mixed color offset values for a mixed color (e.g., the yellow color) of the second color and the first color or a mixed color (e.g., the cyan color) of the second color and the third color, with respect to a target pixel of the second color.

A third double mixed color offset provider 1622 may provide third double mixed color offset values. The third double mixed color offset values may be double mixed color offset values for a mixed color (e.g., the magenta color) of the third color and the first color or a mixed color (e.g., the cyan color) of the third color and the second color, with respect to a target pixel of the third color.

A first triple mixed color offset provider 1613 may provide first triple mixed color offset values. The first triple mixed color offset values may be triple mixed color offset values for a mixed color of the first color, the second color, and the third color, with respect to a target pixel of the first color.

A second triple mixed color offset provider 1623 may provide second triple mixed color offset values. The second triple mixed color offset values may be triple mixed color offset values for a mixed color of the first color, the second color, and the third color, with respect to a target pixel of the second color.

A third triple mixed color offset provider 1633 may provide third triple mixed color offset values. The third triple mixed color offset values may be triple mixed color offset values for a mixed color of the first color, the second color, and the third color, with respect to a target pixel of the third color.

Figure 28:
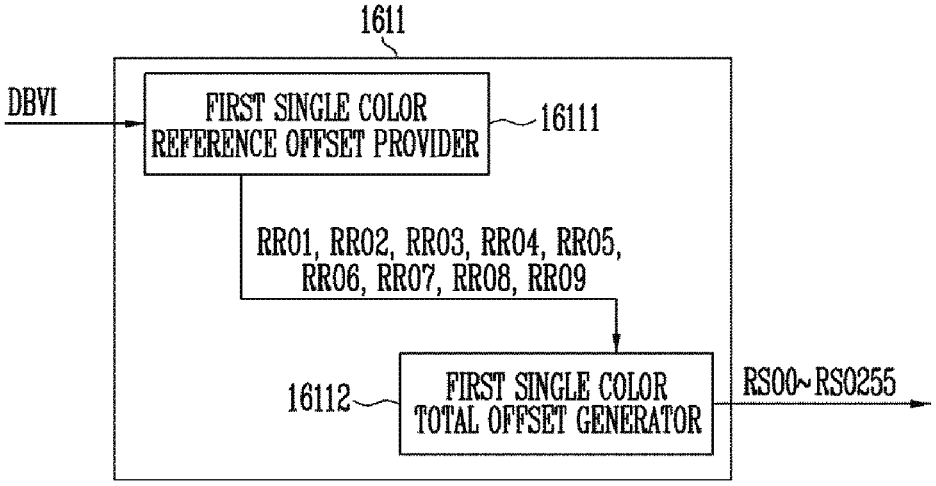
FIGS. 28 to 30 are diagrams illustrating a single color offset provider in accordance with an exemplary embodiment of the inventive concept.
Figure 29:
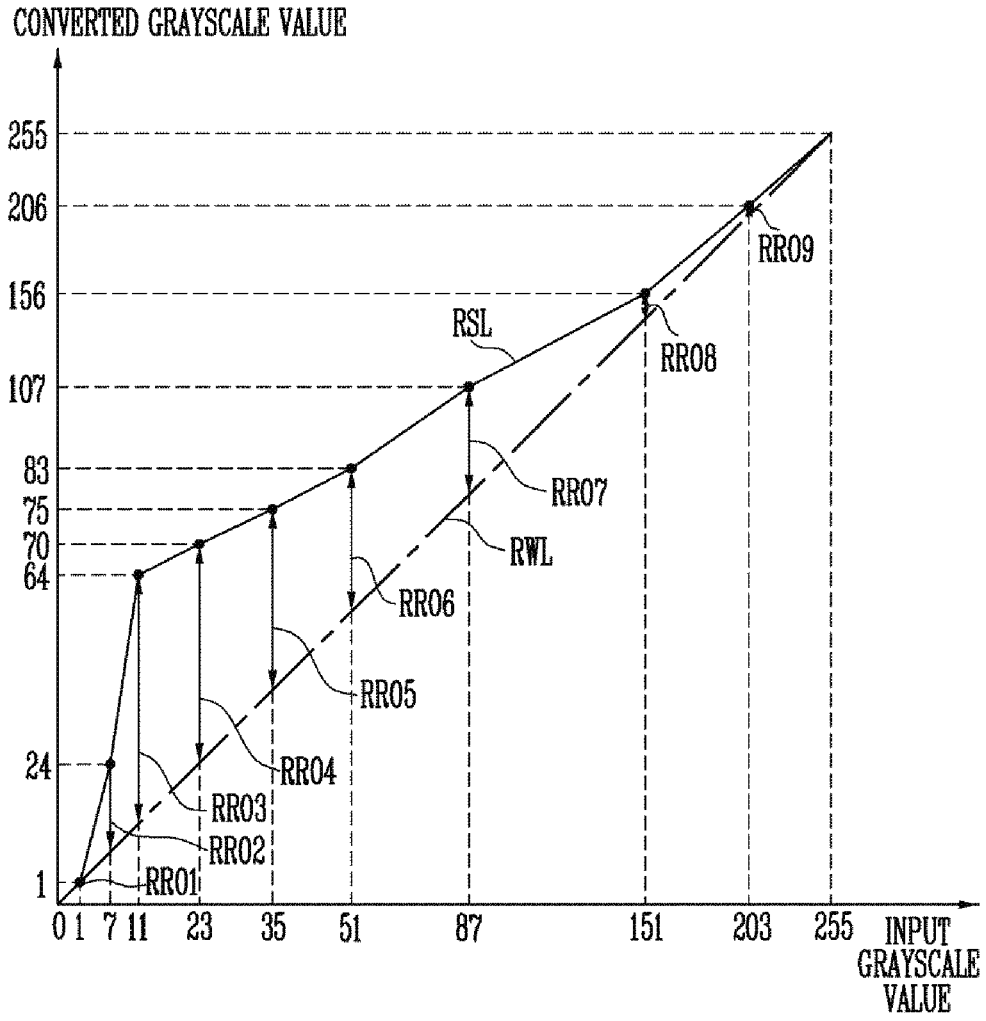
Figure 30:
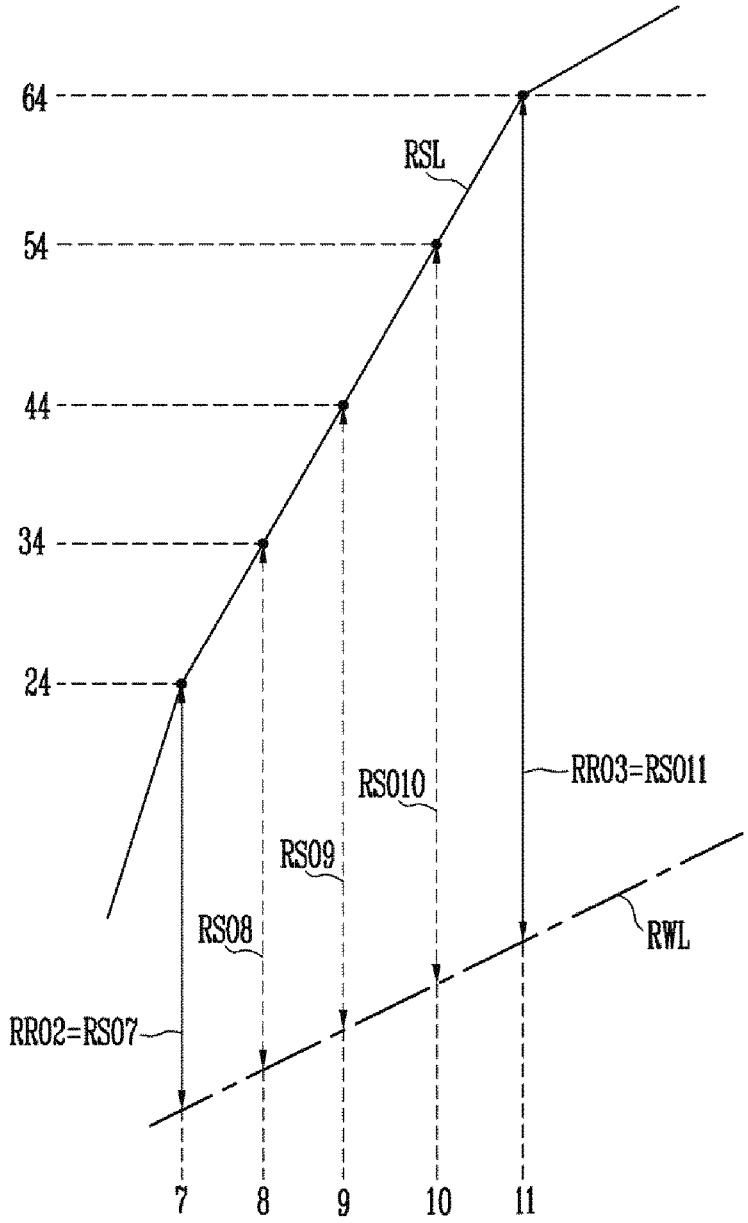

FIGS. 28 to 30 are diagrams illustrating a single color offset provider according to an exemplary embodiment of the inventive concept.

In exemplary embodiments of the inventive concept, the first single color offset provider 1611 may include a first single color reference offset provider 16111 and a first single color total offset generator 16112. The same description may be substantially applied to the second and third single color offset providers 1621 and 1631, and therefore, overlapping descriptions will be omitted.

The first single color reference offset provider 16111 may receive the input maximum luminance value DBVI, and provide first single color reference offset values RRO1, RRO2, RRO3, RRO4, RRO5, RRO6, RRO7, RRO8, and RRO9 corresponding to the input maximum luminance value DBVI.

When the second color light emitting pixel number is equal to the number of second color observation pixels and the third color light emitting pixel number is equal to the number of third color observation pixels, a converted grayscale value equal to the input grayscale value may be output by the grayscale converter 165 as described above. The relationship of converted grayscale values with respect to input grayscale values may follow a white color grayscale line RWL.

When the second color light emitting pixel number is 0 and the third color light emitting pixel number is 0, a converted grayscale value different from the input grayscale value may be output by the grayscale converter 165 as described above. In other words, the converted grayscale value may be generated by adding a corresponding offset value among first single color offset values RSO0 to RSO255 to the input grayscale value. The relationship of converted grayscale values with respect to input grayscale values may follow a first single color grayscale line RSL.

For example, when the input grayscale value is 1, the converted grayscale value may become 1 by adding a first single offset value RSO1 that is 0 to the input grayscale value. When the input grayscale value 7, the converted grayscale value may become 24 by adding a first single color offset value RSO7 that is 17 to the input grayscale value. When the input grayscale value is 11, the converted grayscale value may become 64 by adding a first single offset value RSO11 that is 53 to the input grayscale value. When the input grayscale value is 23, the converted grayscale value may become 70 by adding a first single color offset value RSO23 that is 47 to the input grayscale value. When the input grayscale value is 35, the converted grayscale value may become 75 by adding a first single color offset value RSO35 that is 40 to the input grayscale value. When the input grayscale value is 51, the converted grayscale value may become 83 by adding a first single color offset value RSO51 that is 32 to the input grayscale value. When the input grayscale value is 87, the converted grayscale value may become 107 by adding a first single color offset value RSO87 that is 20 to the input grayscale value. When the input grayscale value is 151, the converted grayscale value may become 156 by adding a first single color offset value RSO151 that is 5 to the input grayscale value. When the input grayscale value is 203, the converted grayscale value may become 206 by adding a first single color offset value RSO203 that is 3 to the input grayscale value. When the input grayscale value is 255, the converted grayscale value may be 255. When the input grayscale value is 0, the converted grayscale value may be 0.

The first single offset values RSO1, RSO7, RSO11, RSO23, RSO35, RSO51, RSO87, RSO151, and RSO203 may correspond to the first single color reference offset values RRO1, RRO2, RRO3, RRO4, RRO5, RRO6, RRO7, RRO8, and RRO9.

The first single color total offset generator 16112 may generate the first single color offset values RSO1 to RSO255 by interpolating the first single color reference offset values RRO1 to RRO9. The interpolation method may use a conventional method such as linear interpolation, polynomial interpolation, or exponential interpolation.

For example, referring to FIGS. 29 and 30, the first single color total offset generator 16112 may generate a first single color offset value RSO8 corresponding to the grayscale 8, a first single color offset value RSO9 corresponding to the grayscale 9, and a first single color offset value RSO10 corresponding to the grayscale 10 by interpolating a first reference offset value RRO2 corresponding to the grayscale 7 and a first reference offset value RRO3 corresponding to the grayscale 11.

Thus, in accordance with the present exemplary embodiment, it is unnecessary to store all first total offset values RSO0 to RSO255, and accordingly, the configuration cost of a memory device, etc. can be reduced.

Figure 31:
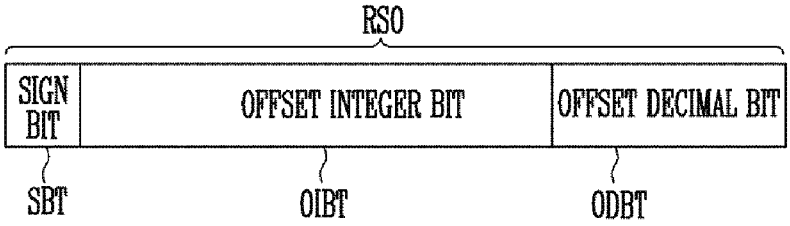
FIG. 31 is a diagram illustrating a configuration of an offset value in accordance with an exemplary embodiment of the inventive concept.

FIG. 31 is a diagram illustrating a configuration of an offset value according to an exemplary embodiment of the inventive concept.

Referring to FIG. 31, an offset value RSO may include a sign bit SBT, an offset integer bit OIBT, and an offset decimal bit ODBT.

The sign bit SBT may express whether the offset value RSO is a positive number or negative number. For example, referring to FIG. 11, it may be necessary to decrease the gamma values of the first single color light curve RWC and the second single color light curve GWC, and therefore, the offset value RSO may be the positive number. On the other hand, it may be necessary to increase the gamma value of the third single color light curve BWC, and therefore, the offset value RSO may be the negative number. For example, the offset value RSO may represent the positive number when the sign bit SBT is 0, and represent the negative number when the sign bit SBT is 1. On the contrary, the offset value RSO may represent the positive number when the sign bit SBT is 1, and represent the negative number when the sign bit SBT is 0.

Like the case shown in FIG. 30, interpolated converted grayscale values 24, 44, 54, and 64 may be expressed with only integers, but it is necessary to express interpolated converted grayscale values with integers and decimals in some cases. For example, referring to FIG. 29, when 63 input grayscale values corresponding to between 87 and 151 are corrected as converted grayscale values between 107 and 156, the corrected converted grayscale values may be expressed with integers and decimals. Since the number of integers between 107 and 156 is 48, it is necessary to express a minimum of 15 converted grayscale values with integers and decimals. Therefore, the offset value RSO includes the offset integer bit OIBT and the offset decimal bit ODBT.

When the offset value RSO has a decimal value, the corrected converted grayscale value cannot express a corresponding luminance, using only one of the grayscale voltages RV0 to RV255 (see FIG. 8). The display panel 10 spatially dithers a target pixel and adjacent pixels, to express a luminance corresponding to a converted grayscale value having a decimal value.

Figure 32:
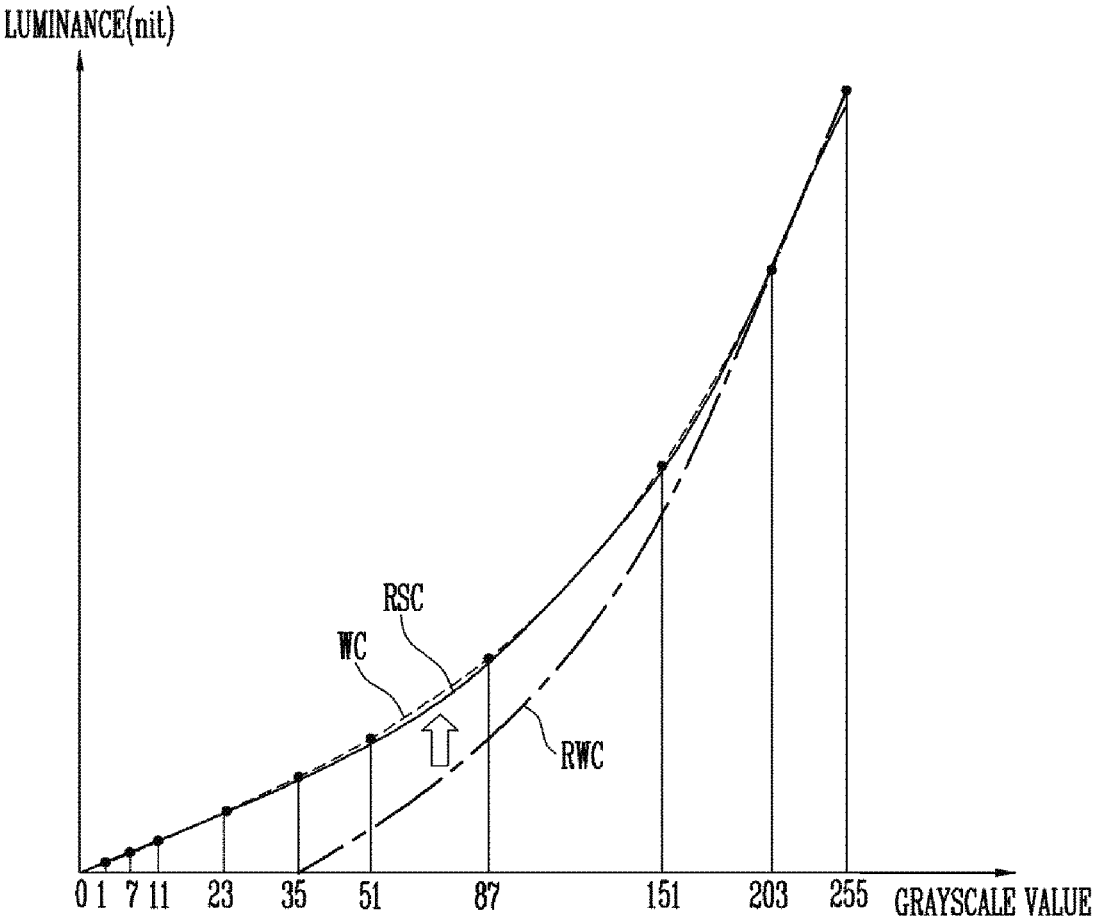
FIG. 32 is a diagram illustrating an effect obtained by applying a single color offset value in accordance with an exemplary embodiment of the inventive concept.

FIG. 32 is a diagram illustrating an effect obtained by applying a single color offset value according to an exemplary embodiment of the inventive concept.

A first single color light curve RWC represents a luminance when pixels emit light of a first single color according to input grayscale values.

A first single color light correction curve RSC represents a luminance when the pixels emit light of the first single color according to converted grayscale values obtained by correcting the input grayscale values.

For example, in accordance with an exemplary embodiment of the inventive concept, the display panel 10 may include a first pixel emitting light of a first color, a second pixel emitting light of a second color different from the first color, and a third pixel emitting light of a third color different from the first color and the second color.

A first luminance of the first pixel in a first case where the first pixel, the second pixel, and the third pixel emit lights and a second luminance of the first pixel in a second case where only the first pixel emits light and the second pixel and the third pixel do not emit light may be different from each other.

Input grayscale values provided corresponding to the first pixel in the first case and the second case may be equal to each other.

In other words, the first luminance with respect to the input grayscale value in the first case may follow the first single color light curve RWC, and the second luminance with respect to the input grayscale value in the second case may follow the first single color light correction curve RSC.

A gamma value of the first single color light correction curve RSC may be smaller than that of the first single color light curve RWC. Accordingly, the luminance of the first single color can be accurately expressed according to a desired gamma curve. In addition, low grayscale expression can be further clarified.

The above described exemplary embodiment may be substantially applied to second single color light and third single color light, and therefore, overlapping descriptions will be omitted.

Figure 33:
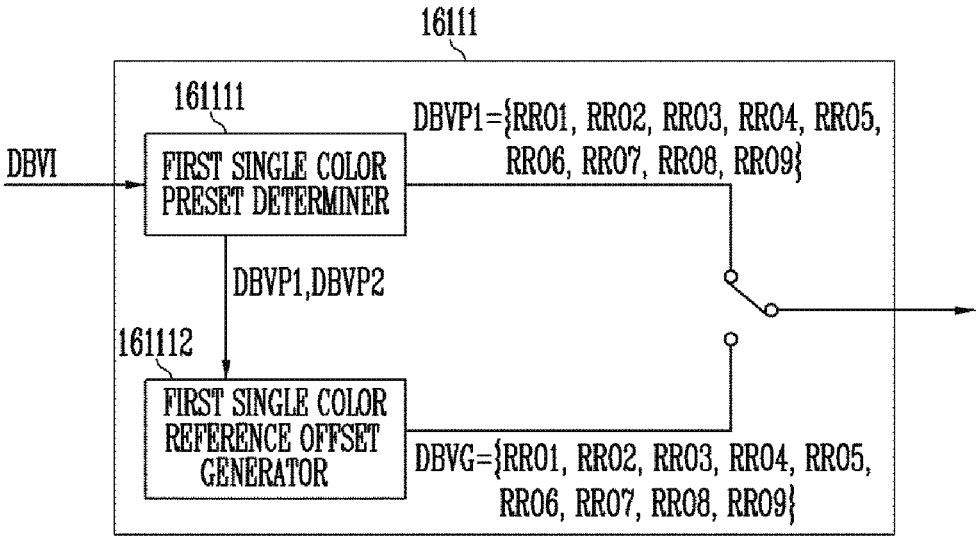
FIGS. 33 and 34 are diagrams illustrating a single color reference offset provider in accordance with an exemplary embodiment of the inventive concept.
Figure 34:
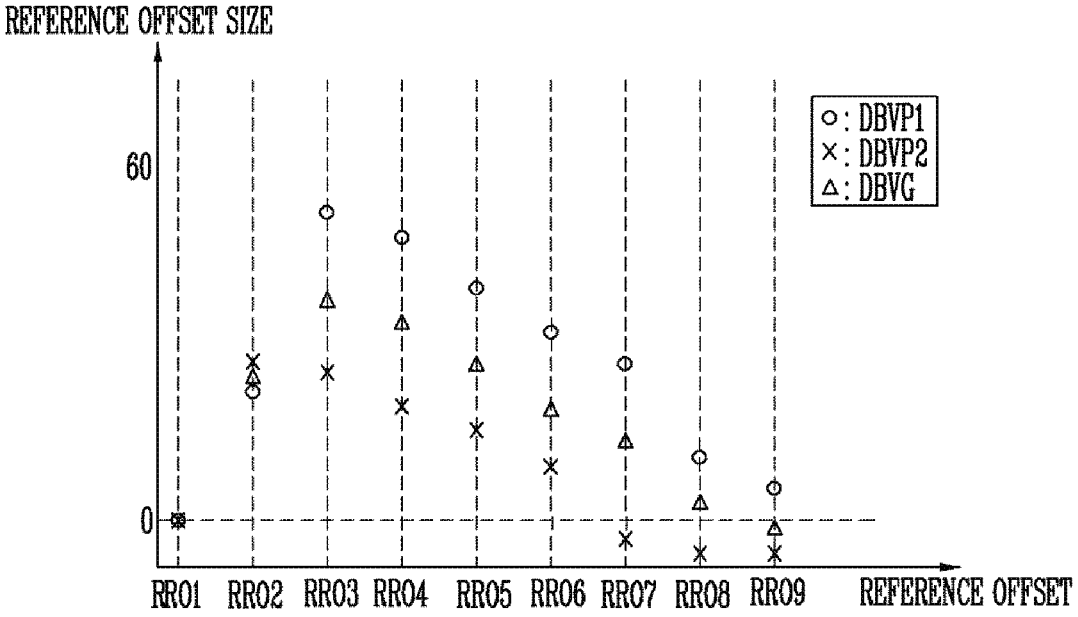

FIGS. 33 and 34 are diagrams illustrating a single color reference offset provider according to an exemplary embodiment of the inventive concept.

In exemplary embodiments of the inventive concept, the first single color reference offset provider 16111 may include a first single color preset determiner 161111 and a first single color reference offset generator 161112.

The first single color preset determiner 161111 may pre-store first preset offset values corresponding to preset maximum luminance values, and determine whether the input maximum luminance value DBVI corresponds to any one of the preset maximum luminance values.

For example, the preset maximum luminance values may include a maximum value (e.g., 1200 nits) and a minimum value (e.g., 4 nits) of the receivable input maximum luminance value DBVI.

Additionally, the preset maximum luminance values may further include a first intermediate maximum luminance value (e.g., 100 nits). When the input maximum luminance value is a value between the maximum value and the first intermediate maximum luminance value, a grayscale voltage corresponding to a converted grayscale value is adjusted corresponding to the input maximum luminance value DBVI, so that the luminance of a target pixel can be controlled. For example, the luminance of the target pixel in a section between 1200 nits and 100 nits may rely on a grayscale voltage control method. In addition, when the input maximum luminance value DBVI is a value between the minimum value and the first intermediate maximum luminance value, the emission period of the target pixel is adjusted corresponding to the input maximum luminance value DBVI, so that the luminance of the target pixel can be controlled. For example, the luminance of the target pixel in a section between 100 nits and 4 nits may rely on a duty ratio control method.

In addition, the preset maximum luminance values may further include a second intermediate maximum luminance value (e.g., 30 nits) that is a value between the first intermediate maximum luminance value and the minimum value.

The above-described four preset maximum luminance values (e.g., 1200 nits, 100 nits, 30 nits, and 4 nits) are merely an example, and other preset maximum luminance values may be set depending on products.

When the input maximum luminance value DBVI corresponds to any one of the preset maximum luminance values, the first single color preset determiner 161111 may provide corresponding first preset offset values DBVP1 as the first single color reference offset values RRO1 to RRO9. For example, first preset offset values DBVP1 for 1200 nits, 100 nits, 30 nits, and 4 nits may be pre-stored. Therefore, when the input maximum luminance value DBVI corresponds to one of 1200 nits, 100 nits, 30 nits, and 4 nits, the first single color reference offset values RRO1 to RRO9 may be provided without passing through the first single color reference offset generator 161112.

When the input maximum luminance value DBVI does not correspond to any one of the preset maximum luminance values, the first single color preset determiner 161111 may provide first preset offset values corresponding to at least two preset maximum luminance values.

For example, when the input maximum luminance value DBVI is 17 nits, the first single color preset determiner 161111 may provide first preset offset values DBVP1 corresponding to 4 nits and second preset offset values DBVP2 corresponding to 30 nits.

The first single color reference offset generator 161112 may generate the first single color reference offset values RRO1 to RRO9 by interpolating the first and second preset offset values DBVP1 and DBVP2 corresponding to the at least two preset maximum luminance values.

Referring to FIG. 34, a process of determining magnitudes of first reference offset values DBVG corresponding to 17 nits by interpolating the first preset offset values DBVP1 corresponding to 4 nits and the second preset offset values DBVP2 corresponding to 30 nits is expressed by a graph.

Thus, in accordance with the present exemplary embodiment, it is unnecessary to store all offset values with respect to the receivable input maximum luminance value DBVI, and accordingly, the configuration cost of a memory device, etc. can be reduced.

FIGS. 35 to 38 are diagrams illustrating a first double mixed color offset provider and a first triple mixed color offset provider according to an exemplary embodiment of the inventive concept.

Figure 35:
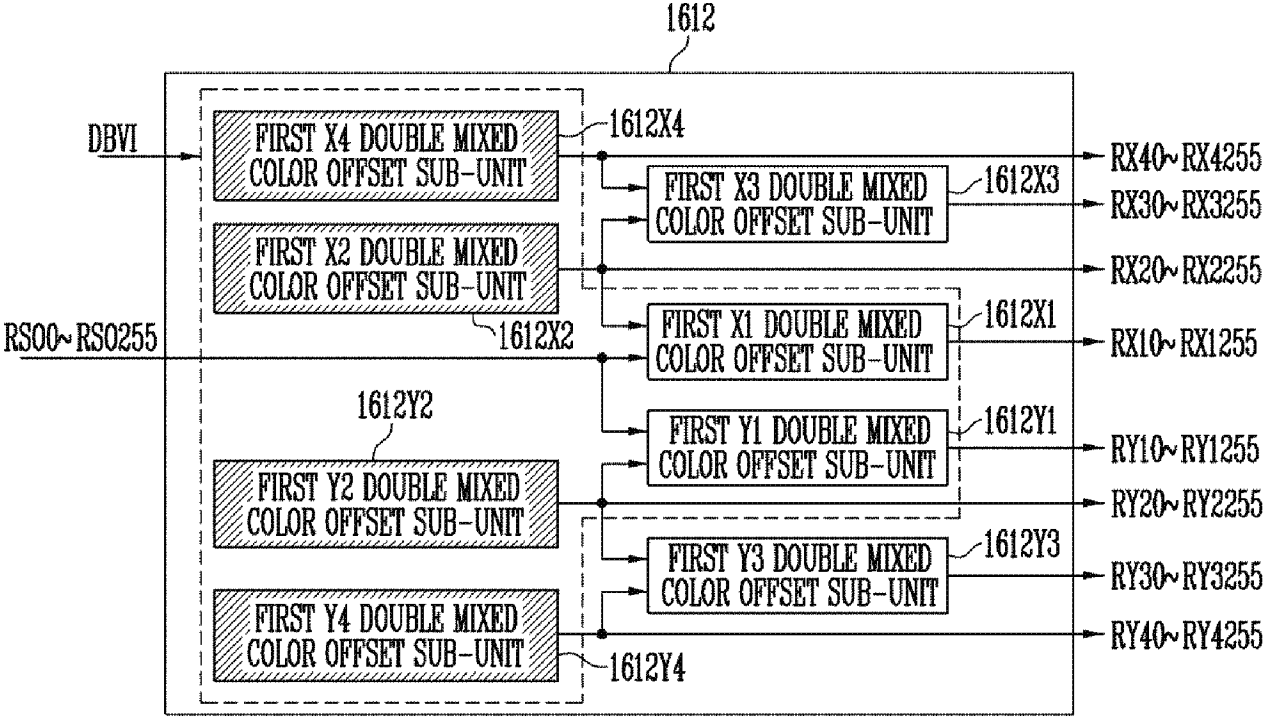
FIGS. 35 to 38 are diagrams illustrating a first double mixed color offset provider and a first triple mixed color offset provider in accordance with an exemplary embodiment of the inventive concept.

Referring to FIG. 35, the first double mixed color offset provider 1612 may include first double mixed color offset sub-units 1612X1, 1612X2, 1612X3, 1612X4, 1612 Y1, 1612Y2, 1612Y3, and 1612Y4.

A first X2 double mixed color offset sub-unit 1612X2 may provide first X2 double mixed color offset values RX20 to RX2255 corresponding to when the second color light emitting pixel number is 2 and the third color light emitting pixel number is 0, with respect to a target pixel of the first color.

A first X4 double mixed color offset sub-unit 1612X4 may provide first X4 double mixed color offset values RX40 to RX4255 corresponding to when the second color light emitting pixel number is 4 and the third color light emitting pixel number is 0, with respect to a target pixel of the first color.

A first Y2 double mixed color offset sub-unit 1612Y2 may provide first Y2 double mixed color offset values RY20 to RY2255 corresponding to when the second color light emitting pixel number is 0 and the third color light emitting pixel number is 2, with respect to a target pixel of the first color.

A first Y4 double mixed color offset sub-unit 1612Y4 may provide first Y4 double mixed color offset values RY40 to RY4255 corresponding to when the second color light emitting pixel number is 0 and the third color light emitting pixel number is 4, with respect to a target pixel of the first color.

Figure 36:
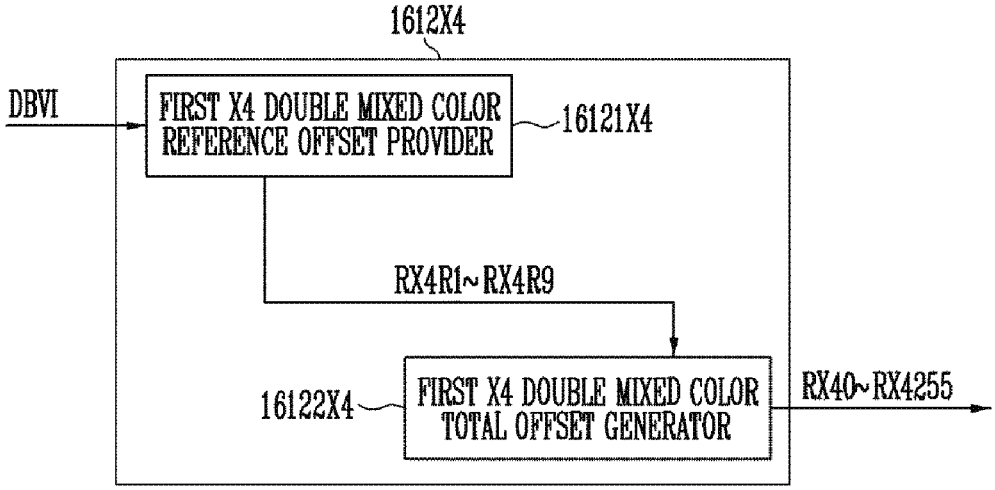

Referring to FIG. 36, the first X4 double mixed color offset sub-unit 1612X4 may include a first X4 double mixed color reference offset provider 16121X4 and a first X4 double mixed color total offset generator 16122X4.

The first X4 double mixed color reference offset provider 16121X4 may provide first X4 double mixed color reference offset values RX4R0 to RX4R255 corresponding to the input maximum luminance value DBVI.

The first X4 double mixed color total offset generator 16122X4 may generate the first X4 double mixed color offset values RX40 to RX4255 by interpolating first X4 double mixed color reference offset values RX4R1 to RX4R9.

A configuration and an operation of the first X4 double mixed color offset sub-unit 1612X4 are substantially identical to those of the first single color offset provider 1611 shown in FIG. 28, and therefore, overlapping descriptions will be omitted. Likewise, the first X2 double mixed color offset sub-unit 1612X2, the first Y2 double mixed color offset sub-unit 1612Y2, and the first Y4 double mixed color offset sub-unit 1612Y4 may be similarly configured, and therefore, overlapping descriptions will be omitted.

A first X1 double mixed color offset sub-unit 1612X1 may provide first X1 double mixed color offset values RX10 to RX1255 corresponding to when the second color light emitting pixel number is 1 and the third color light emitting pixel number is 0, with respect to a target pixel of the first color.

For example, the first X1 double mixed color offset sub-unit 1612X1 may generate the first X1 double mixed color offset values RX10 to RX1255 by interpolating the first single color offset values RSO0 to RSO255 and the first X2 double mixed color offset values RX20 to RX2255.

Additionally, for example, the first X1 double mixed color offset sub-unit 1612X1 may output the first X2 double mixed color offset values RX20 to RX2255 as the first X1 double mixed color offset values RX10 to RX1255.

A first X3 double mixed color offset sub-unit 1612X3 may provide double mixed color offset values RX30 to RX3255 corresponding to when the second color light emitting pixel number is 3 and the third color light emitting pixel number is 0, with respect to a target pixel of the first color.

For example, the first X3 double mixed color offset sub-unit 1612X3 may generate first X3 double mixed color offset values RX30 to RX3255 by interpolating the first X2 double mixed color offset values RX20 to RX2255 and the first X4 double mixed color offset values RX40 to RX4255.

A first Y1 double mixed color offset sub-unit 1612Y1 may provide double mixed color offset values RY10 to RY1255 corresponding to when the second color light emitting pixel number is 0 and the third color light emitting pixel number is 1, with respect to a target pixel of the first color.

For example, the first Y1 double mixed color offset sub-unit 1612Y1 may generate first Y1 double mixed color offset values RY10 to RY1255 by interpolating the first single color offset values RSO0 to RSO255 and the first Y2 double mixed color offset values RY20 to RY2255.

Additionally, for example, the first Y1 double mixed color offset sub-unit 1612Y1 may output the first Y2 double mixed color offset values RY20 to RY2255 as the first Y1 double mixed color offset values RY10 to RY1255.

A first Y3 double mixed color offset sub-unit 1612Y3 may provide double mixed color offset values RY30 to RY3255 corresponding to when the second color light emitting pixel number is 0 and the third color light emitting pixel number 3, with respect to a target pixel of the first color.

For example, the first Y3 double mixed color offset sub-unit 1612Y3 may provide first Y3 double mixed color offset values RY30 to RY3255 by interpolating the first Y2 double mixed color offset values RY20 to RY2255 and the first Y4 double mixed color offset values RY40 to RY4255.

In accordance with the present exemplary embodiment, when a unit area ORA displays a double mixed color (e.g., the magenta color and the yellow color), double mixed color light curves can be adjusted to become similar to a white color light curve.

Figure 37:
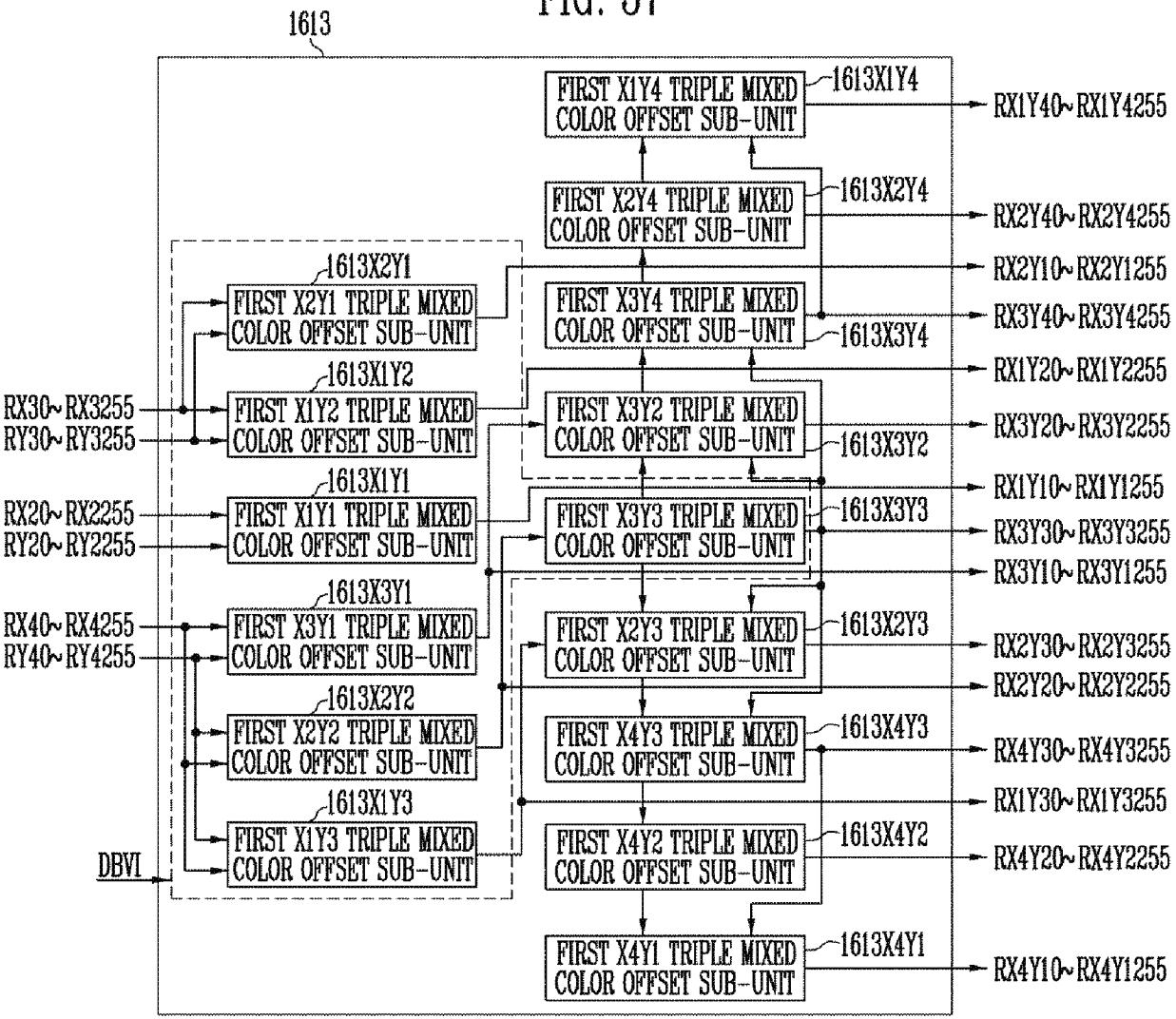

Referring to FIG. 37, the first triple mixed color offset provider 1613 may include first triple mixed color offset sub-units 1613X1Y1, 1613X1Y2, 1613X1Y3, 1613X1Y4, 1613X2Y1, 1613X2Y2, 1613X2Y3, 1613X2Y4, 1613X3Y1, 1613X3Y2, 1613X3Y3, 1613X3Y4, 1613X4Y1, 1613X4Y2, and 1613X4Y3.

A first X1Y1 triple mixed color offset sub-unit 1613X1Y1 may provide first X1Y1 triple mixed color offset values RX1Y10 to RX1Y1255 corresponding to when the second color light emitting pixel number is 1 and the third color light emitting pixel number is 1, with respect to a target pixel of the first color.

For example, the first X1Y1 triple mixed color offset sub-unit 1613X1Y1 may generate the first X1Y1 triple mixed color offset values RX1Y10 to RX1Y1255 by using double mixed color offset values corresponding to a total sum (here, 2) of light emitting pixel numbers.

For example, the first X1Y1 triple mixed color offset sub-unit 1613X1Y1 may generate the first X1Y1 triple mixed color offset values RX1Y10 to RX1Y1255 by using the first X2 double mixed color offset values RX20 to RX2255 and the first Y2 double mixed color offset values RY20 to RY2255.

For example, the first X1Y1 triple mixed color offset values RX1Y10 to RX1Y1255 may be determined using the following Equation 2.

$$RX1Y1 = \text{W_RX1}Y1 * \frac{\text{X_RX1}Y1 * RX2 + \text{Y_RX1}Y1 * RY2}{\text{X_RX1}Y1 + \text{Y_RX1}Y1} \quad \text{Equation 2}$$

Here, RX1Y1 may be a first X1Y1 triple mixed color offset value corresponding to an input grayscale value, W_RX1Y1 may be a weighted value, X_RX1Y1 may be 1 as the second color light emitting pixel number, Y_RX1Y1 may be 1 as the third color light emitting pixel number, RX2 may be a first X2 double mixed color offset value corresponding to the input grayscale value, and RY2 may be a first Y2 double mixed color offset value corresponding to the input grayscale value. The weighted value W_RX1Y1 may be increased as the input grayscale value is increased. The weighted value W_RX1Y1 may be a real number that is 0 or more and is 1 or less. The weighted value W_RX1Y1 may vary depending on the input maximum luminance value DBVI.

A first X1Y2 triple mixed color offset sub-unit 1613X1Y2 may provide first X1Y2 triple mixed color offset values RX1Y20 to RX1Y2255 corresponding to when the second color light emitting pixel number is 1 and the third color light emitting pixel number is 2, with respect to a target pixel of the first color.

For example, the first X1Y2 triple mixed color offset sub-unit 1613X1Y2 may generate the first X1Y2 triple mixed color offset values RX1Y20 to RX1Y2255 by using double mixed color offset values corresponding to a total sum (here, 3) of light emitting pixel numbers.

For example, the first X1Y2 triple mixed color offset sub-unit 1613X1Y2 may generate the first X1Y2 triple mixed color offset values RX1Y20 to RX1Y2255 by using the first X3 double mixed color offset values RX30 to RX3255 and the first Y3 double mixed color offset values RY30 to RY3255.

For example, the first X1Y2 triple mixed color offset values RX1Y20 to RX1Y2255 may be determined using the following Equation 3.

$$RX1Y2 = \text{W_RX1}Y2 * \frac{\text{X_RX1}Y2 * RX3 + \text{Y_RX1}Y2 * RY3}{\text{X_RX1}Y2 + \text{Y_RX1}Y2} \quad \text{Equation 3}$$

Here, RX1Y2 may be a first X1Y2 triple mixed color offset value corresponding to an input grayscale value, W_RX1Y2 may be a weighted value, X_RX1Y2 may be 1 as the second color light emitting pixel number, Y_RX1Y2 may be 2 as the third color light emitting pixel number, RX3 may be a first X3 double mixed color offset value corresponding to the input grayscale value, and RY3 may be a first Y3 double mixed color offset value corresponding to the input grayscale value. The weighted value W_RX1Y2 may be increased as the input grayscale value is increased. The weighted value W_RX1Y2 may be a real number that is 0 or more and is 1 or less. The weighted value W_RX1Y2 may vary depending on the input maximum luminance value DBVI.

A first X2Y1 triple mixed color offset sub-unit 1613X2Y1 may provide first X2Y1 triple mixed color offset values RX2Y10 to RX2Y1255 corresponding to when the second color light emitting pixel number is 2 and the third color light emitting pixel number is 1, with respect to a target pixel of the first color. For example, the first X2Y1 triple mixed color offset sub-unit 1613X2Y1 may generate the first X2Y1 triple mixed color offset values RX2Y10 to RX2Y1255 by using the first X3 double mixed color offset values RX30 to RX3255 and the first Y1 double mixed color offset values RY30 to RY3255. Therefore, its overlapping description will be omitted.

A first X3Y1 triple mixed color offset sub-unit 1613X3Y1 may provide first X3Y1 triple mixed color offset values RX3Y10 to RX3Y1255 corresponding to when the second color light emitting pixel number is 3 and the third color light emitting pixel is 1, with respect to a target pixel of the first color. For example, the first X3Y1 triple mixed color offset sub-unit 1613X3Y1 may generate the first X3Y1 triple mixed color offset values RX3Y10 to RX3Y1255 by using the first X4 double mixed color offset values RX40 to RX4255 and the first Y4 double mixed color offset values RY40 to RY4255. Therefore, its overlapping description will be omitted.

A first X2Y2 triple mixed color offset sub-unit 1613X2Y2 may provide first X2Y2 triple mixed color offset values RX2Y20 to RX2Y2255 corresponding to when the second color light emitting pixel number is 2 and the third color light emitting pixel number is 2, with respect to a target pixel of the first color. For example, the first X2Y2 triple mixed color offset sub-unit 1613X2Y2 may generate the first X2Y2 triple mixed color offset values RX2Y20 to RX2Y2255 by using the first X4 double mixed color offset values RX40 to RX4225 and the first Y4 double mixed color offset values RY40 to RY4255. Therefore, its overlapping description will be omitted.

A first X1Y3 triple mixed color offset sub-unit 1613X1Y3 may provide first X1Y3 triple mixed color offset values RX1Y30 to RX1Y3255 corresponding to when the second color light emitting pixel number is 1 and the third color light emitting pixel number is 3, with respect to a target pixel of the first color. For example, the first X1Y3 triple mixed color offset sub-unit 1613X1Y3 may generate the first X1Y3 triple mixed color offset values RX1Y30 to RX1Y3255 by using the first X4 double mixed color offset values RX40 to RX4255 and the first Y4 double mixed color offset values RY40 to RY4255. Therefore, its overlapping description will be omitted.

A first X3Y3 triple mixed color offset sub-unit 1613X3Y3 may provide first X3Y3 triple mixed color offset values RX3Y30 to RX3Y3255 corresponding to when the second color light emitting pixel number is 3 and the third color light emitting pixel number is 3, with respect to a target pixel of the first color. For example, the first X3Y3 triple mixed color offset values RX3Y30 to RX3Y3255 may be determined using the following Equation 4.

$$RX3Y3 = W_RX3Y3 * \frac{RX4Y4 + RX2Y2}{2} \quad \text{Equation 4}$$

Here, RX3Y3 may be a first X3Y3 triple mixed color offset value corresponding to an input grayscale value, W_RX3Y3 may be a weighted value, RX4Y4 may be a white color offset value corresponding to the input grayscale value, and RX2Y2 may be a first X2Y2 triple mixed color offset value corresponding to the input grayscale value. The weighted value W_RX3Y3 may be increased as the input grayscale value is increased. The weighted value W_RX3Y3 may be a real number that is 0 or more and is 1 or less. The weighted value W_RX3Y3 may vary depending on the input maximum luminance value DBVI. RX4Y4 may be 0.

A first X3Y2 triple mixed color offset sub-unit 1613X3Y2 may provide first X3Y2 triple mixed color offset values RX3Y20 to RX3Y2255 corresponding to when the second color light emitting pixel number is 3 and the third color light emitting pixel number is 2, with respect to a target pixel of the first color. For example, the first X3Y2 triple mixed color offset values RX3Y20 to RX3Y2255 may be determined using the following Equation 5.

$$RX3Y2 = \frac{RX3Y3 + RX3Y1}{2} \quad \text{Equation 5}$$

Here, RX3Y2 may be a first X3Y2 triple mixed color offset value corresponding to an input grayscale value, RX3Y3 may be a first X3Y3 triple mixed color offset value corresponding to the input grayscale value, and RX3Y1 may be a first X3Y1 triple mixed color offset value corresponding to the input grayscale value.

A first X2Y3 triple mixed color offset sub-unit 1613X2Y3 may provide first X2Y3 triple mixed color offset values RX2Y30 to RX2Y3255 corresponding to when the second color light emitting pixel number is 2 and the third color light emitting pixel number is 3, with respect to a target pixel of the first color. For example, the first X2Y3 triple mixed color offset values RX2Y30 to RX2Y3255 may be determined using the following Equation 6.

$$RX2Y3 = \frac{RX3Y3 + RX1Y3}{2} \quad \text{Equation 6}$$

Here, RX2Y3 may be a first X2Y3 triple mixed color offset value corresponding to an input grayscale value, RX3Y3 may be a first X3Y3 triple mixed color offset value corresponding to the input grayscale value, and RX1Y3 may be a first X1Y3 triple mixed color offset value corresponding to the input grayscale value.

A first X4Y3 triple mixed color offset sub-unit 1613X4Y3 may provide first X4Y3 triple mixed color offset values RX4Y30 to RX4Y3255 corresponding to when the second color light emitting pixel number is 4 and the third color light emitting pixel number is 3, with respect to a target pixel of the first color. For example, the first X4Y3 triple mixed color offset values RX4Y30 to RX4Y3255 may be determined using the following Equation 7.

$$RX4Y3 = RX3Y3 + (RX3Y3 - RX2Y3) \quad \text{Equation 7}$$

Here, RX4Y3 may be a first X4Y3 triple mixed color offset value corresponding to an input grayscale value, RX3Y3 may be a first X3Y3 triple mixed color offset value corresponding to the input grayscale value, and RX2Y3 may be a first X2Y3 triple mixed color offset value corresponding to the input grayscale value.

A first X3Y4 triple mixed color offset sub-unit 1613X3Y4 may provide first X3Y4 triple mixed color offset values RX3Y40 to RX3Y4255 corresponding to when the second color light emitting pixel number is 3 and the third color light emitting pixel number is 4, with respect to a target pixel of the first color. For example, the first X3Y4 triple mixed color offset values RX3Y40 to RX3Y4255 may be determined using the following Equation 8.

$$RX3Y4 = RX3Y3 + (RX3Y3 - RX3Y2) \quad \text{Equation 8}$$

Here, RX3Y4 may be a first X3Y4 triple mixed color offset value corresponding to an input grayscale value, RX3Y3 may be a first X3Y3 triple mixed color offset value corresponding to the input grayscale value, and RX3Y2 may be a first X3Y2 triple mixed color offset value corresponding to the input grayscale value.

A first X2Y4 triple mixed color offset sub-unit 1613X2Y4 may provide first X2Y4 triple mixed color offset values RX2Y40 to RX2Y4255 corresponding to when the second color light emitting pixel number is 2 and the third color light emitting pixel number is 4, with respect to a target pixel of the first color. For example, the first X2Y4 triple mixed color offset values RX2Y40 to RX2Y4255 may be determined using the following Equation 9.

$$RX2Y4 = RX3Y4 + (RX3Y4 - RX4Y4) \quad \text{Equation 9}$$

Here, RX2Y4 may be a first X2Y4 triple mixed color offset value corresponding to an input grayscale value, RX3Y4 may be a first X3Y4 triple mixed color offset value corresponding to the input grayscale value, and RX4Y4 may be a white color offset value corresponding to the input grayscale value. RX4Y4 may be 0.

A first X4Y2 triple mixed color offset sub-unit 1613X4Y2 may provide first X4Y2 triple mixed color offset values RX4Y20 to RX4Y2255 corresponding to when the second color light emitting pixel number is 4 and the third color light emitting pixel number is 2, with respect to a target pixel of the first color. For example, the first X4Y2 triple mixed color offset values RX4Y20 to RX4Y2255 may be determined using the following Equation 10.

$$RX4Y2 = RX4Y3 + (RX4Y3 - RX4Y4) \quad \text{Equation 10}$$

Here, RX4Y2 may be a first X4Y2 triple mixed color offset value corresponding to an input grayscale value, RX4Y3 may be a first X4Y3 triple mixed color offset value corresponding to the input grayscale value, and RX4Y4 may be a first X4Y4 triple mixed color offset value corresponding to the input grayscale value.

A first X1Y4 triple mixed color offset sub-unit 1613X1Y4 may provide first X1Y4 triple mixed color offset values RX1Y40 to RX1Y4255 corresponding to when the second color light emitting pixel number is 1 and the third color light emitting pixel number is 4, with respect to a target pixel of the first color. For example, the first X1Y4 triple mixed color offset values RX1Y40 to RX1Y4255 may be determined using the following Equation 11.

$$RX1Y4=RX2Y4+(RX2Y4-RX3Y4) \quad \text{Equation 11}$$

Here, RX1Y4 may be a first X1Y4 triple mixed color offset value corresponding to an input grayscale value, RX2Y4 may be a first X2Y4 triple mixed color offset value corresponding to the input grayscale value, and RX3Y4 may be a first X3Y4 triple mixed color offset value corresponding to the input grayscale value.

A first X4Y1 triple mixed color offset sub-unit 1613X4Y1 may provide first X4Y1 triple mixed color offset values RX4Y10 to RX4Y1255 corresponding to when the second color light emitting pixel number is 4 and the third color light emitting pixel number is 1, with respect to a target pixel of the first color. For example, the first X4Y1 triple mixed color offset values RX4Y10 to RX4Y1255 may be determined using the following Equation 12.

$$RX4Y1=RX4Y2+(RX4Y2-RX4Y3) \quad \text{Equation 12}$$

Here, RX4Y1 may be a first X4Y1 triple mixed color offset value corresponding to an input grayscale value, RX4Y2 may be a first X4Y2 triple mixed color offset value corresponding to the input grayscale value, and RX4Y3 may be a first X4Y3 triple mixed color offset value corresponding to the input grayscale value.

Figures 38, 39:
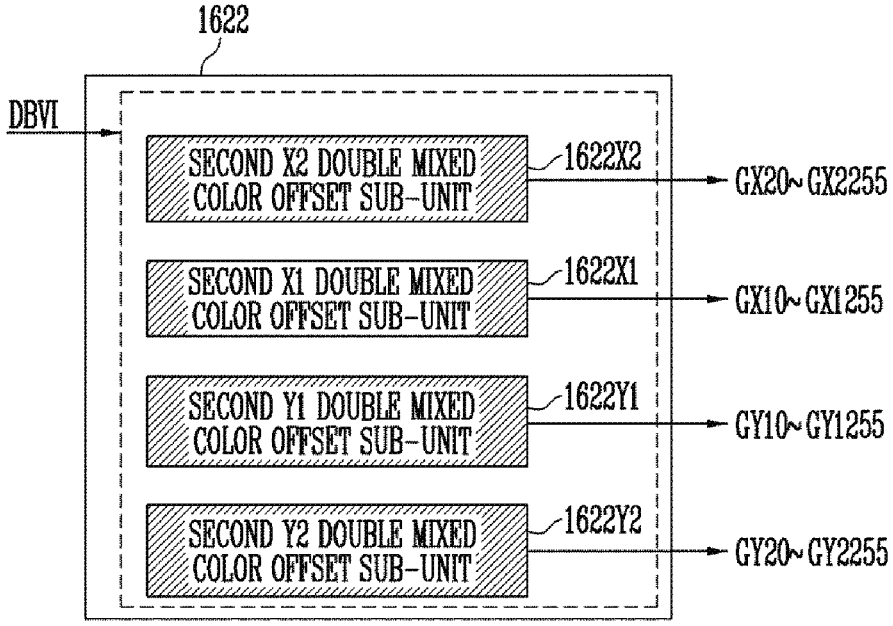
FIGS. 39 to 42 are diagrams illustrating a second double mixed color offset provider and a second triple mixed color offset provider in accordance with an exemplary embodiment of the inventive concept.

FIG. 38 illustrates a table obtained by organizing a relationship of double mixed color offset values and triple mixed color offset values, with respect to a target pixel of the first color. In accordance with the exemplary embodiment shown in FIGS. 35 to 37, a memory device is used only when the first single color offset values RSO0 to RSO255 and some double mixed color offset values RX20 to RX2255, RX40 to RX4255, RY20 to RY2255, and RY40 to RY4255 are generated, and the other double mixed color offset values and the other triple mixed color offset values are produced through calculation, so that the configuration cost of the memory device can be reduced.

FIGS. 39 to 42 are diagrams illustrating a second double mixed color offset provider and a second triple mixed color offset provider according to an exemplary embodiment of the inventive concept.

Referring to FIG. 39, the second double mixed color offset provider 1622 may include second double mixed color offset sub-units 1622X1, 1622X2, 1622 Y1, and 1622Y2.

A second X1 double mixed color offset sub-unit 1622X1 may provide second X1 double mixed color offset values GX10 to GX1255 corresponding to when the first color light emitting pixel number is 1 and third color light emitting pixel number is 0, with respect to a target pixel of the second color.

A second X2 double mixed color offset sub-unit 1622X2 may provide second X2 double mixed color offset values GX20 to GX2255 corresponding to when the first color light emitting pixel number is 2 and third color light emitting pixel number is 0, with respect to a target pixel of the second color.

A second Y1 double mixed color offset sub-unit 1622Y1 may provide second Y1 double mixed color offset values GY10 to GY1255 corresponding to when the first color light emitting pixel number is 0 and third color light emitting pixel number is 1, with respect to a target pixel of the second color.

A second Y2 double mixed color offset sub-unit 1622Y2 may provide second Y2 double mixed color offset values GY20 to GY2255 corresponding to when the first color light emitting pixel number is 0 and third color light emitting pixel number is 2, with respect to a target pixel of the second color.

Figure 40:
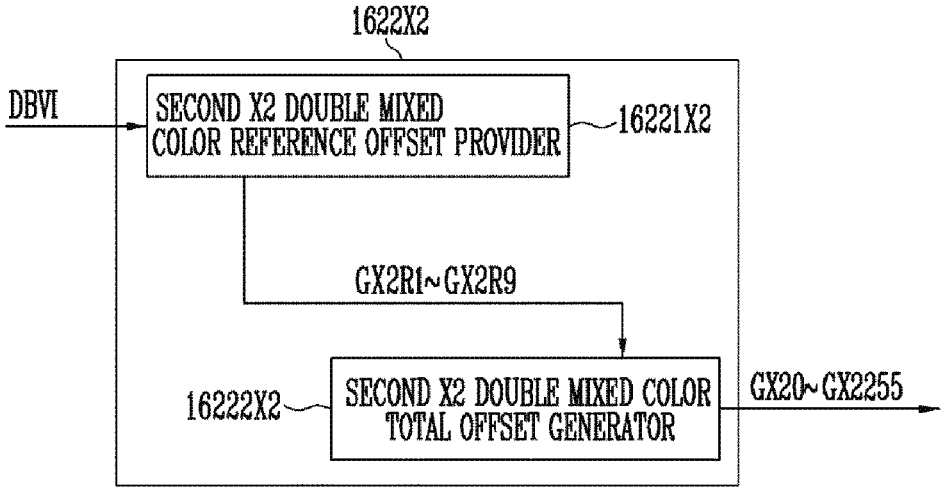

Referring to FIG. 40, the second X2 double mixed color offset sub-unit 1622X2 may include a second X2 double mixed color reference offset provider 16221X2 and a second X2 double mixed color total offset generator 16222X2.

The second X2 double mixed color reference offset provider 16221X2 may provide second X2 double mixed color reference offset values GX2R1 to GX2R9 corresponding to the input maximum luminance value DBVI.

The second X2 double mixed color total offset generator 16222X2 may generate the second X2 double mixed color offset values GX20 to GX2255 by interpolating the second X2 double mixed color reference offset values GX2R1 to GX2R9.

A configuration and an operation of the second X2 double mixed color offset sub-unit 1622X2 are substantially identical to those of the first single color offset provider 1611 shown in FIG. 28, and therefore, overlapping descriptions will be omitted. Likewise, the second X1 double mixed color offset sub-unit 1622X1, the second Y1 double mixed color offset sub-unit 1622Y1, and the second Y2 double mixed color offset sub-unit 1622Y2 may be similarly configured, and therefore, overlapping descriptions will be omitted.

Figure 41:
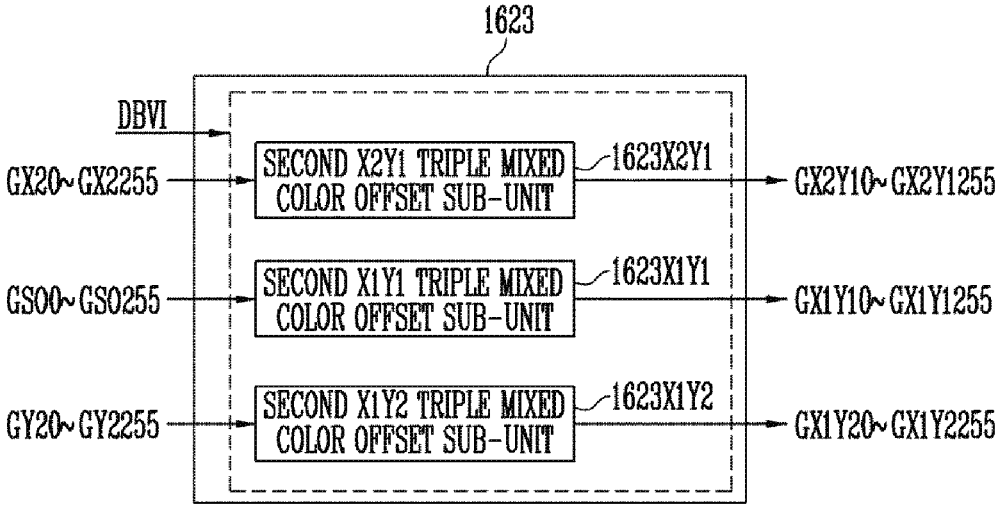

Referring to FIG. 41, the second triple mixed color offset provider 1623 may include second triple mixed color offset sub-units 1623X1Y1, 1623X1Y2, and 1623X2Y1.

A second X1Y1 triple mixed color offset sub-unit 1623X1Y1 may provide second X1Y1 triple mixed color offset values GX1Y10 to GX1Y1255 corresponding to when the first color light emitting pixel number is 1 and the third color light emitting pixel number is 1, with respect to a target pixel of the second color. For example, the second X1Y1 triple mixed color offset values GX1Y10 to GX1Y1255 may be determined using the following Equation 13.

$$GX1Y1 = W_GX1Y1 * \frac{GSO + GX2Y2}{2} \quad \text{Equation 13}$$

Here, GX1Y1 may be a second X1Y1 triple mixed color offset value corresponding to an input grayscale value, W_GX1Y1 may be a weighted value, GSO may be a second single color offset value corresponding to the input grayscale value, and GX2Y2 may be a white color offset value corresponding to the input grayscale value. The weighted value W_GX1Y1 may be increased as the input grayscale value is increased. The weighted value W_GX1Y1 may be a real number that is 0 or more and is 1 or less. The weighted value W_GX1Y1 may vary depending on the input maximum luminance value DBVI. GX2Y2 may be 0.

A second X1Y2 triple mixed color offset sub-unit 1623X1Y2 may provide second X1Y2 triple mixed color offset values GX1Y20 to GX1Y2255 corresponding to when the first color light emitting pixel number is 1 and the third color light emitting pixel number is 2, with respect to a target pixel of the second color. For example, the second X1Y2 triple mixed color offset values GX1Y20 to GX1Y2255 may be determined using the following Equation 14.

$$GX1Y2 = W_GX1Y2 * \frac{GY2 + GX2Y2}{2} \quad \text{Equation 14}$$

Here, GX1Y2 may be a second X1Y2 triple mixed color offset value corresponding to an input grayscale value, W_GX1Y2 may be a weighted value, GY2 may be a second Y2 double mixed color offset value corresponding to the input grayscale value, and GX2Y2 may be a white color offset value corresponding to the input grayscale value. The weighted value W_GX1Y2 may be increased as the input grayscale value is increased. The weighted value W_GX1Y2 may be a real number that is 0 or more and is 1 or less. The weighted value W_GX1Y2 may vary depending on the input maximum luminance value DBVI. GX2Y2 may be 0.

A second X2Y1 triple mixed color offset sub-unit 1623X2Y may provide second X2Y1 triple mixed color offset values GX2Y10 to GX2Y1255 corresponding to when the first color light emitting pixel number is 2 and the third color light emitting pixel number is 1, with respect to a target pixel of the second color. For example, the second X2Y1 triple mixed color offset values GX2Y10 to GX2Y1255 may be determined using the following Equation 15.

$$GX2Y1 = W_GX2Y1 * \frac{GX2 + GX2Y2}{2} \quad \text{Equation 15}$$

Here, GX2Y1 may be a second X2Y1 triple mixed color offset value corresponding to an input grayscale value, W_GX2Y1 may be a weighted value, GX2 may be a second X2 double mixed color offset value corresponding to the input grayscale value, and GX2Y2 may be a white color offset value corresponding to the input grayscale value. The weighted value W_GX2Y1 may be increased as the input grayscale value is increased. The weighted value W_GX2Y1 may be a real number that is 0 or more and is 1 or less. The weighted value W_GX2Y1 may vary depending on the input maximum luminance value DBVI. GX2Y2 may be 0.

Figure 42:
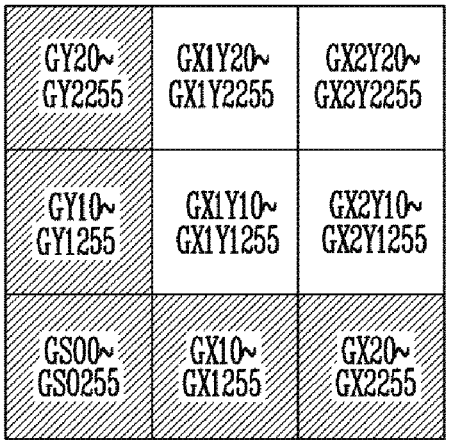
Figure 43:
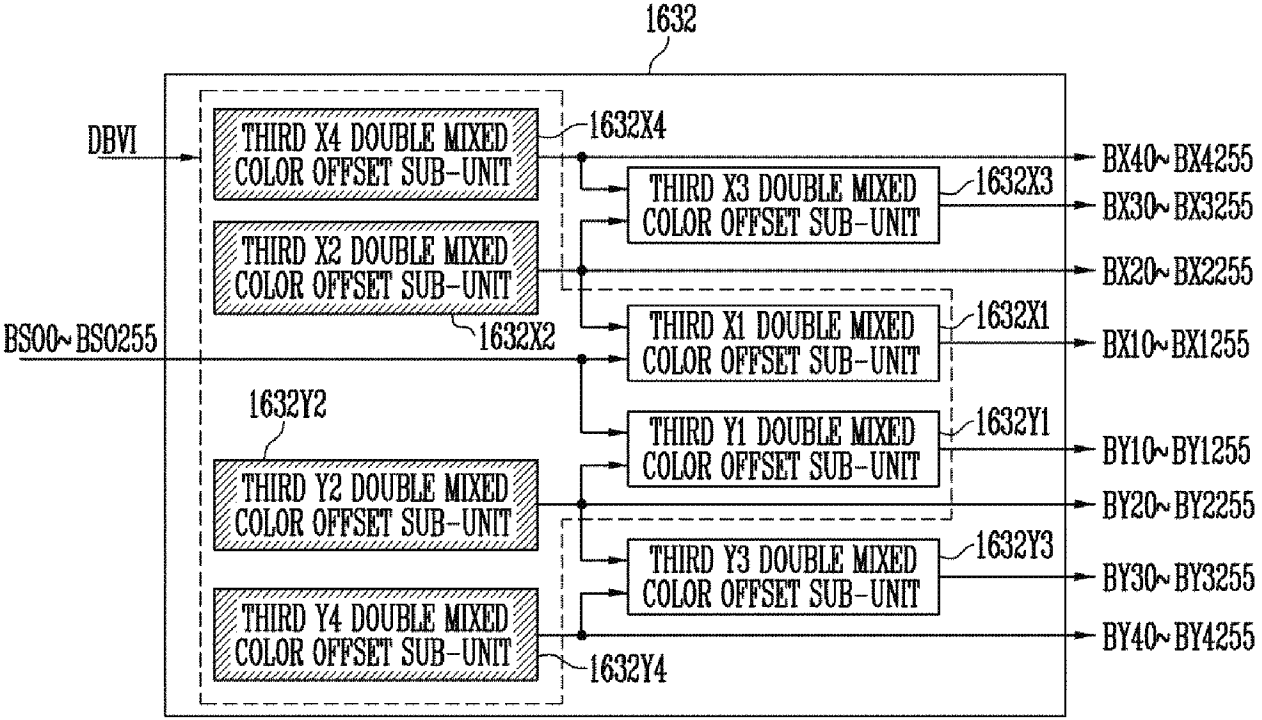
Figure 44:
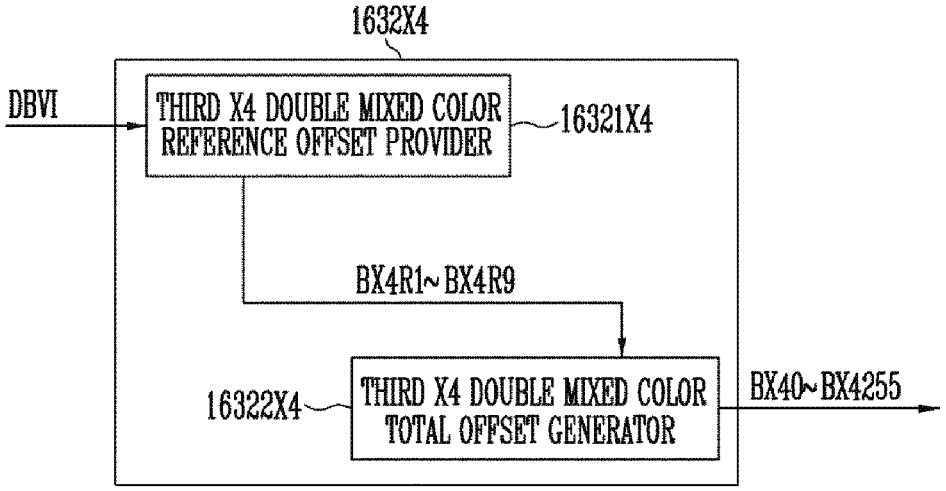
Figure 45:
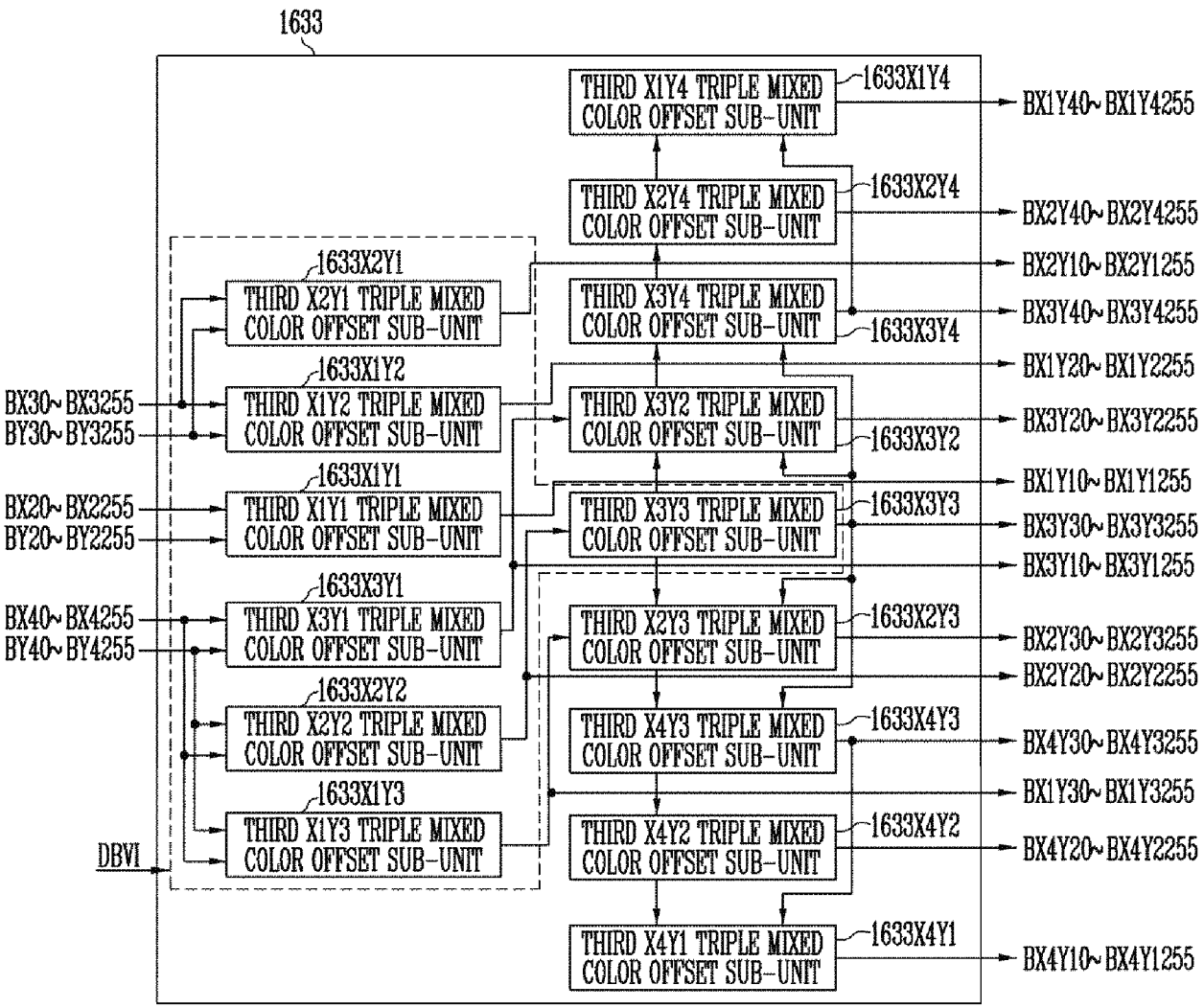

FIG. 42 illustrates a table obtained by organizing a relationship of double mixed color offset values and triple mixed color offset values, with respect to a target pixel of the second color. In accordance with the exemplary embodiment shown in FIGS. 39 to 41, a memory device is used only when the second single color offset values GSO0 to GSO255 and the second double mixed color offset values GX10 to GX1255, GX20 to GX2255, GY10 to GY1255, and GY20 to GY2255 are generated, and the second triple mixed color offset values GX1Y10 to GX1Y1255, GX2Y10 to GX2Y1255, GX1Y20 to GX1Y2255, and GX2Y20 to GX2Y2255 are produced through calculation, so that the configuration cost of the memory device can be reduced.

FIGS. 43 to 46 are diagrams illustrating a third double mixed color offset provider and a third triple mixed color offset provider according to an exemplary embodiment of the inventive concept.

Except that a target pixel is a pixel emitting light of the third color, the third double mixed color offset provider 1632 corresponds to the first double mixed color offset provider 1612 shown in FIG. 35, and the third triple mixed color offset provider 1633 corresponds to the third triple mixed color offset provider 1613 shown in FIG. 37. Therefore, overlapping descriptions will be omitted.

In the display device and the driving method thereof in accordance with exemplary embodiments of the inventive concept, the display device can exhibit a desired luminance even when single color light and mixed color light are emitted in addition to white color light.

While the inventive concept has been shown and described with reference to exemplary embodiments thereof, it will be understood by those of ordinary skill in the art that various changes in form and details may be made thereto without departing from the spirit and scope of the inventive concept as set forth in the following claims.

What is claimed is:

1. A display device comprising:
a processor; and
a display panel configured to receive observation grayscale values from the processor,
wherein the display panel includes:
a data driver configured to apply data voltages to data lines;
a target pixel coupled to at least one of the data lines; and
observation pixels each coupled to at least one of the data lines, and located adjacent to the target pixel,
wherein the display panel applies a first data voltage to the target pixel, when the observation grayscale values for the observation pixels exceed a reference value,
wherein the display panel applies a second data voltage to the target pixel, when at least one of the observation grayscale values does not exceed the reference value,
wherein the first data voltage and the second data voltage are different from each other,
wherein, when a driving transistor of the target pixel is a P-type transistor, the first data voltage is larger than the second data voltage, and
wherein, when the driving transistor of the target pixel is an N-type transistor, the first data voltage is smaller than the second data voltage.

2. The display device of claim 1, wherein no other pixels exist between the target pixel and the observation pixels.

3. The display device of claim 2, wherein the target pixel emits light of a first color, and
wherein some of the observation pixels emit light of a second color different from the first color, and the others of the observation pixels emit light of a third color different from the first color and the second color.

4. The display device of claim 1, wherein the display panel is further configured to receive an input grayscale value from the processor, and
wherein the display panel applies the first data voltage and the second data voltage when the input grayscale value for the target pixel exceeds the reference value.

5. A display device comprising:
a target pixel configured to emit light of a first color;
second color observation pixels located adjacent to the target pixel, and configured to emit light of a second color different from the first color;
third color observation pixels located adjacent to the target pixel, and configured to emit light of a third color different from the first color and the second color; and
a grayscale corrector configured to convert an input grayscale value corresponding to the target pixel, with reference to second color observation grayscale values corresponding to the second color observation pixels and third color observation grayscale values corresponding to the third color observation pixels,
wherein the grayscale corrector includes:
a light emitting pixel counter configured to provide a second color light emitting pixel number by counting a number of the second color observation grayscale values that exceed a reference value, and provide a third color light emitting pixel number by counting a number of the third color observation grayscale values that exceed the reference value; and a grayscale converter configured to provide a converted grayscale value obtained by converting the input grayscale value, based on the second color light emitting pixel number and the third color light emitting pixel number.

6. The display device of claim 5, wherein the grayscale corrector further includes a single color offset provider configured to provide single color offset values, and wherein, when the second color light emitting pixel number is 0 and the third color light emitting pixel number is 0, the grayscale converter generates the converted grayscale value by adding a corresponding offset value among the single color offset values to the input grayscale value.

7. The display device of claim 6, wherein the grayscale corrector further includes a double mixed color offset provider configured to provide double mixed color offset values, and wherein, when the second color light emitting pixel number is greater than 0 and the third color light emitting pixel number is 0, the grayscale converter generates the converted grayscale value by adding a corresponding offset value among the double mixed color offset values to the input grayscale value.

8. The display device of claim 7, wherein the grayscale corrector further includes a triple mixed color offset provider configured to provide triple mixed color offset values, and wherein, when the second color light emitting pixel number is greater than 0, the third color light emitting pixel number is greater than 0, and the second color light emitting pixel number and the third color light emitting pixel number are not respectively equal to a number of the second color observation pixels and a number of the third color observation pixels, the grayscale converter generates the converted grayscale value by adding a corresponding offset value among the triple mixed color offset values to the input grayscale value.

9. The display device of claim 8, wherein the grayscale converter determines the input grayscale value as the converted grayscale value, when the second color light emitting pixel number is equal to the number of the second color observation pixels and the third color light emitting pixel number is equal to the number of the third color observation pixels.

10. The display device of claim 9, wherein the single color offset provider includes:

a single color reference offset provider configured to receive an input maximum luminance value, and provide reference offset values corresponding to the input maximum luminance value; and a single color total offset generator configured to generate the single color offset values by interpolating the reference offset values.

11. The display device of claim 10, wherein the single color reference offset provider includes a single color preset determiner configured to pre-store preset offset values corresponding to preset maximum luminance values, and determine whether the input maximum luminance value corresponds to any one of the preset maximum luminance values, and wherein, when the input maximum luminance value corresponds to any one of the preset maximum luminance values, the single color preset determiner provides the corresponding preset offset values as the reference offset values.

12. The display device of claim 11, wherein, when the input maximum luminance value does not correspond to any one of the preset maximum luminance values, the single color preset determiner provides the preset offset values corresponding to at least two preset maximum luminance values, and wherein the single color reference offset provider further includes a single reference offset generator configured to generate the reference offset values by interpolating the preset offset values corresponding to the at least two preset maximum luminance values.

13. The display device of claim 12, wherein the preset maximum luminance values include a maximum value and a minimum value of the receivable input maximum luminance value.

14. The display device of claim 13, wherein the preset maximum luminance values further include a first intermediate maximum luminance value, and wherein, when the input maximum luminance value is a value between the maximum value and the first intermediate maximum luminance value, a grayscale voltage corresponding to the converted grayscale value is adjusted corresponding to the input maximum luminance value.

15. The display device of claim 14, wherein, when the input maximum luminance value is a value between the minimum value and the first intermediate maximum luminance value, an emission period of the target pixel is adjusted corresponding to the input maximum luminance value.

16. The display device of claim 15, wherein the preset maximum luminance values further include a second intermediate maximum luminance value that is a value between the first intermediate maximum luminance value and the minimum value.

17. A method for driving a display device, wherein the display device includes:

a target pixel configured to emit light of a first color;

second color observation pixels located adjacent to the target pixel, and configured to emit light of a second color different from the first color; and third color observation pixels located adjacent to the target pixel, and configured to emit light of a third color different from the first color and the second color, wherein the driving method comprising:

receiving an input grayscale value corresponding to the target pixel, second color observation grayscale values corresponding to the second color observation pixels, and third color observation grayscale values corresponding to the third color observation pixels;

determining a second color light emitting pixel number by counting a number of the second color observation grayscale values that exceed a reference value;

determining a third color light emitting pixel number by counting a number of the third color observation grayscale values that exceed the reference value; and generating a converted grayscale value by converting the input grayscale value, based on the second color light emitting pixel number and the third color light emitting pixel number.

18. The method of claim 17, wherein, in the generating of the converted grayscale value, the converted grayscale value is generated by adding a single color offset value to the input grayscale value, when the second color light emitting pixel number is 0 and the third color light emitting pixel number is 0.

19. The method of claim 18, wherein, in the generating of the converted grayscale value, the converted grayscale value is generated by adding a double mixed color offset value to the input grayscale value, when the second color light emitting pixel number is greater than 0 and the third color light emitting pixel number is 0.

20. The method of claim 19, wherein, in the generating of the converted grayscale value, the converted grayscale value is generated by adding a triple mixed color offset value to the input grayscale value, when the second color light emitting pixel number is greater than 0, the third color light emitting pixel number is greater than 0, and the second color light emitting pixel number and the third color light emitting pixel number are not respectively equal to a number of the second color observation pixels and a number of the third color observation pixels.

21. The method of claim 20, wherein, in the generating of the converted grayscale value, the input grayscale value is determined as the converted grayscale value, when the second color light emitting pixel number is equal to the number of the second color observation pixels, and the third color light emitting pixel number is equal to the number of the third color observation pixels.

* * * * *